US008192168B2

(12) United States Patent
Bonini et al.

(10) Patent No.: US 8,192,168 B2
(45) Date of Patent: Jun. 5, 2012

(54) AIRFOIL SHAPE FOR A COMPRESSOR BLADE

(75) Inventors: Eric R. Bonini, Greer, SC (US); Thomas R. Tipton, Greer, SC (US); Bruce C. Busbey, Greer, SC (US); Christopher E. LaMaster, Simpsonville, SC (US); Jamie D. Lumpkin, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 937 days.

(21) Appl. No.: 12/208,426

(22) Filed: Sep. 11, 2008

(65) Prior Publication Data

US 2010/0061862 A1 Mar. 11, 2010

(51) Int. Cl.
*F01D 5/14* (2006.01)

(52) U.S. Cl. ..... 416/223 A; 416/241 R; 416/243

(58) Field of Classification Search ..... 416/223 A, 416/214 R, 243; 415/199.5
See application file for complete search history.

(56) References Cited

U.S. PATENT DOCUMENTS

| | | | | |
|---|---|---|---|---|
| 7,534,094 | B2 * | 5/2009 | Tomberg et al. | 416/223 A |
| 7,540,715 | B2 * | 6/2009 | Latimer et al. | 416/223 A |
| 7,566,202 | B2 * | 7/2009 | Noshi et al. | 416/223 A |
| 7,568,892 | B2 * | 8/2009 | Devangada et al. | 416/223 A |

* cited by examiner

*Primary Examiner* — Ninh H Nguyen
(74) *Attorney, Agent, or Firm* — Ernest G. Cusick; Frank A. Landgraff

(57) ABSTRACT

An article of manufacture having a nominal profile substantially in accordance with Cartesian coordinate values of X, Y and Z set forth in TABLE A. X and Y are distances in inches which, when connected by smooth continuing arcs, define airfoil profile sections at each distance Z in inches. The profile sections at the Z distances can be joined smoothly with one another to form a complete airfoil shape.

8 Claims, 5 Drawing Sheets

AIRFOIL SHAPE FOR A COMPRESSOR BLADE

BACKGROUND OF THE INVENTION

The present invention relates to airfoils for a blade of a gas turbine. In particular, the invention relates to compressor airfoil profiles for a "Stage 0" rotor blade.

In a gas turbine, many system requirements should be met at each stage of a gas turbine's flow path section to meet design goals. A turbine hot gas path requires that the compressor airfoil rotor blade meet design goals and desired requirements of efficiency, reliability, and loading. For example, and in no way limiting of the invention, a blade of a compressor rotor should achieve thermal and mechanical operating requirements for that particular stage.

Past efforts to meet design goals and desired requirements have provided coatings on the airfoil, but the coatings may not be robust enough or permanent to provide design goals and desired requirements. Accordingly, it is desirable to provide an airfoil configuration with a profile meet to design goals and desired requirements.

BRIEF DESCRIPTION OF THE INVENTION

In one embodiment of the invention, an article of manufacture comprises a blade airfoil having an airfoil shape, the airfoil having a nominal profile substantially in accordance with Cartesian coordinate values of X, Y and Z set forth in TABLE A. X and Y are distances which, when connected by smooth continuing arcs, define airfoil profile sections at each distance Z in inches. The profile sections at the Z distances are joined smoothly with one another to form a complete airfoil shape.

In another embodiment according to the invention, a compressor blade includes a blade airfoil having an uncoated nominal airfoil profile substantially in accordance with Cartesian coordinate values of X, Y and Z set forth in TABLE A. X and Y are distances in inches which, when connected by smooth continuing arcs, define airfoil profile sections at each Z distance in inches. The profile sections at the Z distances are joined smoothly with one another to form a complete airfoil shape. X and Y distances are scalable as a function of a constant to provide a scaled-up or scaled-down airfoil.

In a further embodiment of the invention, a compressor comprises a compressor wheel having a plurality of blades. Each of the blades includes an airfoil having an airfoil shape. The airfoil comprises a nominal profile substantially in accordance with Cartesian coordinate values of X, Y and Z set forth in TABLE A. X and Y are distances in inches which, when connected by smooth continuing arcs, define the airfoil profile sections at each distance Z in inches. The profile sections at the Z distances are joined smoothly with one another to form a complete airfoil shape.

In a yet further embodiment of the invention, a compressor comprises a compressor wheel having a plurality of blades, and each of the blades include an airfoil having an uncoated nominal airfoil profile substantially in accordance with Cartesian coordinate values of X, Y and Z set forth in TABLE A. X and Y are distances which, when connected by smooth continuing arcs, define airfoil profile sections at each distance Z in inches. The profile sections at the Z distances are joined smoothly with one another to form a complete airfoil shape. The X, Y and Z distances are scalable as a function of a constant to provide a scaled-up or scaled-down blade airfoil.

DETAILED DESCRIPTION OF THE INVENTION

Figure 1:
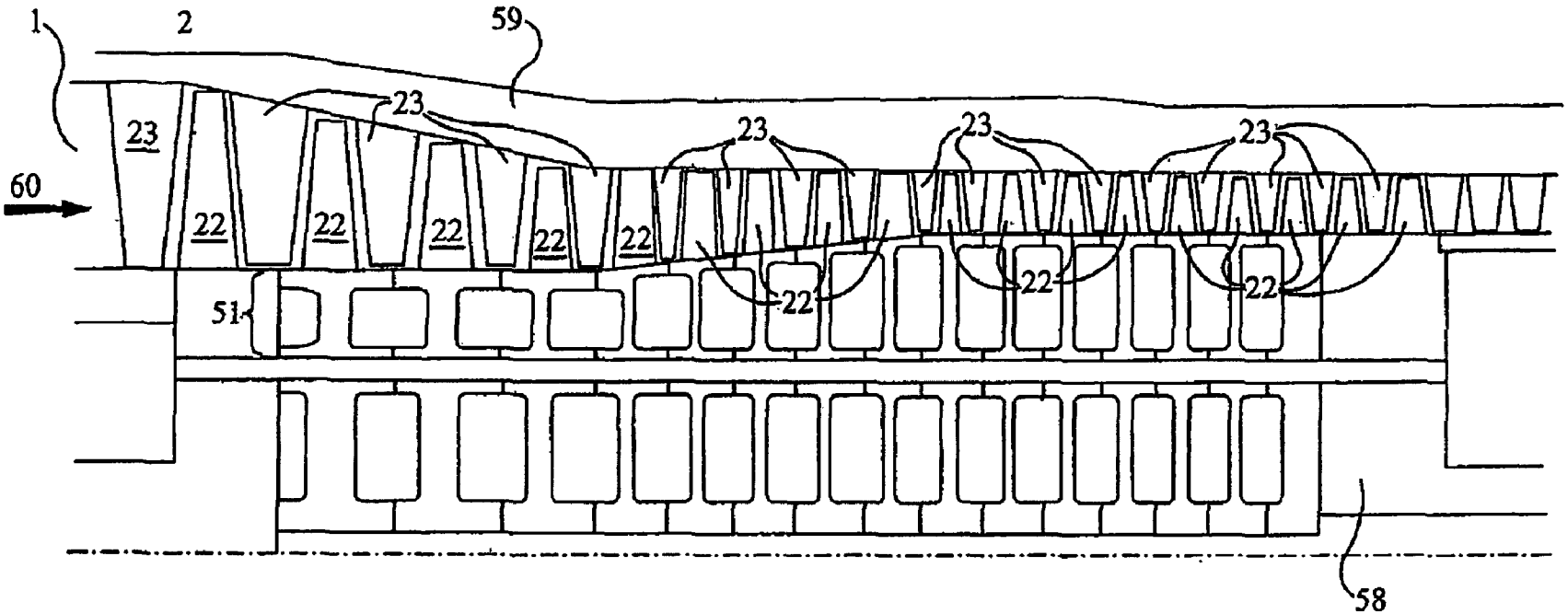
FIG. 1 is a schematic representation of a compressor flow path through multiple stages of a gas turbine and illustrates an exemplary blade airfoil according to an embodiment of the invention.
Figure 4:
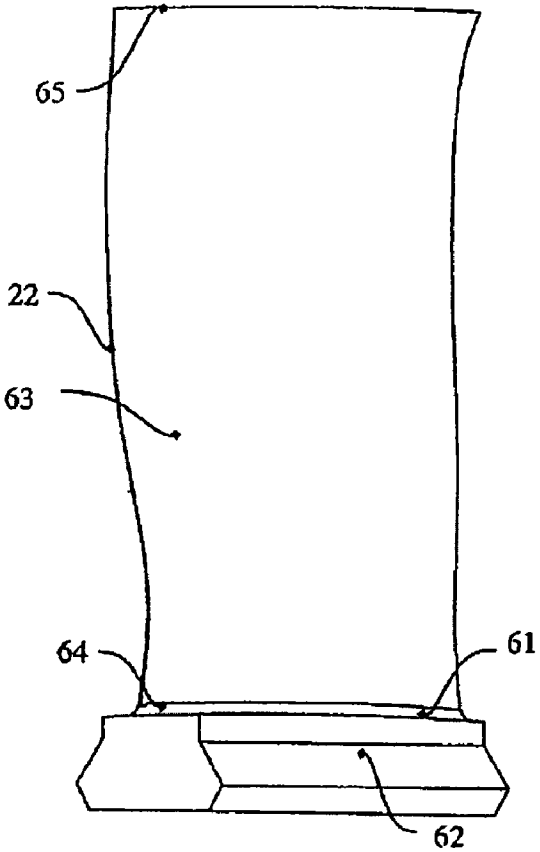
FIGS. 4 and 5 are side elevational views of the blade of FIG. 2 and associated platform and dovetail connection as viewed in a generally circumferential direction from the pressure and suction sides of the airfoil, respectively.
Figure 3:
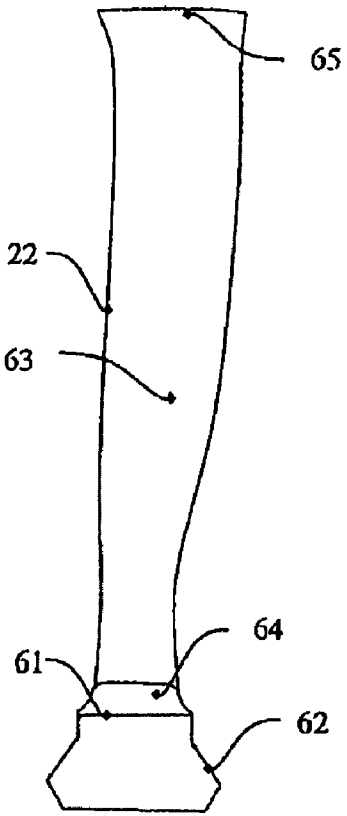
FIGS. 2 and 3 are respective perspective views of a blade according to an embodiment of the invention with the blade airfoil illustrated in conjunction with its platform and its substantially or near axial entry dovetail connection.
Figure 2:
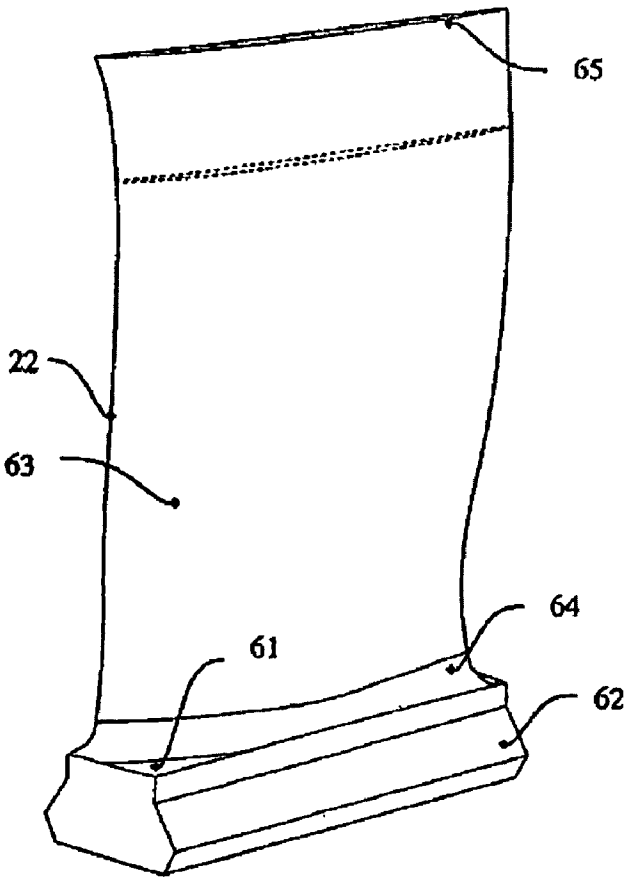

In accordance with one embodiment of the instant invention, an article of manufacture has a nominal profile substantially in accordance with Cartesian coordinate values of X, Y and Z set forth in TABLE A, and wherein X and Y are distances in inches which, when connected by smooth continuing arcs, define airfoil profile sections at each distance Z in inches, the profile sections at the Z distances being joined smoothly with one another to form a complete airfoil shape.

In accordance with one embodiment of the instant invention, there is provided an airfoil compressor shape for a blade of a gas turbine that enhances the performance of the gas turbine. The airfoil shape hereof also improves the interaction between various stages of the compressor, while simultaneously reducing stage airfoil thermal and mechanical stresses.

The blade airfoil profile, as embodied by the invention, is defined by a unique loci of points to achieve the necessary efficiency and loading requirements whereby improved compressor performance is obtained. These unique loci of points define the nominal airfoil profile and are identified by the X, Y and Z Cartesian coordinates of the TABLE A that follows. The points for the coordinate values shown in TABLE A are relative to the engine centerline and for a cold, i.e., room temperature blade at various cross-sections of the blade's airfoil along its length. The positive X, Y and Z directions are axial toward the exhaust end of the turbine, tangential in the direction of engine rotation and radially outwardly toward the static case, respectively. The X, Y, and Z coordinates are given in distance dimensions, e.g., units of inches, and are joined smoothly at each Z location to form a smooth continuous airfoil cross-section. Each defined airfoil section in the X, Y plane is joined smoothly with adjacent airfoil sections in the Z direction to form the complete airfoil shape.

It will be appreciated that an airfoil heats up during use, as known by a person of ordinary skill in the art. The airfoil profile will thus change as a result of mechanical loading and temperature. Accordingly, the cold or room temperature profile, for manufacturing purposes, is given by X, Y and Z coordinates. A distance of plus or minus about 0.160 inches (+/−0.160") from the nominal profile in a direction normal to any surface location along the nominal profile and which includes any coating, defines a profile envelope for this blade airfoil, because a manufactured blade airfoil profile may be different from the nominal airfoil profile given by the following tables. The airfoil shape is robust to this variation, without impairment of the mechanical and aerodynamic functions of the blade.

The airfoil, as embodied by the invention, can be scaled up or scaled down geometrically for introduction into similar turbine designs. Consequently, the X, Y and Z coordinates of the nominal airfoil profile may be a function of a constant. That is, the X, Y and Z coordinate values may be multiplied or divided by the same constant or number to provide a "scaled-up" or "scaled-down" version of the blade airfoil profile, while retaining the airfoil section shape, as embodied by the invention.

Referring now to the drawings, FIG. 1 illustrates an axial compressor flow path 1 of a gas turbine compressor 2 includes a plurality of compressor stages. The compressor stages are sequentially numbered in the Figure. The compressor flow path may comprise seventeen rotor stages and stator stages. However, the exact number of rotor and stator stages is a choice of engineering design. Any number of rotor and stator stages can be provided in the combustor, as embodied by the invention. The seventeen rotor stages are merely exemplary of one turbine design. The seventeen rotor stages, as embodied by the invention, are not intended to limit the invention in any manner.

The compressor blades impart kinetic energy to the airflow and therefore bring about a desired pressure rise. Directly following the rotor airfoils is a stage of stator airfoils. Both the rotor and stator airfoils turn the airflow, slow the airflow velocity (in the respective airfoil frame of reference), and yield a rise in the static pressure of the airflow. Typically, multiple rows of rotor/stator stages are stacked in axial flow compressors to achieve a desired discharge to inlet pressure ratio. Rotor and stator airfoils can be secured to rotor wheels or stator case by an appropriate attachment configuration, often known as a "root", "base" or "dovetail" (see FIGS. 2-5).

Figure 9:
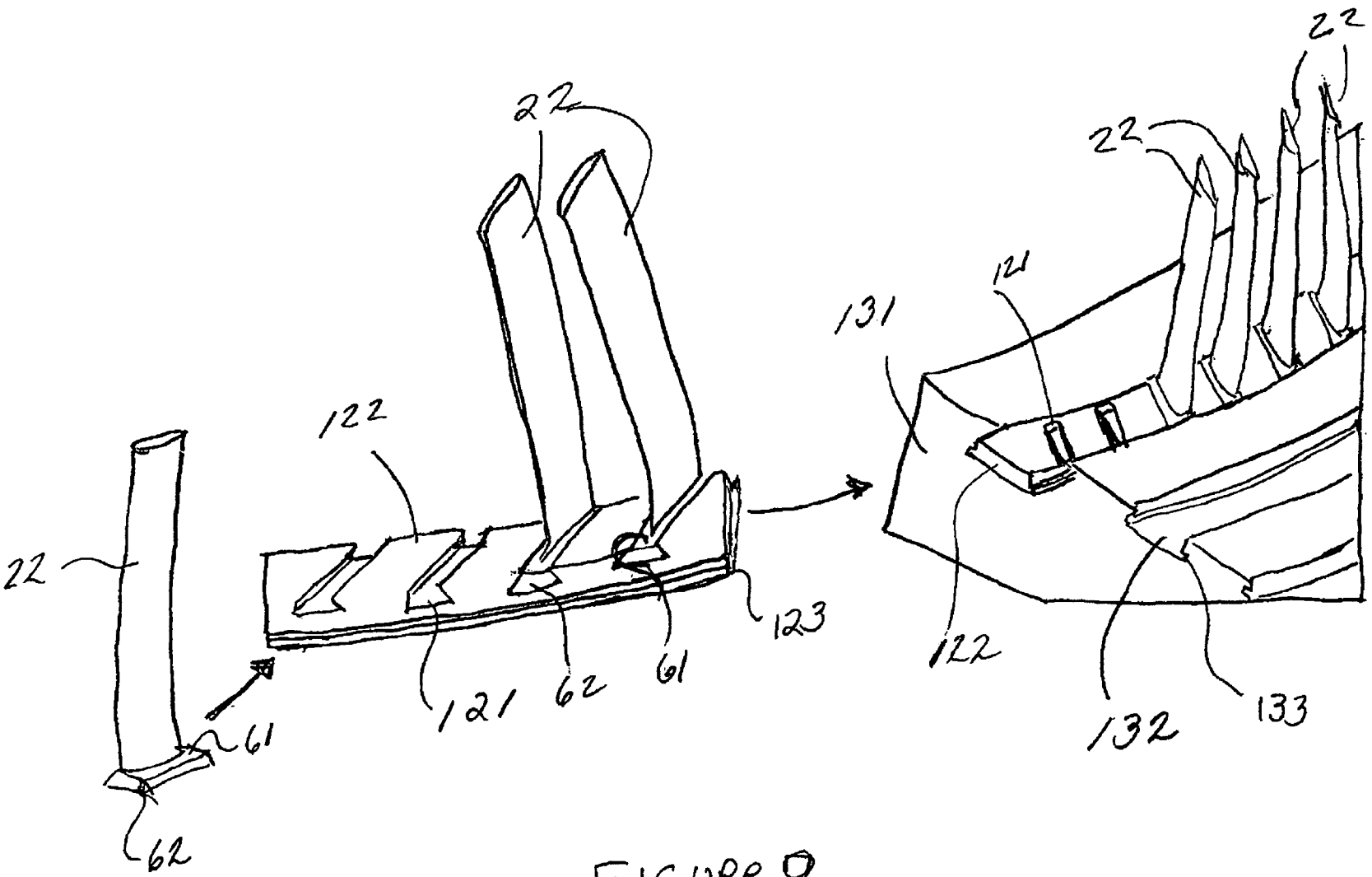
FIG. 9 is a schematic view of a vane, ring, and wheel configuration, as embodied by the invention.

The vanes 22, as embodied by the invention, and as illustrated in FIGS. 5 and 7-9, comprises a platform 61 and a dovetail 62 configuration. As in FIG. 9, as embodied by another embodiment of the invention, the vane 22 may be inserted into a cutout 121 of a ring 122. In turn, the ring 122 may be inserted into a slot 132 of a wheel 131. The ring 122 may comprises a tab 123 that is inserted into slot 133 in the wheel 131. The arrangement of FIG. 9 provides a stable and secure mounting of the vanes 22 in the overall apparatus.

Figure 6:
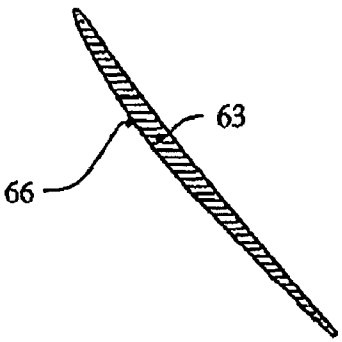
FIG. 6 is a cross-sectional view of the blade airfoil taken generally about on line 6-6 in FIG. 5.

The blades 22 are mounted on the rotor wheel 51 forming part of forward drive shaft 58. Each blade 22, as illustrated in FIGS. 2-6, is provided with a platform 61, and substantially or near axial entry dovetail 62 for connection with a complementary-shaped mating dovetail, not shown, on the rotor wheel 51. An axial entry dovetail, however, may be provided with the airfoil profile, as embodied by the invention. Each blade 22 comprises a blade airfoil 63, as illustrated in FIGS. 2-6. Thus, each of the blades 22 has a blade airfoil profile 66 at any cross-section from the airfoil root 64 at a midpoint of platform 61 to the blade tip 65 in the general shape of an airfoil (FIG. 6).

To define the airfoil shape of the blade airfoil, a unique set or loci of points in space are provided. This unique set or loci of points meet the stage requirements so the stage can be manufactured. This unique loci of points also meets the desired requirements for stage efficiency and reduced thermal and mechanical stresses. The loci of points are arrived at by iteration between aerodynamic and mechanical loadings enabling the compressor to run in an efficient, safe and smooth manner.

The loci, as embodied by the invention, defines the blade airfoil profile and can comprise a set of points relative to the axis of rotation of the engine. For example, a set of points can be provided to define a blade airfoil profile. Furthermore, the blade airfoil profile, as embodied by the invention, can comprise a first rotating stage "R0" of a compressor.

A Cartesian coordinate system of X, Y and Z values given in TABLE A below defines a profile of a blade airfoil at various locations along its length. The coordinate values for the X, Y and Z coordinates are set forth in inches, although other units of dimensions may be used when the values are appropriately converted. These values exclude fillet regions of the platform. The Cartesian coordinate system has orthogonally-related X, Y and Z axes. The X axis lies parallel to the compressor rotor centerline, such as the rotary axis. A positive X coordinate value is axial toward the aft, for example the exhaust end of the compressor. A positive Y coordinate value directed aft extends tangentially in the direction of rotation of the rotor. A positive Z coordinate value is directed radially outward toward the static casing of the compressor.

By defining X and Y coordinate values at selected locations in a Z direction normal to the X, Y plane, the profile section of the blade airfoil, such as, but not limited to the profile section 66 in FIG. 6, at each Z distance along the length of the airfoil can be ascertained. By connecting the X and Y values with smooth continuing arcs, each profile section 66 at each distance Z can be fixed. The airfoil profiles of the various surface locations between the distances Z are determined by smoothly connecting the adjacent profile sections 66 to one another, thus forming the airfoil profile. These values represent the airfoil profiles at ambient, non-operating or non-hot conditions and are for an uncoated airfoil.

TABLE A values are generated and shown to three decimal places for determining the profile of the airfoil. There are typical manufacturing tolerances as well as coatings, which should be accounted for in the actual profile of the airfoil. Accordingly, the values for the profile given are for a nominal airfoil. It will therefore be appreciated that +/− typical manufacturing tolerances, such as, +/− values, including any coating thicknesses, are additive to the X and Y values. Therefore, a distance of about +/−0.160 inches in a direction normal to any surface location along the airfoil profile defines an airfoil profile envelope for a blade airfoil design and compressor. In other words, a distance of about +/−0.160 inches in a direction normal to any surface location along the airfoil profile defines a range of variation between measured points on the actual airfoil surface at nominal cold or room temperature and the ideal position of those points, at the same temperature, as embodied by the invention. The blade airfoil design, as embodied by the invention, is robust to this range of variation without impairment of mechanical and aerodynamic functions.

The coordinate values given in the TABLE A below provide the nominal profile envelope for an exemplary R0 stage rotor.

TABLE A

| X | Y | Z |
|---|---|---|
| 3.566267 | 0.538501 | −0.2506 |
| 3.568513 | 0.527072 | −0.2506 |
| 3.569998 | 0.511731 | −0.2506 |
| 3.569432 | 0.492391 | −0.2506 |
| 3.565205 | 0.469583 | −0.2506 |
| 3.55372 | 0.44086 | −0.2506 |
| 3.529741 | 0.408758 | −0.2506 |

TABLE A-continued

| X | Y | Z |
|---|---|---|
| 3.488467 | 0.380549 | −0.2506 |
| 3.432629 | 0.35522 | −0.2506 |
| 3.366141 | 0.325185 | −0.2506 |
| 3.288268 | 0.290189 | −0.2506 |
| 3.19614 | 0.24905 | −0.2506 |
| 3.089689 | 0.201928 | −0.2506 |
| 2.968822 | 0.149037 | −0.2506 |
| 2.833387 | 0.090731 | −0.2506 |
| 2.683216 | 0.027393 | −0.2506 |
| 2.518106 | −0.04047 | −0.2506 |
| 2.34506 | −0.10933 | −0.2506 |
| 2.163876 | −0.17861 | −0.2506 |
| 1.974319 | −0.2477 | −0.2506 |
| 1.776177 | −0.31589 | −0.2506 |
| 1.569485 | −0.38222 | −0.2506 |
| 1.354037 | −0.44571 | −0.2506 |
| 1.129522 | −0.50518 | −0.2506 |
| 0.903196 | −0.55779 | −0.2506 |
| 0.674953 | −0.60312 | −0.2506 |
| 0.445096 | −0.64074 | −0.2506 |
| 0.2144 | −0.6699 | −0.2506 |
| −0.01715 | −0.69012 | −0.2506 |
| −0.2496 | −0.70102 | −0.2506 |
| −0.48257 | −0.7023 | −0.2506 |
| −0.71489 | −0.69293 | −0.2506 |
| −0.94639 | −0.67151 | −0.2506 |
| −1.17701 | −0.63797 | −0.2506 |
| −1.40597 | −0.594 | −0.2506 |
| −1.62525 | −0.5424 | −0.2506 |
| −1.8338 | −0.48399 | −0.2506 |
| −2.03189 | −0.4199 | −0.2506 |
| −2.22015 | −0.35172 | −0.2506 |
| −2.39895 | −0.28044 | −0.2506 |
| −2.56855 | −0.20669 | −0.2506 |
| −2.72939 | −0.13165 | −0.2506 |
| −2.88158 | −0.05558 | −0.2506 |
| −3.01758 | 0.01954 | −0.2506 |
| −3.13607 | 0.093721 | −0.2506 |
| −3.23672 | 0.166519 | −0.2506 |
| −3.32561 | 0.242272 | −0.2506 |
| −3.39542 | 0.315275 | −0.2506 |
| −3.44173 | 0.378083 | −0.2506 |
| −3.47108 | 0.433198 | −0.2506 |
| −3.48505 | 0.477713 | −0.2506 |
| −3.48828 | 0.51274 | −0.2506 |
| −3.48615 | 0.532251 | −0.2506 |
| −3.48289 | 0.544442 | −0.2506 |
| −3.48092 | 0.550441 | −0.2506 |
| −3.47993 | 0.553439 | −0.2506 |
| −3.47937 | 0.55492 | −0.2506 |
| −3.47879 | 0.55626 | −0.2506 |
| −3.47751 | 0.558878 | −0.2506 |
| −3.47498 | 0.564121 | −0.2506 |
| −3.46969 | 0.574475 | −0.2506 |
| −3.46017 | 0.589899 | −0.2506 |
| −3.43942 | 0.615233 | −0.2506 |
| −3.40685 | 0.64377 | −0.2506 |
| −3.35682 | 0.672922 | −0.2506 |
| −3.28855 | 0.696164 | −0.2506 |
| −3.19587 | 0.707632 | −0.2506 |
| −3.088 | 0.700734 | −0.2506 |
| −2.97492 | 0.680013 | −0.2506 |
| −2.84903 | 0.65041 | −0.2506 |
| −2.70941 | 0.616322 | −0.2506 |
| −2.555 | 0.582742 | −0.2506 |
| −2.39295 | 0.550839 | −0.2506 |
| −2.22351 | 0.520316 | −0.2506 |
| −2.0466 | 0.492043 | −0.2506 |
| −1.86199 | 0.467816 | −0.2506 |
| −1.66959 | 0.448495 | −0.2506 |
| −1.46948 | 0.433302 | −0.2506 |
| −1.26167 | 0.422244 | −0.2506 |
| −1.04626 | 0.41617 | −0.2506 |
| −0.83075 | 0.415164 | −0.2506 |
| −0.61527 | 0.418296 | −0.2506 |
| −0.39989 | 0.424812 | −0.2506 |
| −0.18465 | 0.434117 | −0.2506 |
| 0.03048 | 0.445544 | −0.2506 |

TABLE A-continued

| X | Y | Z |
|---|---|---|
| 0.245532 | 0.458386 | −0.2506 |
| 0.460538 | 0.472081 | −0.2506 |
| 0.675516 | 0.486293 | −0.2506 |
| 0.89048 | 0.500757 | −0.2506 |
| 1.10544 | 0.515273 | −0.2506 |
| 1.32041 | 0.529651 | −0.2506 |
| 1.528241 | 0.543143 | −0.2506 |
| 1.728941 | 0.555619 | −0.2506 |
| 1.922503 | 0.567146 | −0.2506 |
| 2.108922 | 0.577813 | −0.2506 |
| 2.288193 | 0.587683 | −0.2506 |
| 2.460312 | 0.596807 | −0.2506 |
| 2.625275 | 0.605249 | −0.2506 |
| 2.775902 | 0.612787 | −0.2506 |
| 2.912192 | 0.619423 | −0.2506 |
| 3.034142 | 0.625261 | −0.2506 |
| 3.141743 | 0.630442 | −0.2506 |
| 3.234998 | 0.63491 | −0.2506 |
| 3.313911 | 0.638596 | −0.2506 |
| 3.381348 | 0.641688 | −0.2506 |
| 3.438036 | 0.643645 | −0.2506 |
| 3.483633 | 0.634179 | −0.2506 |
| 3.516143 | 0.615717 | −0.2506 |
| 3.537038 | 0.595893 | −0.2506 |
| 3.549708 | 0.578447 | −0.2506 |
| 3.558094 | 0.562525 | −0.2506 |
| 3.563306 | 0.548978 | −0.2506 |
| 3.565435 | 0.46178 | 0 |
| 3.567436 | 0.450454 | 0 |
| 3.568471 | 0.435269 | 0 |
| 3.567137 | 0.416168 | 0 |
| 3.561745 | 0.39396 | 0 |
| 3.548352 | 0.366489 | 0 |
| 3.521723 | 0.337143 | 0 |
| 3.477996 | 0.313848 | 0 |
| 3.422385 | 0.289778 | 0 |
| 3.3562 | 0.261173 | 0 |
| 3.278711 | 0.227792 | 0 |
| 3.187043 | 0.188552 | 0 |
| 3.081108 | 0.143674 | 0 |
| 2.960793 | 0.093424 | 0 |
| 2.825979 | 0.038089 | 0 |
| 2.676512 | −0.02196 | 0 |
| 2.512327 | −0.08614 | 0 |
| 2.340492 | −0.15104 | 0 |
| 2.160871 | −0.21611 | 0 |
| 1.97331 | −0.28072 | 0 |
| 1.777641 | −0.34419 | 0 |
| 1.573669 | −0.40573 | 0 |
| 1.361173 | −0.46445 | 0 |
| 1.139903 | −0.51933 | 0 |
| 0.917049 | −0.56779 | 0 |
| 0.692514 | −0.60944 | 0 |
| 0.466178 | −0.64379 | 0 |
| 0.237864 | −0.67013 | 0 |
| 0.007383 | −0.68769 | 0 |
| −0.22472 | −0.69551 | 0 |
| −0.4569 | −0.69277 | 0 |
| −0.68873 | −0.67886 | 0 |
| −0.9195 | −0.65335 | 0 |
| −1.14881 | −0.6164 | 0 |
| −1.37611 | −0.5689 | 0 |
| −1.59329 | −0.5137 | 0 |
| −1.79966 | −0.45227 | 0 |
| −1.9957 | −0.38582 | 0 |
| −2.18189 | −0.31553 | 0 |
| −2.35868 | −0.24249 | 0 |
| −2.5265 | −0.16773 | 0 |
| −2.68574 | −0.09225 | 0 |
| −2.83664 | −0.01658 | 0 |
| −2.97209 | 0.056434 | 0 |
| −3.09166 | 0.127802 | 0 |
| −3.19443 | 0.19775 | 0 |
| −3.28548 | 0.270267 | 0 |
| −3.35813 | 0.340673 | 0 |
| −3.40689 | 0.401321 | 0 |
| −3.43848 | 0.454625 | 0 |
| −3.45466 | 0.498584 | 0 |

TABLE A-continued

| X | Y | Z |
|---|---|---|
| −3.45937 | 0.533435 | 0 |
| −3.45797 | 0.552888 | 0 |
| −3.45498 | 0.565173 | 0 |
| −3.45304 | 0.571192 | 0 |
| −3.45207 | 0.574202 | 0 |
| −3.45152 | 0.575688 | 0 |
| −3.45095 | 0.577024 | 0 |
| −3.4497 | 0.579634 | 0 |
| −3.44723 | 0.584871 | 0 |
| −3.44193 | 0.595131 | 0 |
| −3.4322 | 0.61028 | 0 |
| −3.41099 | 0.63492 | 0 |
| −3.37746 | 0.661924 | 0 |
| −3.32635 | 0.68803 | 0 |
| −3.25702 | 0.706368 | 0 |
| −3.16445 | 0.710793 | 0 |
| −3.05792 | 0.697477 | 0 |
| −2.94612 | 0.673952 | 0 |
| −2.82076 | 0.645484 | 0 |
| −2.68124 | 0.614974 | 0 |
| −2.5274 | 0.583252 | 0 |
| −2.36625 | 0.552122 | 0 |
| −2.19772 | 0.522293 | 0 |
| −2.02167 | 0.494696 | 0 |
| −1.838 | 0.470204 | 0 |
| −1.64663 | 0.449322 | 0 |
| −1.44756 | 0.432002 | 0 |
| −1.24092 | 0.41841 | 0 |
| −1.02694 | 0.408938 | 0 |
| −0.81277 | 0.403948 | 0 |
| −0.59854 | 0.403132 | 0 |
| −0.38435 | 0.405936 | 0 |
| −0.17018 | 0.411623 | 0 |
| 0.043906 | 0.419495 | 0 |
| 0.25792 | 0.428964 | 0 |
| 0.471887 | 0.439473 | 0 |
| 0.685832 | 0.450442 | 0 |
| 0.899778 | 0.461391 | 0 |
| 1.113736 | 0.472093 | 0 |
| 1.327708 | 0.482449 | 0 |
| 1.53457 | 0.491991 | 0 |
| 1.734323 | 0.500649 | 0 |
| 1.926964 | 0.508487 | 0 |
| 2.11249 | 0.515611 | 0 |
| 2.290894 | 0.522094 | 0 |
| 2.462174 | 0.528002 | 0 |
| 2.626325 | 0.533403 | 0 |
| 2.776208 | 0.538179 | 0 |
| 2.911819 | 0.542403 | 0 |
| 3.033158 | 0.546096 | 0 |
| 3.140222 | 0.54934 | 0 |
| 3.233011 | 0.552163 | 0 |
| 3.311525 | 0.554549 | 0 |
| 3.378617 | 0.556623 | 0 |
| 3.435002 | 0.558446 | 0 |
| 3.481004 | 0.553278 | 0 |
| 3.514429 | 0.537189 | 0 |
| 3.535956 | 0.518455 | 0 |
| 3.548991 | 0.501394 | 0 |
| 3.557465 | 0.48568 | 0 |
| 3.562612 | 0.472217 | 0 |
| 3.564815 | 0.41058 | 0.1664 |
| 3.566633 | 0.3993 | 0.1664 |
| 3.567321 | 0.38419 | 0.1664 |
| 3.565384 | 0.36525 | 0.1664 |
| 3.559066 | 0.343459 | 0.1664 |
| 3.54419 | 0.317014 | 0.1664 |
| 3.515496 | 0.290119 | 0.1664 |
| 3.470587 | 0.269437 | 0.1664 |
| 3.415001 | 0.246219 | 0.1664 |
| 3.348871 | 0.218569 | 0.1664 |
| 3.27146 | 0.186273 | 0.1664 |
| 3.179889 | 0.148316 | 0.1664 |
| 3.074049 | 0.104967 | 0.1664 |
| 2.953837 | 0.05648 | 0.1664 |
| 2.819152 | 0.003102 | 0.1664 |
| 2.669867 | −0.05477 | 0.1664 |
| 2.505931 | −0.11656 | 0.1664 |

TABLE A-continued

| X | Y | Z |
|---|---|---|
| 2.334336 | −0.17896 | 0.1664 |
| 2.15494 | −0.24144 | 0.1664 |
| 1.967585 | −0.30338 | 0.1664 |
| 1.772096 | −0.3641 | 0.1664 |
| 1.568278 | −0.42283 | 0.1664 |
| 1.355909 | −0.47873 | 0.1664 |
| 1.134747 | −0.53085 | 0.1664 |
| 0.911976 | −0.57673 | 0.1664 |
| 0.687488 | −0.61593 | 0.1664 |
| 0.46113 | −0.64788 | 0.1664 |
| 0.232703 | −0.6718 | 0.1664 |
| 0.003184 | −0.6867 | 0.1664 |
| −0.22634 | −0.6915 | 0.1664 |
| −0.45585 | −0.68533 | 0.1664 |
| −0.68535 | −0.66791 | 0.1664 |
| −0.91384 | −0.63935 | 0.1664 |
| −1.14078 | −0.5999 | 0.1664 |
| −1.36558 | −0.54998 | 0.1664 |
| −1.58062 | −0.49231 | 0.1664 |
| −1.78519 | −0.42872 | 0.1664 |
| −1.97947 | −0.36059 | 0.1664 |
| −2.16388 | −0.28885 | 0.1664 |
| −2.33889 | −0.21459 | 0.1664 |
| −2.50507 | −0.13911 | 0.1664 |
| −2.66282 | −0.06333 | 0.1664 |
| −2.81237 | 0.012227 | 0.1664 |
| −2.94687 | 0.084242 | 0.1664 |
| −3.0659 | 0.153676 | 0.1664 |
| −3.16891 | 0.221486 | 0.1664 |
| −3.26072 | 0.291692 | 0.1664 |
| −3.33442 | 0.35984 | 0.1664 |
| −3.38448 | 0.418757 | 0.1664 |
| −3.4174 | 0.470543 | 0.1664 |
| −3.43485 | 0.513289 | 0.1664 |
| −3.44071 | 0.547906 | 0.1664 |
| −3.43983 | 0.56744 | 0.1664 |
| −3.43709 | 0.579551 | 0.1664 |
| −3.43522 | 0.585501 | 0.1664 |
| −3.43428 | 0.588474 | 0.1664 |
| −3.43374 | 0.589948 | 0.1664 |
| −3.43318 | 0.591282 | 0.1664 |
| −3.43195 | 0.593888 | 0.1664 |
| −3.42951 | 0.599118 | 0.1664 |
| −3.42419 | 0.609304 | 0.1664 |
| −3.41429 | 0.62426 | 0.1664 |
| −3.39267 | 0.64831 | 0.1664 |
| −3.35832 | 0.674079 | 0.1664 |
| −3.30645 | 0.697733 | 0.1664 |
| −3.23658 | 0.712297 | 0.1664 |
| −3.1441 | 0.711908 | 0.1664 |
| −3.03863 | 0.695098 | 0.1664 |
| −2.92743 | 0.670565 | 0.1664 |
| −2.80225 | 0.643377 | 0.1664 |
| −2.66283 | 0.614867 | 0.1664 |
| −2.50935 | 0.584119 | 0.1664 |
| −2.34867 | 0.553461 | 0.1664 |
| −2.1806 | 0.524056 | 0.1664 |
| −2.00502 | 0.496809 | 0.1664 |
| −1.82186 | 0.472039 | 0.1664 |
| −1.63108 | 0.45011 | 0.1664 |
| −1.43267 | 0.431413 | 0.1664 |
| −1.22685 | 0.416201 | 0.1664 |
| −1.01365 | 0.40459 | 0.1664 |
| −0.80026 | 0.397077 | 0.1664 |
| −0.58679 | 0.393705 | 0.1664 |
| −0.37326 | 0.394094 | 0.1664 |
| −0.15978 | 0.397445 | 0.1664 |
| 0.053631 | 0.403014 | 0.1664 |
| 0.266994 | 0.410265 | 0.1664 |
| 0.480324 | 0.418684 | 0.1664 |
| 0.69364 | 0.427588 | 0.1664 |
| 0.906962 | 0.436336 | 0.1664 |
| 1.120301 | 0.44463 | 0.1664 |
| 1.333659 | 0.452407 | 0.1664 |
| 1.539926 | 0.459367 | 0.1664 |
| 1.739101 | 0.4655 | 0.1664 |
| 1.931179 | 0.470877 | 0.1664 |
| 2.116153 | 0.475611 | 0.1664 |

TABLE A-continued

| X | Y | Z |
|---|---|---|
| 2.294022 | 0.479788 | 0.1664 |
| 2.464784 | 0.483478 | 0.1664 |
| 2.628437 | 0.48676 | 0.1664 |
| 2.777862 | 0.489596 | 0.1664 |
| 2.913059 | 0.492081 | 0.1664 |
| 3.034025 | 0.494246 | 0.1664 |
| 3.14076 | 0.496109 | 0.1664 |
| 3.233265 | 0.497712 | 0.1664 |
| 3.311537 | 0.499096 | 0.1664 |
| 3.378423 | 0.500363 | 0.1664 |
| 3.434634 | 0.501563 | 0.1664 |
| 3.480511 | 0.498614 | 0.1664 |
| 3.514047 | 0.484051 | 0.1664 |
| 3.535735 | 0.4661 | 0.1664 |
| 3.548732 | 0.44954 | 0.1664 |
| 3.557174 | 0.434012 | 0.1664 |
| 3.562144 | 0.420846 | 0.1664 |
| 3.562429 | 0.307431 | 0.4864 |
| 3.56385 | 0.29622 | 0.4864 |
| 3.563785 | 0.281245 | 0.4864 |
| 3.560549 | 0.262693 | 0.4864 |
| 3.552218 | 0.241804 | 0.4864 |
| 3.534215 | 0.217872 | 0.4864 |
| 3.501609 | 0.196711 | 0.4864 |
| 3.455792 | 0.17911 | 0.4864 |
| 3.400138 | 0.157638 | 0.4864 |
| 3.333944 | 0.132019 | 0.4864 |
| 3.25647 | 0.102075 | 0.4864 |
| 3.164824 | 0.066913 | 0.4864 |
| 3.058887 | 0.026846 | 0.4864 |
| 2.938584 | −0.01792 | 0.4864 |
| 2.803837 | −0.06717 | 0.4864 |
| 2.654589 | −0.12049 | 0.4864 |
| 2.490708 | −0.17732 | 0.4864 |
| 2.319168 | −0.23462 | 0.4864 |
| 2.139827 | −0.29186 | 0.4864 |
| 1.95252 | −0.34841 | 0.4864 |
| 1.757065 | −0.4036 | 0.4864 |
| 1.553266 | −0.4567 | 0.4864 |
| 1.340906 | −0.50689 | 0.4864 |
| 1.119748 | −0.55328 | 0.4864 |
| 0.896978 | −0.59363 | 0.4864 |
| 0.672486 | −0.62748 | 0.4864 |
| 0.446967 | −0.65402 | 0.4864 |
| 0.220893 | −0.67243 | 0.4864 |
| −0.00581 | −0.68167 | 0.4864 |
| −0.23314 | −0.68036 | 0.4864 |
| −0.46008 | −0.66759 | 0.4864 |
| −0.68623 | −0.64361 | 0.4864 |
| −0.91091 | −0.60902 | 0.4864 |
| −1.13385 | −0.56406 | 0.4864 |
| −1.35442 | −0.50902 | 0.4864 |
| −1.56511 | −0.44686 | 0.4864 |
| −1.76545 | −0.3796 | 0.4864 |
| −1.95591 | −0.30847 | 0.4864 |
| −2.13677 | −0.23412 | 0.4864 |
| −2.3085 | −0.15764 | 0.4864 |
| −2.47177 | −0.08058 | 0.4864 |
| −2.62699 | −0.00384 | 0.4864 |
| −2.77428 | 0.072253 | 0.4864 |
| −2.90707 | 0.143991 | 0.4864 |
| −3.02518 | 0.211731 | 0.4864 |
| −3.12771 | 0.276038 | 0.4864 |
| −3.22027 | 0.34166 | 0.4864 |
| −3.29564 | 0.405083 | 0.4864 |
| −3.34796 | 0.45981 | 0.4864 |
| −3.38388 | 0.508476 | 0.4864 |
| −3.40429 | 0.549203 | 0.4864 |
| −3.41251 | 0.582167 | 0.4864 |
| −3.41287 | 0.601167 | 0.4864 |
| −3.41074 | 0.613122 | 0.4864 |
| −3.40901 | 0.618959 | 0.4864 |
| −3.40812 | 0.621873 | 0.4864 |
| −3.40762 | 0.623317 | 0.4864 |
| −3.40707 | 0.62464 | 0.4864 |
| −3.40586 | 0.627228 | 0.4864 |
| −3.40347 | 0.632414 | 0.4864 |
| −3.39805 | 0.642411 | 0.4864 |

TABLE A-continued

| X | Y | Z |
|---|---|---|
| −3.38768 | 0.656899 | 0.4864 |
| −3.3649 | 0.679254 | 0.4864 |
| −3.32867 | 0.701639 | 0.4864 |
| −3.27493 | 0.71935 | 0.4864 |
| −3.20476 | 0.725633 | 0.4864 |
| −3.11318 | 0.716765 | 0.4864 |
| −3.00898 | 0.69689 | 0.4864 |
| −2.89823 | 0.673428 | 0.4864 |
| −2.77337 | 0.648547 | 0.4864 |
| −2.63442 | 0.622022 | 0.4864 |
| −2.48155 | 0.593013 | 0.4864 |
| −2.32158 | 0.563469 | 0.4864 |
| −2.15428 | 0.534734 | 0.4864 |
| −1.9795 | 0.507586 | 0.4864 |
| −1.7974 | 0.481779 | 0.4864 |
| −1.608 | 0.457642 | 0.4864 |
| −1.41118 | 0.43606 | 0.4864 |
| −1.20691 | 0.417405 | 0.4864 |
| −0.99523 | 0.401556 | 0.4864 |
| −0.78334 | 0.389138 | 0.4864 |
| −0.57123 | 0.3805 | 0.4864 |
| −0.35902 | 0.375618 | 0.4864 |
| −0.14675 | 0.37385 | 0.4864 |
| 0.06552 | 0.374498 | 0.4864 |
| 0.277765 | 0.376978 | 0.4864 |
| 0.489994 | 0.380758 | 0.4864 |
| 0.702216 | 0.385122 | 0.4864 |
| 0.91444 | 0.389249 | 0.4864 |
| 1.126674 | 0.392641 | 0.4864 |
| 1.338917 | 0.395282 | 0.4864 |
| 1.544094 | 0.39715 | 0.4864 |
| 1.742205 | 0.398304 | 0.4864 |
| 1.933241 | 0.398817 | 0.4864 |
| 2.117201 | 0.398793 | 0.4864 |
| 2.294084 | 0.398327 | 0.4864 |
| 2.463892 | 0.39749 | 0.4864 |
| 2.626624 | 0.396374 | 0.4864 |
| 2.775204 | 0.395159 | 0.4864 |
| 2.909633 | 0.393974 | 0.4864 |
| 3.029911 | 0.392868 | 0.4864 |
| 3.136038 | 0.391812 | 0.4864 |
| 3.228014 | 0.390818 | 0.4864 |
| 3.305841 | 0.390022 | 0.4864 |
| 3.372348 | 0.389464 | 0.4864 |
| 3.428243 | 0.389175 | 0.4864 |
| 3.474159 | 0.388581 | 0.4864 |
| 3.509253 | 0.378633 | 0.4864 |
| 3.532394 | 0.362469 | 0.4864 |
| 3.546219 | 0.346449 | 0.4864 |
| 3.554999 | 0.331009 | 0.4864 |
| 3.559947 | 0.317795 | 0.4864 |
| 3.560955 | 0.268497 | 0.5994 |
| 3.562222 | 0.257303 | 0.5994 |
| 3.561869 | 0.242372 | 0.5994 |
| 3.558144 | 0.223978 | 0.5994 |
| 3.54906 | 0.203445 | 0.5994 |
| 3.529935 | 0.180514 | 0.5994 |
| 3.496164 | 0.161506 | 0.5994 |
| 3.450281 | 0.144466 | 0.5994 |
| 3.394549 | 0.123665 | 0.5994 |
| 3.328255 | 0.098864 | 0.5994 |
| 3.250658 | 0.06989 | 0.5994 |
| 3.158865 | 0.035889 | 0.5994 |
| 3.052768 | −0.00285 | 0.5994 |
| 2.932296 | −0.04612 | 0.5994 |
| 2.797387 | −0.09372 | 0.5994 |
| 2.647979 | −0.14522 | 0.5994 |
| 2.483932 | −0.2001 | 0.5994 |
| 2.312235 | −0.25541 | 0.5994 |
| 2.132746 | −0.31062 | 0.5994 |
| 1.9453 | −0.36512 | 0.5994 |
| 1.749718 | −0.41823 | 0.5994 |
| 1.5458 | −0.46919 | 0.5994 |
| 1.333327 | −0.5172 | 0.5994 |
| 1.112063 | −0.56135 | 0.5994 |
| 0.889196 | −0.59946 | 0.5994 |
| 0.664966 | −0.63103 | 0.5994 |
| 0.440098 | −0.65526 | 0.5994 |

TABLE A-continued

| X | Y | Z |
|---|---|---|
| 0.214567 | −0.67139 | 0.5994 |
| −0.01172 | −0.67832 | 0.5994 |
| −0.23828 | −0.67465 | 0.5994 |
| −0.46435 | −0.65954 | 0.5994 |
| −0.6894 | −0.6333 | 0.5994 |
| −0.91299 | −0.59642 | 0.5994 |
| −1.13461 | −0.54931 | 0.5994 |
| −1.35394 | −0.49234 | 0.5994 |
| −1.56293 | −0.42877 | 0.5994 |
| −1.76174 | −0.36038 | 0.5994 |
| −1.95084 | −0.2883 | 0.5994 |
| −2.1305 | −0.21314 | 0.5994 |
| −2.30116 | −0.13598 | 0.5994 |
| −2.46351 | −0.05838 | 0.5994 |
| −2.61792 | 0.018733 | 0.5994 |
| −2.76451 | 0.095091 | 0.5994 |
| −2.89678 | 0.166866 | 0.5994 |
| −3.01453 | 0.234022 | 0.5994 |
| −3.11715 | 0.297048 | 0.5994 |
| −3.21029 | 0.361065 | 0.5994 |
| −3.28631 | 0.422873 | 0.5994 |
| −3.33931 | 0.476245 | 0.5994 |
| −3.37609 | 0.524027 | 0.5994 |
| −3.39725 | 0.564035 | 0.5994 |
| −3.40616 | 0.59658 | 0.5994 |
| −3.40689 | 0.615493 | 0.5994 |
| −3.40497 | 0.627466 | 0.5994 |
| −3.40325 | 0.633366 | 0.5994 |
| −3.40237 | 0.636306 | 0.5994 |
| −3.40187 | 0.63776 | 0.5994 |
| −3.40131 | 0.639083 | 0.5994 |
| −3.40012 | 0.641674 | 0.5994 |
| −3.39772 | 0.646858 | 0.5994 |
| −3.39222 | 0.656799 | 0.5994 |
| −3.38161 | 0.671133 | 0.5994 |
| −3.35828 | 0.692843 | 0.5994 |
| −3.3213 | 0.713877 | 0.5994 |
| −3.26685 | 0.729299 | 0.5994 |
| −3.19651 | 0.732745 | 0.5994 |
| −3.10526 | 0.721371 | 0.5994 |
| −3.00128 | 0.700981 | 0.5994 |
| −2.89052 | 0.678408 | 0.5994 |
| −2.76571 | 0.654122 | 0.5994 |
| −2.62689 | 0.627913 | 0.5994 |
| −2.47414 | 0.599406 | 0.5994 |
| −2.31431 | 0.570323 | 0.5994 |
| −2.14722 | 0.541825 | 0.5994 |
| −1.97274 | 0.514544 | 0.5994 |
| −1.79095 | 0.488233 | 0.5994 |
| −1.60189 | 0.463282 | 0.5994 |
| −1.40548 | 0.440624 | 0.5994 |
| −1.20166 | 0.420662 | 0.5994 |
| −0.99045 | 0.403282 | 0.5994 |
| −0.77901 | 0.389135 | 0.5994 |
| −0.56743 | 0.378545 | 0.5994 |
| −0.35569 | 0.371548 | 0.5994 |
| −0.14382 | 0.367644 | 0.5994 |
| 0.068108 | 0.366234 | 0.5994 |
| 0.280027 | 0.366718 | 0.5994 |
| 0.491941 | 0.36852 | 0.5994 |
| 0.703851 | 0.370942 | 0.5994 |
| 0.915762 | 0.373172 | 0.5994 |
| 1.127676 | 0.374662 | 0.5994 |
| 1.339593 | 0.375367 | 0.5994 |
| 1.544448 | 0.375338 | 0.5994 |
| 1.742242 | 0.37464 | 0.5994 |
| 1.932967 | 0.373341 | 0.5994 |
| 2.116621 | 0.37153 | 0.5994 |
| 2.293206 | 0.369297 | 0.5994 |
| 2.462722 | 0.366715 | 0.5994 |
| 2.625171 | 0.363883 | 0.5994 |
| 2.773491 | 0.361079 | 0.5994 |
| 2.907683 | 0.358443 | 0.5994 |
| 3.027749 | 0.356029 | 0.5994 |
| 3.133687 | 0.353816 | 0.5994 |
| 3.225499 | 0.351805 | 0.5994 |
| 3.303186 | 0.350137 | 0.5994 |
| 3.369576 | 0.348828 | 0.5994 |

TABLE A-continued

| X | Y | Z |
|---|---|---|
| 3.425375 | 0.347899 | 0.5994 |
| 3.47128 | 0.347233 | 0.5994 |
| 3.506841 | 0.338895 | 0.5994 |
| 3.530534 | 0.323446 | 0.5994 |
| 3.544673 | 0.307633 | 0.5994 |
| 3.553579 | 0.292234 | 0.5994 |
| 3.558534 | 0.278961 | 0.5994 |
| 3.557796 | 0.182882 | 0.8444 |
| 3.558721 | 0.171724 | 0.8444 |
| 3.557729 | 0.156893 | 0.8444 |
| 3.552943 | 0.138889 | 0.8444 |
| 3.542277 | 0.119254 | 0.8444 |
| 3.520946 | 0.098583 | 0.8444 |
| 3.485338 | 0.083429 | 0.8444 |
| 3.439297 | 0.067623 | 0.8444 |
| 3.383344 | 0.0484 | 0.8444 |
| 3.31676 | 0.02555 | 0.8444 |
| 3.238807 | −0.00109 | 0.8444 |
| 3.146597 | −0.03232 | 0.8444 |
| 3.040059 | −0.06793 | 0.8444 |
| 2.919126 | −0.10773 | 0.8444 |
| 2.783758 | −0.15147 | 0.8444 |
| 2.633874 | −0.19878 | 0.8444 |
| 2.469348 | −0.24918 | 0.8444 |
| 2.297201 | −0.29994 | 0.8444 |
| 2.1173 | −0.35057 | 0.8444 |
| 1.929489 | −0.40045 | 0.8444 |
| 1.733584 | −0.44887 | 0.8444 |
| 1.529384 | −0.49506 | 0.8444 |
| 1.316671 | −0.53815 | 0.8444 |
| 1.095203 | −0.57721 | 0.8444 |
| 0.872639 | −0.61019 | 0.8444 |
| 0.649451 | −0.63652 | 0.8444 |
| 0.425578 | −0.65555 | 0.8444 |
| 0.200952 | −0.66655 | 0.8444 |
| −0.02423 | −0.66834 | 0.8444 |
| −0.24913 | −0.65969 | 0.8444 |
| −0.47348 | −0.63987 | 0.8444 |
| −0.69641 | −0.60904 | 0.8444 |
| −0.91776 | −0.56746 | 0.8444 |
| −1.13687 | −0.51583 | 0.8444 |
| −1.35366 | −0.45498 | 0.8444 |
| −1.56016 | −0.38837 | 0.8444 |
| −1.75662 | −0.3175 | 0.8444 |
| −1.94349 | −0.2434 | 0.8444 |
| −2.12106 | −0.16669 | 0.8444 |
| −2.28978 | −0.08841 | 0.8444 |
| −2.45032 | −0.01007 | 0.8444 |
| −2.60307 | 0.067493 | 0.8444 |
| −2.74812 | 0.144059 | 0.8444 |
| −2.87912 | 0.2156 | 0.8444 |
| −2.99629 | 0.281634 | 0.8444 |
| −3.09944 | 0.342336 | 0.8444 |
| −3.19368 | 0.403088 | 0.8444 |
| −3.27124 | 0.46188 | 0.8444 |
| −3.3259 | 0.513091 | 0.8444 |
| −3.36402 | 0.55903 | 0.8444 |
| −3.38657 | 0.597996 | 0.8444 |
| −3.39668 | 0.630138 | 0.8444 |
| −3.39796 | 0.648773 | 0.8444 |
| −3.39632 | 0.660741 | 0.8444 |
| −3.39469 | 0.666549 | 0.8444 |
| −3.39382 | 0.669441 | 0.8444 |
| −3.39333 | 0.670876 | 0.8444 |
| −3.39278 | 0.6722 | 0.8444 |
| −3.3916 | 0.674797 | 0.8444 |
| −3.38919 | 0.679968 | 0.8444 |
| −3.38345 | 0.689772 | 0.8444 |
| −3.37233 | 0.703717 | 0.8444 |
| −3.34777 | 0.724004 | 0.8444 |
| −3.30942 | 0.742045 | 0.8444 |
| −3.25397 | 0.75271 | 0.8444 |
| −3.18345 | 0.750932 | 0.8444 |
| −3.0931 | 0.735641 | 0.8444 |
| −2.98942 | 0.714817 | 0.8444 |
| −2.87858 | 0.694029 | 0.8444 |
| −2.7539 | 0.670497 | 0.8444 |
| −2.61532 | 0.644725 | 0.8444 |

TABLE A-continued

| X | Y | Z |
|---|---|---|
| −2.46276 | 0.617098 | 0.8444 |
| −2.30315 | 0.588939 | 0.8444 |
| −2.1364 | 0.560848 | 0.8444 |
| −1.96245 | 0.533156 | 0.8444 |
| −1.78131 | 0.505806 | 0.8444 |
| −1.59292 | 0.479236 | 0.8444 |
| −1.39714 | 0.454294 | 0.8444 |
| −1.19392 | 0.431437 | 0.8444 |
| −0.98338 | 0.410713 | 0.8444 |
| −0.77258 | 0.392874 | 0.8444 |
| −0.56159 | 0.378109 | 0.8444 |
| −0.35041 | 0.366482 | 0.8444 |
| −0.13905 | 0.35777 | 0.8444 |
| 0.072402 | 0.351648 | 0.8444 |
| 0.283887 | 0.347539 | 0.8444 |
| 0.495395 | 0.344771 | 0.8444 |
| 0.706913 | 0.342663 | 0.8444 |
| 0.918429 | 0.340494 | 0.8444 |
| 1.129936 | 0.337688 | 0.8444 |
| 1.34143 | 0.334095 | 0.8444 |
| 1.545858 | 0.329875 | 0.8444 |
| 1.743216 | 0.325084 | 0.8444 |
| 1.933505 | 0.319779 | 0.8444 |
| 2.116727 | 0.314018 | 0.8444 |
| 2.292884 | 0.307861 | 0.8444 |
| 2.461978 | 0.301386 | 0.8444 |
| 2.62401 | 0.294704 | 0.8444 |
| 2.77194 | 0.288331 | 0.8444 |
| 2.905776 | 0.282429 | 0.8444 |
| 3.02552 | 0.27705 | 0.8444 |
| 3.131171 | 0.272201 | 0.8444 |
| 3.222732 | 0.267916 | 0.8444 |
| 3.300207 | 0.264291 | 0.8444 |
| 3.366416 | 0.261263 | 0.8444 |
| 3.422064 | 0.258827 | 0.8444 |
| 3.467856 | 0.256938 | 0.8444 |
| 3.503659 | 0.250944 | 0.8444 |
| 3.527694 | 0.236774 | 0.8444 |
| 3.542034 | 0.22144 | 0.8444 |
| 3.550865 | 0.206328 | 0.8444 |
| 3.555631 | 0.193182 | 0.8444 |
| 3.557443 | 0.114504 | 1.0564 |
| 3.558087 | 0.103403 | 1.0564 |
| 3.556582 | 0.088701 | 1.0564 |
| 3.550972 | 0.071092 | 1.0564 |
| 3.539137 | 0.052326 | 1.0564 |
| 3.516252 | 0.033764 | 1.0564 |
| 3.479886 | 0.020821 | 1.0564 |
| 3.433803 | 0.006128 | 1.0564 |
| 3.37778 | −0.01169 | 1.0564 |
| 3.311096 | −0.0328 | 1.0564 |
| 3.233021 | −0.05739 | 1.0564 |
| 3.140685 | −0.08623 | 1.0564 |
| 3.034035 | −0.11917 | 1.0564 |
| 2.913014 | −0.15599 | 1.0564 |
| 2.777579 | −0.19645 | 1.0564 |
| 2.627651 | −0.24021 | 1.0564 |
| 2.463116 | −0.28681 | 1.0564 |
| 2.291005 | −0.33372 | 1.0564 |
| 2.111193 | −0.38043 | 1.0564 |
| 1.92353 | −0.42634 | 1.0564 |
| 1.72784 | −0.47073 | 1.0564 |
| 1.523931 | −0.51283 | 1.0564 |
| 1.311596 | −0.55179 | 1.0564 |
| 1.090933 | −0.58663 | 1.0564 |
| 0.87005 | −0.6154 | 1.0564 |
| 0.648975 | −0.63764 | 1.0564 |
| 0.427692 | −0.65272 | 1.0564 |
| 0.206179 | −0.65995 | 1.0564 |
| −0.01559 | −0.65831 | 1.0564 |
| −0.23766 | −0.64668 | 1.0564 |
| −0.46004 | −0.62426 | 1.0564 |
| −0.6822 | −0.59076 | 1.0564 |
| −0.90238 | −0.54645 | 1.0564 |
| −1.12047 | −0.49207 | 1.0564 |
| −1.33605 | −0.42878 | 1.0564 |
| −1.54211 | −0.35992 | 1.0564 |
| −1.73854 | −0.28698 | 1.0564 |

TABLE A-continued

| X | Y | Z |
|---|---|---|
| −1.92557 | −0.2111 | 1.0564 |
| −2.10353 | −0.13305 | 1.0564 |
| −2.27283 | −0.05378 | 1.0564 |
| −2.43404 | 0.025358 | 1.0564 |
| −2.58747 | 0.103544 | 1.0564 |
| −2.73306 | 0.180539 | 1.0564 |
| −2.86447 | 0.252276 | 1.0564 |
| −2.98208 | 0.318077 | 1.0564 |
| −3.0859 | 0.377807 | 1.0564 |
| −3.18134 | 0.436942 | 1.0564 |
| −3.26033 | 0.493907 | 1.0564 |
| −3.31632 | 0.543597 | 1.0564 |
| −3.35584 | 0.588484 | 1.0564 |
| −3.37962 | 0.626725 | 1.0564 |
| −3.39079 | 0.658379 | 1.0564 |
| −3.39261 | 0.677108 | 1.0564 |
| −3.39126 | 0.689056 | 1.0564 |
| −3.38966 | 0.694948 | 1.0564 |
| −3.38878 | 0.697873 | 1.0564 |
| −3.3883 | 0.699322 | 1.0564 |
| −3.38775 | 0.700646 | 1.0564 |
| −3.38657 | 0.703245 | 1.0564 |
| −3.38413 | 0.708397 | 1.0564 |
| −3.37819 | 0.718084 | 1.0564 |
| −3.36666 | 0.731655 | 1.0564 |
| −3.34113 | 0.750757 | 1.0564 |
| −3.30179 | 0.766423 | 1.0564 |
| −3.24592 | 0.773542 | 1.0564 |
| −3.17554 | 0.768488 | 1.0564 |
| −3.0856 | 0.751312 | 1.0564 |
| −2.982 | 0.730354 | 1.0564 |
| −2.87109 | 0.710256 | 1.0564 |
| −2.74644 | 0.68693 | 1.0564 |
| −2.60788 | 0.661368 | 1.0564 |
| −2.4553 | 0.634146 | 1.0564 |
| −2.29564 | 0.606444 | 1.0564 |
| −2.12889 | 0.578481 | 1.0564 |
| −1.95502 | 0.550418 | 1.0564 |
| −1.77402 | 0.522323 | 1.0564 |
| −1.58584 | 0.494568 | 1.0564 |
| −1.39042 | 0.467788 | 1.0564 |
| −1.18772 | 0.442448 | 1.0564 |
| −0.97771 | 0.41881 | 1.0564 |
| −0.76741 | 0.397836 | 1.0564 |
| −0.55688 | 0.379651 | 1.0564 |
| −0.34611 | 0.364305 | 1.0564 |
| −0.13514 | 0.351711 | 1.0564 |
| 0.075938 | 0.341703 | 1.0564 |
| 0.287088 | 0.333784 | 1.0564 |
| 0.498288 | 0.327256 | 1.0564 |
| 0.709513 | 0.321439 | 1.0564 |
| 0.920738 | 0.315645 | 1.0564 |
| 1.131944 | 0.30929 | 1.0564 |
| 1.343118 | 0.30215 | 1.0564 |
| 1.54722 | 0.294471 | 1.0564 |
| 1.744251 | 0.286308 | 1.0564 |
| 1.934214 | 0.277718 | 1.0564 |
| 2.117111 | 0.268757 | 1.0564 |
| 2.292945 | 0.259471 | 1.0564 |
| 2.461716 | 0.249936 | 1.0564 |
| 2.623424 | 0.240264 | 1.0564 |
| 2.771051 | 0.231114 | 1.0564 |
| 2.904608 | 0.222677 | 1.0564 |
| 3.024098 | 0.214994 | 1.0564 |
| 3.129523 | 0.208096 | 1.0564 |
| 3.220886 | 0.202042 | 1.0564 |
| 3.298192 | 0.196897 | 1.0564 |
| 3.364255 | 0.192514 | 1.0564 |
| 3.419778 | 0.188871 | 1.0564 |
| 3.465465 | 0.185926 | 1.0564 |
| 3.501699 | 0.181461 | 1.0564 |
| 3.526584 | 0.168447 | 1.0564 |
| 3.541515 | 0.153429 | 1.0564 |
| 3.550636 | 0.138257 | 1.0564 |
| 3.555401 | 0.124992 | 1.0564 |
| 3.607046 | −0.17369 | 2.1134 |
| 3.606506 | −0.18474 | 2.1134 |
| 3.602719 | −0.199 | 2.1134 |

TABLE A-continued

| X | Y | Z |
|---|---|---|
| 3.593371 | −0.21484 | 2.1134 |
| 3.576512 | −0.22904 | 2.1134 |
| 3.548361 | −0.23774 | 2.1134 |
| 3.510495 | −0.24539 | 2.1134 |
| 3.463154 | −0.25492 | 2.1134 |
| 3.405605 | −0.26644 | 2.1134 |
| 3.337113 | −0.28007 | 2.1134 |
| 3.256946 | −0.29593 | 2.1134 |
| 3.162183 | −0.31457 | 2.1134 |
| 3.052811 | −0.33591 | 2.1134 |
| 2.928802 | −0.35979 | 2.1134 |
| 2.790118 | −0.38598 | 2.1134 |
| 2.63671 | −0.41419 | 2.1134 |
| 2.468504 | −0.44401 | 2.1134 |
| 2.292736 | −0.47367 | 2.1134 |
| 2.109326 | −0.50272 | 2.1134 |
| 1.918183 | −0.53063 | 2.1134 |
| 1.719274 | −0.55678 | 2.1134 |
| 1.5127 | −0.58041 | 2.1134 |
| 1.2984 | −0.60069 | 2.1134 |
| 1.076287 | −0.61655 | 2.1134 |
| 0.853691 | −0.62657 | 2.1134 |
| 0.630739 | −0.63013 | 2.1134 |
| 0.408107 | −0.62663 | 2.1134 |
| 0.185902 | −0.6153 | 2.1134 |
| −0.03582 | −0.59507 | 2.1134 |
| −0.25688 | −0.56494 | 2.1134 |
| −0.47595 | −0.5247 | 2.1134 |
| −0.69267 | −0.4744 | 2.1134 |
| −0.90712 | −0.41437 | 2.1134 |
| −1.11944 | −0.34574 | 2.1134 |
| −1.32931 | −0.27 | 2.1134 |
| −1.53005 | −0.19109 | 2.1134 |
| −1.72185 | −0.11058 | 2.1134 |
| −1.90516 | −0.02948 | 2.1134 |
| −2.08026 | 0.051592 | 2.1134 |
| −2.24746 | 0.132004 | 2.1134 |
| −2.40718 | 0.210866 | 2.1134 |
| −2.55965 | 0.287673 | 2.1134 |
| −2.70477 | 0.362672 | 2.1134 |
| −2.83598 | 0.43236 | 2.1134 |
| −2.9535 | 0.49629 | 2.1134 |
| −3.05733 | 0.554272 | 2.1134 |
| −3.15367 | 0.610384 | 2.1134 |
| −3.23487 | 0.662767 | 2.1134 |
| −3.29365 | 0.708262 | 2.1134 |
| −3.33626 | 0.749634 | 2.1134 |
| −3.36315 | 0.785083 | 2.1134 |
| −3.37748 | 0.815354 | 2.1134 |
| −3.38096 | 0.833505 | 2.1134 |
| −3.3804 | 0.845423 | 2.1134 |
| −3.37896 | 0.851183 | 2.1134 |
| −3.37807 | 0.85403 | 2.1134 |
| −3.37759 | 0.855446 | 2.1134 |
| −3.377 | 0.856768 | 2.1134 |
| −3.37575 | 0.859369 | 2.1134 |
| −3.37301 | 0.864426 | 2.1134 |
| −3.36604 | 0.873616 | 2.1134 |
| −3.35251 | 0.885337 | 2.1134 |
| −3.32341 | 0.898974 | 2.1134 |
| −3.28108 | 0.905129 | 2.1134 |
| −3.22422 | 0.899947 | 2.1134 |
| −3.15443 | 0.885895 | 2.1134 |
| −3.06435 | 0.864548 | 2.1134 |
| −2.96021 | 0.840937 | 2.1134 |
| −2.84875 | 0.817624 | 2.1134 |
| −2.72324 | 0.791982 | 2.1134 |
| −2.58363 | 0.764289 | 2.1134 |
| −2.42992 | 0.734508 | 2.1134 |
| −2.26913 | 0.703844 | 2.1134 |
| −2.10129 | 0.672137 | 2.1134 |
| −1.92644 | 0.639229 | 2.1134 |
| −1.7446 | 0.604962 | 2.1134 |
| −1.55578 | 0.56926 | 2.1134 |
| −1.36001 | 0.53209 | 2.1134 |
| −1.15723 | 0.493621 | 2.1134 |
| −0.94739 | 0.454241 | 2.1134 |
| −0.73736 | 0.415869 | 2.1134 |

TABLE A-continued

| X | Y | Z |
|---|---|---|
| −0.527 | 0.379321 | 2.1134 |
| −0.31623 | 0.345344 | 2.1134 |
| −0.10499 | 0.314375 | 2.1134 |
| 0.106672 | 0.286715 | 2.1134 |
| 0.318688 | 0.262188 | 2.1134 |
| 0.530948 | 0.239807 | 2.1134 |
| 0.743338 | 0.218568 | 2.1134 |
| 0.955778 | 0.197768 | 2.1134 |
| 1.168212 | 0.176916 | 2.1134 |
| 1.380599 | 0.1556 | 2.1134 |
| 1.585834 | 0.134278 | 2.1134 |
| 1.783905 | 0.112831 | 2.1134 |
| 1.974803 | 0.09128 | 2.1134 |
| 2.158536 | 0.069704 | 2.1134 |
| 2.335116 | 0.048228 | 2.1134 |
| 2.504558 | 0.026993 | 2.1134 |
| 2.666875 | 0.006137 | 2.1134 |
| 2.81503 | −0.01328 | 2.1134 |
| 2.949038 | −0.03113 | 2.1134 |
| 3.068913 | −0.0473 | 2.1134 |
| 3.174665 | −0.06171 | 2.1134 |
| 3.266306 | −0.07428 | 2.1134 |
| 3.343838 | −0.085 | 2.1134 |
| 3.410081 | −0.09424 | 2.1134 |
| 3.465742 | −0.10208 | 2.1134 |
| 3.511533 | −0.10858 | 2.1134 |
| 3.548161 | −0.11381 | 2.1134 |
| 3.57516 | −0.12184 | 2.1134 |
| 3.591562 | −0.13507 | 2.1134 |
| 3.6012 | −0.14979 | 2.1134 |
| 3.60571 | −0.16317 | 2.1134 |
| 3.663463 | −0.46369 | 3.2464 |
| 3.661726 | −0.47465 | 3.2464 |
| 3.655772 | −0.4882 | 3.2464 |
| 3.643219 | −0.50171 | 3.2464 |
| 3.622908 | −0.51043 | 3.2464 |
| 3.593143 | −0.51324 | 3.2464 |
| 3.554415 | −0.51654 | 3.2464 |
| 3.506003 | −0.52065 | 3.2464 |
| 3.447161 | −0.52561 | 3.2464 |
| 3.377145 | −0.53148 | 3.2464 |
| 3.295207 | −0.53831 | 3.2464 |
| 3.198368 | −0.54634 | 3.2464 |
| 3.086625 | −0.55552 | 3.2464 |
| 2.959972 | −0.5658 | 3.2464 |
| 2.818401 | −0.57703 | 3.2464 |
| 2.661897 | −0.58905 | 3.2464 |
| 2.490438 | −0.60156 | 3.2464 |
| 2.311453 | −0.61367 | 3.2464 |
| 2.124925 | −0.62492 | 3.2464 |
| 1.930892 | −0.63476 | 3.2464 |
| 1.72935 | −0.6427 | 3.2464 |
| 1.520284 | −0.64812 | 3.2464 |
| 1.303678 | −0.65012 | 3.2464 |
| 1.079506 | −0.64753 | 3.2464 |
| 0.855317 | −0.6394 | 3.2464 |
| 0.631705 | −0.625 | 3.2464 |
| 0.408844 | −0.60356 | 3.2464 |
| 0.186852 | −0.57398 | 3.2464 |
| −0.03412 | −0.53495 | 3.2464 |
| −0.25315 | −0.48575 | 3.2464 |
| −0.46982 | −0.427 | 3.2464 |
| −0.68403 | −0.3596 | 3.2464 |
| −0.89573 | −0.28482 | 3.2464 |
| −1.1054 | −0.20432 | 3.2464 |
| −1.31346 | −0.11976 | 3.2464 |
| −1.51327 | −0.03487 | 3.2464 |
| −1.70491 | 0.049745 | 3.2464 |
| −1.8886 | 0.133575 | 3.2464 |
| −2.06457 | 0.216163 | 3.2464 |
| −2.233 | 0.297131 | 3.2464 |
| −2.39401 | 0.376268 | 3.2464 |
| −2.54766 | 0.453412 | 3.2464 |
| −2.69403 | 0.528423 | 3.2464 |
| −2.82648 | 0.597855 | 3.2464 |
| −2.94495 | 0.66184 | 3.2464 |
| −3.04955 | 0.720141 | 3.2464 |
| −3.14691 | 0.776221 | 3.2464 |

TABLE A-continued

| X | Y | Z |
|---|---|---|
| −3.22983 | 0.827368 | 3.2464 |
| −3.29039 | 0.871508 | 3.2464 |
| −3.33471 | 0.911739 | 3.2464 |
| −3.3632 | 0.946464 | 3.2464 |
| −3.37896 | 0.976245 | 3.2464 |
| −3.3833 | 0.994459 | 3.2464 |
| −3.38308 | 1.006484 | 3.2464 |
| −3.38164 | 1.012369 | 3.2464 |
| −3.38065 | 1.015233 | 3.2464 |
| −3.38012 | 1.016655 | 3.2464 |
| −3.37947 | 1.01798 | 3.2464 |
| −3.37809 | 1.020585 | 3.2464 |
| −3.37489 | 1.025493 | 3.2464 |
| −3.36671 | 1.033932 | 3.2464 |
| −3.35106 | 1.043417 | 3.2464 |
| −3.31923 | 1.051191 | 3.2464 |
| −3.27565 | 1.049126 | 3.2464 |
| −3.21929 | 1.03543 | 3.2464 |
| −3.14958 | 1.015451 | 3.2464 |
| −3.05871 | 0.990415 | 3.2464 |
| −2.95361 | 0.962583 | 3.2464 |
| −2.84124 | 0.933988 | 3.2464 |
| −2.71449 | 0.903204 | 3.2464 |
| −2.57327 | 0.87056 | 3.2464 |
| −2.41765 | 0.835819 | 3.2464 |
| −2.25483 | 0.799977 | 3.2464 |
| −2.085 | 0.762325 | 3.2464 |
| −1.9082 | 0.722621 | 3.2464 |
| −1.72446 | 0.680715 | 3.2464 |
| −1.53387 | 0.63629 | 3.2464 |
| −1.33653 | 0.58895 | 3.2464 |
| −1.13251 | 0.538411 | 3.2464 |
| −0.92186 | 0.484472 | 3.2464 |
| −0.71152 | 0.429268 | 3.2464 |
| −0.5012 | 0.374037 | 3.2464 |
| −0.29054 | 0.320091 | 3.2464 |
| −0.07927 | 0.268808 | 3.2464 |
| 0.132774 | 0.221574 | 3.2464 |
| 0.345744 | 0.179254 | 3.2464 |
| 0.559449 | 0.140825 | 3.2464 |
| 0.773607 | 0.104797 | 3.2464 |
| 0.987993 | 0.069983 | 3.2464 |
| 1.20248 | 0.035696 | 3.2464 |
| 1.416959 | 0.001352 | 3.2464 |
| 1.624202 | −0.03237 | 3.2464 |
| 1.82416 | −0.06576 | 3.2464 |
| 2.016815 | −0.09895 | 3.2464 |
| 2.202176 | −0.13181 | 3.2464 |
| 2.380253 | −0.16424 | 3.2464 |
| 2.551065 | −0.19613 | 3.2464 |
| 2.714632 | −0.22739 | 3.2464 |
| 2.863871 | −0.25649 | 3.2464 |
| 2.998816 | −0.28324 | 3.2464 |
| 3.119501 | −0.30744 | 3.2464 |
| 3.225952 | −0.32898 | 3.2464 |
| 3.318186 | −0.34776 | 3.2464 |
| 3.39621 | −0.36375 | 3.2464 |
| 3.462866 | −0.37751 | 3.2464 |
| 3.518869 | −0.38915 | 3.2464 |
| 3.564937 | −0.39878 | 3.2464 |
| 3.601784 | −0.40652 | 3.2464 |
| 3.629939 | −0.413 | 3.2464 |
| 3.648092 | −0.42447 | 3.2464 |
| 3.658528 | −0.43913 | 3.2464 |
| 3.66284 | −0.4529 | 3.2464 |
| 3.665995 | −0.75295 | 4.3074 |
| 3.66319 | −0.76372 | 4.3074 |
| 3.655475 | −0.77638 | 4.3074 |
| 3.640642 | −0.78742 | 4.3074 |
| 3.618756 | −0.79121 | 4.3074 |
| 3.588753 | −0.79066 | 4.3074 |
| 3.549749 | −0.78993 | 4.3074 |
| 3.500994 | −0.789 | 4.3074 |
| 3.441738 | −0.78783 | 4.3074 |
| 3.371233 | −0.78641 | 4.3074 |
| 3.288726 | −0.78472 | 4.3074 |
| 3.191219 | −0.78271 | 4.3074 |
| 3.078711 | −0.78038 | 4.3074 |

TABLE A-continued

| X | Y | Z |
|---|---|---|
| 2.951204 | −0.77766 | 4.3074 |
| 2.808701 | −0.77443 | 4.3074 |
| 2.651206 | −0.77047 | 4.3074 |
| 2.478727 | −0.76552 | 4.3074 |
| 2.298785 | −0.75949 | 4.3074 |
| 2.111437 | −0.75203 | 4.3074 |
| 1.916718 | −0.74275 | 4.3074 |
| 1.714662 | −0.73121 | 4.3074 |
| 1.50531 | −0.71691 | 4.3074 |
| 1.288711 | −0.69923 | 4.3074 |
| 1.064925 | −0.67742 | 4.3074 |
| 0.841501 | −0.6511 | 4.3074 |
| 0.61854 | −0.619 | 4.3074 |
| 0.396677 | −0.57997 | 4.3074 |
| 0.176651 | −0.53318 | 4.3074 |
| −0.04133 | −0.47776 | 4.3074 |
| −0.25719 | −0.4134 | 4.3074 |
| −0.47069 | −0.34105 | 4.3074 |
| −0.68155 | −0.26195 | 4.3074 |
| −0.89026 | −0.17731 | 4.3074 |
| −1.0974 | −0.08862 | 4.3074 |
| −1.30346 | 0.002696 | 4.3074 |
| −1.50176 | 0.092954 | 4.3074 |
| −1.69239 | 0.18186 | 4.3074 |
| −1.87542 | 0.269135 | 4.3074 |
| −2.05096 | 0.354568 | 4.3074 |
| −2.21911 | 0.437946 | 4.3074 |
| −2.38001 | 0.519 | 4.3074 |
| −2.53377 | 0.597548 | 4.3074 |
| −2.68026 | 0.673806 | 4.3074 |
| −2.81267 | 0.744608 | 4.3074 |
| −2.93084 | 0.810287 | 4.3074 |
| −3.03511 | 0.870157 | 4.3074 |
| −3.13239 | 0.927204 | 4.3074 |
| −3.21563 | 0.978503 | 4.3074 |
| −3.27694 | 1.022075 | 4.3074 |
| −3.32223 | 1.061575 | 4.3074 |
| −3.35163 | 1.095718 | 4.3074 |
| −3.36833 | 1.12512 | 4.3074 |
| −3.37327 | 1.143247 | 4.3074 |
| −3.37329 | 1.155318 | 4.3074 |
| −3.37186 | 1.161154 | 4.3074 |
| −3.37081 | 1.163981 | 4.3074 |
| −3.37024 | 1.165384 | 4.3074 |
| −3.36954 | 1.166702 | 4.3074 |
| −3.36803 | 1.169276 | 4.3074 |
| −3.36435 | 1.173959 | 4.3074 |
| −3.35509 | 1.181383 | 4.3074 |
| −3.33793 | 1.188306 | 4.3074 |
| −3.30484 | 1.190525 | 4.3074 |
| −3.26142 | 1.182238 | 4.3074 |
| −3.20567 | 1.163812 | 4.3074 |
| −3.13619 | 1.140063 | 4.3074 |
| −3.0452 | 1.111404 | 4.3074 |
| −2.94 | 1.079061 | 4.3074 |
| −2.82751 | 1.04548 | 4.3074 |
| −2.70045 | 1.009366 | 4.3074 |
| −2.55874 | 0.971069 | 4.3074 |
| −2.40258 | 0.930017 | 4.3074 |
| −2.23919 | 0.887613 | 4.3074 |
| −2.06868 | 0.843385 | 4.3074 |
| −1.89122 | 0.796739 | 4.3074 |
| −1.70698 | 0.747038 | 4.3074 |
| −1.51607 | 0.693926 | 4.3074 |
| −1.31861 | 0.637099 | 4.3074 |
| −1.1147 | 0.576257 | 4.3074 |
| −0.90442 | 0.511102 | 4.3074 |
| −0.69473 | 0.443989 | 4.3074 |
| −0.48532 | 0.375961 | 4.3074 |
| −0.27583 | 0.308166 | 4.3074 |
| −0.06585 | 0.241994 | 4.3074 |
| 0.144945 | 0.179034 | 4.3074 |
| 0.356878 | 0.120576 | 4.3074 |
| 0.569845 | 0.066212 | 4.3074 |
| 0.783557 | 0.014798 | 4.3074 |
| 0.997731 | −0.03478 | 4.3074 |
| 1.212088 | −0.08364 | 4.3074 |
| 1.42636 | −0.13284 | 4.3074 |

TABLE A-continued

| X | Y | Z |
|---|---|---|
| 1.633259 | −0.18131 | 4.3074 |
| 1.832783 | −0.22906 | 4.3074 |
| 2.024945 | −0.27604 | 4.3074 |
| 2.209768 | −0.32215 | 4.3074 |
| 2.38728 | −0.36729 | 4.3074 |
| 2.557513 | −0.41133 | 4.3074 |
| 2.720501 | −0.45413 | 4.3074 |
| 2.869199 | −0.49366 | 4.3074 |
| 3.003647 | −0.52976 | 4.3074 |
| 3.123879 | −0.56229 | 4.3074 |
| 3.229919 | −0.59117 | 4.3074 |
| 3.321782 | −0.61634 | 4.3074 |
| 3.39948 | −0.63776 | 4.3074 |
| 3.465846 | −0.65617 | 4.3074 |
| 3.521596 | −0.67173 | 4.3074 |
| 3.567447 | −0.68461 | 4.3074 |
| 3.604117 | −0.69495 | 4.3074 |
| 3.632316 | −0.70293 | 4.3074 |
| 3.651434 | −0.71323 | 4.3074 |
| 3.662187 | −0.72791 | 4.3074 |
| 3.666104 | −0.742 | 4.3074 |
| 3.64922 | −1.03013 | 5.3994 |
| 3.645361 | −1.04063 | 5.3994 |
| 3.63586 | −1.0521 | 5.3994 |
| 3.619039 | −1.05992 | 5.3994 |
| 3.596569 | −1.05899 | 5.3994 |
| 3.566625 | −1.05541 | 5.3994 |
| 3.527699 | −1.05075 | 5.3994 |
| 3.479041 | −1.04493 | 5.3994 |
| 3.419903 | −1.03785 | 5.3994 |
| 3.349537 | −1.02943 | 5.3994 |
| 3.267193 | −1.01957 | 5.3994 |
| 3.169878 | −1.00793 | 5.3994 |
| 3.057593 | −0.99448 | 5.3994 |
| 2.930343 | −0.97917 | 5.3994 |
| 2.788138 | −0.96194 | 5.3994 |
| 2.630996 | −0.94264 | 5.3994 |
| 2.45895 | −0.92102 | 5.3994 |
| 2.279532 | −0.89775 | 5.3994 |
| 2.092793 | −0.87251 | 5.3994 |
| 1.898783 | −0.84496 | 5.3994 |
| 1.697557 | −0.81473 | 5.3994 |
| 1.489186 | −0.78139 | 5.3994 |
| 1.273757 | −0.74433 | 5.3994 |
| 1.051385 | −0.70283 | 5.3994 |
| 0.829861 | −0.65731 | 5.3994 |
| 0.609698 | −0.60688 | 5.3994 |
| 0.391154 | −0.55062 | 5.3994 |
| 0.17448 | −0.48761 | 5.3994 |
| −0.04007 | −0.41695 | 5.3994 |
| −0.2525 | −0.33869 | 5.3994 |
| −0.46269 | −0.25427 | 5.3994 |
| −0.67091 | −0.16516 | 5.3994 |
| −0.87766 | −0.07257 | 5.3994 |
| −1.08335 | 0.02236 | 5.3994 |
| −1.28843 | 0.11862 | 5.3994 |
| −1.48616 | 0.21274 | 5.3994 |
| −1.67655 | 0.304695 | 5.3994 |
| −1.85959 | 0.394464 | 5.3994 |
| −2.0353 | 0.482027 | 5.3994 |
| −2.2037 | 0.567319 | 5.3994 |
| −2.36489 | 0.650158 | 5.3994 |
| −2.51893 | 0.730408 | 5.3994 |
| −2.66565 | 0.808329 | 5.3994 |
| −2.79821 | 0.880706 | 5.3994 |
| −2.91635 | 0.947914 | 5.3994 |
| −3.02047 | 1.009227 | 5.3994 |
| −3.11768 | 1.067386 | 5.3994 |
| −3.20099 | 1.119326 | 5.3994 |
| −3.26299 | 1.162406 | 5.3994 |
| −3.30942 | 1.201013 | 5.3994 |
| −3.33992 | 1.234326 | 5.3994 |
| −3.35785 | 1.263196 | 5.3994 |
| −3.36363 | 1.281094 | 5.3994 |
| −3.36409 | 1.293195 | 5.3994 |
| −3.36274 | 1.299118 | 5.3994 |
| −3.36162 | 1.30194 | 5.3994 |
| −3.36101 | 1.303335 | 5.3994 |

TABLE A-continued

| X | Y | Z |
|---|---|---|
| −3.36024 | 1.304637 | 5.3994 |
| −3.35858 | 1.307149 | 5.3994 |
| −3.35439 | 1.311494 | 5.3994 |
| −3.34404 | 1.317558 | 5.3994 |
| −3.32578 | 1.321533 | 5.3994 |
| −3.29243 | 1.318278 | 5.3994 |
| −3.25001 | 1.304795 | 5.3994 |
| −3.19469 | 1.283129 | 5.3994 |
| −3.1255 | 1.256147 | 5.3994 |
| −3.0348 | 1.223149 | 5.3994 |
| −2.92979 | 1.186055 | 5.3994 |
| −2.81738 | 1.147614 | 5.3994 |
| −2.69033 | 1.106124 | 5.3994 |
| −2.54862 | 1.061814 | 5.3994 |
| −2.39239 | 1.014157 | 5.3994 |
| −2.22885 | 0.965044 | 5.3994 |
| −2.05809 | 0.914095 | 5.3994 |
| −1.88037 | 0.860582 | 5.3994 |
| −1.69591 | 0.803706 | 5.3994 |
| −1.50484 | 0.743082 | 5.3994 |
| −1.30727 | 0.67839 | 5.3994 |
| −1.10336 | 0.609216 | 5.3994 |
| −0.89335 | 0.535062 | 5.3994 |
| −0.68428 | 0.458273 | 5.3994 |
| −0.47591 | 0.379542 | 5.3994 |
| −0.26796 | 0.299692 | 5.3994 |
| −0.05994 | 0.220014 | 5.3994 |
| 0.148834 | 0.142317 | 5.3994 |
| 0.358925 | 0.068316 | 5.3994 |
| 0.570243 | −0.00182 | 5.3994 |
| 0.782444 | −0.06916 | 5.3994 |
| 0.995192 | −0.13477 | 5.3994 |
| 1.208203 | −0.19955 | 5.3994 |
| 1.421221 | −0.26431 | 5.3994 |
| 1.626959 | −0.32748 | 5.3994 |
| 1.825385 | −0.38915 | 5.3994 |
| 2.016495 | −0.44935 | 5.3994 |
| 2.200304 | −0.50802 | 5.3994 |
| 2.37684 | −0.56507 | 5.3994 |
| 2.546128 | −0.62041 | 5.3994 |
| 2.708196 | −0.67395 | 5.3994 |
| 2.856043 | −0.72322 | 5.3994 |
| 2.98972 | −0.76807 | 5.3994 |
| 3.109261 | −0.80838 | 5.3994 |
| 3.21469 | −0.84411 | 5.3994 |
| 3.306021 | −0.87518 | 5.3994 |
| 3.383267 | −0.90158 | 5.3994 |
| 3.449249 | −0.92422 | 5.3994 |
| 3.504681 | −0.94331 | 5.3994 |
| 3.550276 | −0.95905 | 5.3994 |
| 3.586744 | −0.97167 | 5.3994 |
| 3.614791 | −0.98139 | 5.3994 |
| 3.634874 | −0.99062 | 5.3994 |
| 3.64626 | −1.00492 | 5.3994 |
| 3.649976 | −1.01912 | 5.3994 |
| 3.646288 | −1.29856 | 6.4934 |
| 3.641334 | −1.3088 | 6.4934 |
| 3.629961 | −1.31875 | 6.4934 |
| 3.611512 | −1.3224 | 6.4934 |
| 3.589051 | −1.31773 | 6.4934 |
| 3.559172 | −1.31118 | 6.4934 |
| 3.520323 | −1.30269 | 6.4934 |
| 3.471752 | −1.29213 | 6.4934 |
| 3.412708 | −1.27933 | 6.4934 |
| 3.34244 | −1.26418 | 6.4934 |
| 3.260201 | −1.24648 | 6.4934 |
| 3.163006 | −1.22559 | 6.4934 |
| 3.050861 | −1.20147 | 6.4934 |
| 2.923771 | −1.1741 | 6.4934 |
| 2.781734 | −1.14349 | 6.4934 |
| 2.624769 | −1.10954 | 6.4934 |
| 2.452918 | −1.07209 | 6.4934 |
| 2.273717 | −1.03248 | 6.4934 |
| 2.087237 | −0.99043 | 6.4934 |
| 1.893538 | −0.94568 | 6.4934 |
| 1.692687 | −0.89795 | 6.4934 |
| 1.484802 | −0.84674 | 6.4934 |
| 1.270037 | −0.79139 | 6.4934 |

TABLE A-continued

| X | Y | Z |
|---|---|---|
| 1.048697 | −0.73113 | 6.4934 |
| 0.828557 | −0.66723 | 6.4934 |
| 0.609831 | −0.59908 | 6.4934 |
| 0.392745 | −0.52597 | 6.4934 |
| 0.177547 | −0.44717 | 6.4934 |
| −0.03553 | −0.36197 | 6.4934 |
| −0.24641 | −0.27094 | 6.4934 |
| −0.45532 | −0.17559 | 6.4934 |
| −0.66287 | −0.07726 | 6.4934 |
| −0.86951 | 0.023034 | 6.4934 |
| −1.07555 | 0.124532 | 6.4934 |
| −1.28132 | 0.226583 | 6.4934 |
| −1.47999 | 0.325705 | 6.4934 |
| −1.67152 | 0.421984 | 6.4934 |
| −1.85586 | 0.515503 | 6.4934 |
| −2.03297 | 0.606357 | 6.4934 |
| −2.20281 | 0.694615 | 6.4934 |
| −2.36533 | 0.780364 | 6.4934 |
| −2.52048 | 0.86367 | 6.4934 |
| −2.66817 | 0.944671 | 6.4934 |
| −2.80161 | 1.019781 | 6.4934 |
| −2.92065 | 1.089224 | 6.4934 |
| −3.02552 | 1.15256 | 6.4934 |
| −3.12332 | 1.212786 | 6.4934 |
| −3.20727 | 1.266271 | 6.4934 |
| −3.27061 | 1.30929 | 6.4934 |
| −3.31877 | 1.347099 | 6.4934 |
| −3.35093 | 1.379724 | 6.4934 |
| −3.37038 | 1.408147 | 6.4934 |
| −3.37718 | 1.425853 | 6.4934 |
| −3.37826 | 1.438131 | 6.4934 |
| −3.37705 | 1.444185 | 6.4934 |
| −3.37588 | 1.447035 | 6.4934 |
| −3.37522 | 1.448434 | 6.4934 |
| −3.37439 | 1.44973 | 6.4934 |
| −3.37253 | 1.452167 | 6.4934 |
| −3.3678 | 1.456091 | 6.4934 |
| −3.35646 | 1.460604 | 6.4934 |
| −3.33745 | 1.461589 | 6.4934 |
| −3.30429 | 1.453409 | 6.4934 |
| −3.2625 | 1.435615 | 6.4934 |
| −3.20719 | 1.410864 | 6.4934 |
| −3.1379 | 1.380306 | 6.4934 |
| −3.0472 | 1.342035 | 6.4934 |
| −2.94199 | 1.299212 | 6.4934 |
| −2.82919 | 1.254962 | 6.4934 |
| −2.70166 | 1.206905 | 6.4934 |
| −2.55937 | 1.155173 | 6.4934 |
| −2.4024 | 1.099536 | 6.4934 |
| −2.23797 | 1.042256 | 6.4934 |
| −2.06626 | 0.982878 | 6.4934 |
| −1.88748 | 0.920774 | 6.4934 |
| −1.70188 | 0.85526 | 6.4934 |
| −1.50963 | 0.785858 | 6.4934 |
| −1.31094 | 0.712077 | 6.4934 |
| −1.10602 | 0.633422 | 6.4934 |
| −0.89507 | 0.54936 | 6.4934 |
| −0.68525 | 0.462469 | 6.4934 |
| −0.47643 | 0.373229 | 6.4934 |
| −0.26839 | 0.282192 | 6.4934 |
| −0.06068 | 0.190371 | 6.4934 |
| 0.1474 | 0.099471 | 6.4934 |
| 0.356546 | 0.011202 | 6.4934 |
| 0.567003 | −0.07384 | 6.4934 |
| 0.778462 | −0.15641 | 6.4934 |
| 0.990592 | −0.23732 | 6.4934 |
| 1.20312 | −0.31725 | 6.4934 |
| 1.415831 | −0.39672 | 6.4934 |
| 1.621442 | −0.47357 | 6.4934 |
| 1.819847 | −0.54807 | 6.4934 |
| 2.010982 | −0.6204 | 6.4934 |
| 2.194826 | −0.69061 | 6.4934 |
| 2.371405 | −0.75863 | 6.4934 |
| 2.540744 | −0.8244 | 6.4934 |
| 2.702858 | −0.88785 | 6.4934 |
| 2.850732 | −0.94615 | 6.4934 |
| 2.984417 | −0.99917 | 6.4934 |
| 3.103954 | −1.0468 | 6.4934 |

TABLE A-continued

| X | Y | Z |
|---|---|---|
| 3.209359 | −1.089 | 6.4934 |
| 3.300656 | −1.12571 | 6.4934 |
| 3.377873 | −1.15685 | 6.4934 |
| 3.44385 | −1.18348 | 6.4934 |
| 3.499302 | −1.20586 | 6.4934 |
| 3.54493 | −1.22427 | 6.4934 |
| 3.581434 | −1.23899 | 6.4934 |
| 3.609515 | −1.25031 | 6.4934 |
| 3.630411 | −1.25911 | 6.4934 |
| 3.643484 | −1.27263 | 6.4934 |
| 3.647575 | −1.2872 | 6.4934 |
| 3.642789 | −1.50849 | 7.3994 |
| 3.636922 | −1.51848 | 7.3994 |
| 3.624099 | −1.52687 | 7.3994 |
| 3.604996 | −1.52657 | 7.3994 |
| 3.582653 | −1.52 | 7.3994 |
| 3.55285 | −1.51127 | 7.3994 |
| 3.514089 | −1.49998 | 7.3994 |
| 3.465611 | −1.48597 | 7.3994 |
| 3.406658 | −1.46905 | 7.3994 |
| 3.336476 | −1.44905 | 7.3994 |
| 3.254322 | −1.42572 | 7.3994 |
| 3.157228 | −1.39818 | 7.3994 |
| 3.045211 | −1.36634 | 7.3994 |
| 2.918282 | −1.33017 | 7.3994 |
| 2.776441 | −1.28968 | 7.3994 |
| 2.619709 | −1.2448 | 7.3994 |
| 2.448127 | −1.1954 | 7.3994 |
| 2.269233 | −1.1434 | 7.3994 |
| 2.0831 | −1.08856 | 7.3994 |
| 1.889793 | −1.03067 | 7.3994 |
| 1.689399 | −0.96948 | 7.3994 |
| 1.482073 | −0.90449 | 7.3994 |
| 1.268012 | −0.83509 | 7.3994 |
| 1.047466 | −0.7605 | 7.3994 |
| 0.828039 | −0.68242 | 7.3994 |
| 0.609935 | −0.60021 | 7.3994 |
| 0.393346 | −0.51352 | 7.3994 |
| 0.178697 | −0.42221 | 7.3994 |
| −0.0339 | −0.32616 | 7.3994 |
| −0.24463 | −0.22599 | 7.3994 |
| −0.45384 | −0.12274 | 7.3994 |
| −0.662 | −0.01734 | 7.3994 |
| −0.86941 | 0.089526 | 7.3994 |
| −1.07632 | 0.197363 | 7.3994 |
| −1.28295 | 0.305723 | 7.3994 |
| −1.48251 | 0.410835 | 7.3994 |
| −1.67503 | 0.512626 | 7.3994 |
| −1.86048 | 0.611134 | 7.3994 |
| −2.03876 | 0.706556 | 7.3994 |
| −2.20978 | 0.799058 | 7.3994 |
| −2.37345 | 0.888813 | 7.3994 |
| −2.52967 | 0.97596 | 7.3994 |
| −2.67834 | 1.060641 | 7.3994 |
| −2.81268 | 1.139052 | 7.3994 |
| −2.93265 | 1.211196 | 7.3994 |
| −3.0384 | 1.27681 | 7.3994 |
| −3.13683 | 1.339438 | 7.3994 |
| −3.22143 | 1.394813 | 7.3994 |
| −3.28591 | 1.438311 | 7.3994 |
| −3.33571 | 1.475562 | 7.3994 |
| −3.36952 | 1.507575 | 7.3994 |
| −3.39036 | 1.535621 | 7.3994 |
| −3.39814 | 1.553425 | 7.3994 |
| −3.39977 | 1.565767 | 7.3994 |
| −3.39874 | 1.571898 | 7.3994 |
| −3.39754 | 1.57482 | 7.3994 |
| −3.39682 | 1.576233 | 7.3994 |
| −3.39594 | 1.577527 | 7.3994 |
| −3.39389 | 1.579884 | 7.3994 |
| −3.38871 | 1.583389 | 7.3994 |
| −3.37666 | 1.586526 | 7.3994 |
| −3.35732 | 1.585137 | 7.3994 |
| −3.32455 | 1.573521 | 7.3994 |
| −3.28304 | 1.553003 | 7.3994 |
| −3.22765 | 1.525734 | 7.3994 |
| −3.15816 | 1.492166 | 7.3994 |
| −3.06735 | 1.449492 | 7.3994 |

TABLE A-continued

| X | Y | Z |
|---|---|---|
| −2.96192 | 1.401694 | 7.3994 |
| −2.84878 | 1.352344 | 7.3994 |
| −2.72084 | 1.298452 | 7.3994 |
| −2.57806 | 1.240127 | 7.3994 |
| −2.42045 | 1.177296 | 7.3994 |
| −2.25532 | 1.112476 | 7.3994 |
| −2.08289 | 1.045169 | 7.3994 |
| −1.90335 | 0.97485 | 7.3994 |
| −1.71695 | 0.90094 | 7.3994 |
| −1.52391 | 0.822917 | 7.3994 |
| −1.32447 | 0.740207 | 7.3994 |
| −1.11879 | 0.652393 | 7.3994 |
| −0.90702 | 0.559153 | 7.3994 |
| −0.69632 | 0.463514 | 7.3994 |
| −0.48659 | 0.365827 | 7.3994 |
| −0.27763 | 0.266484 | 7.3994 |
| −0.06915 | 0.166146 | 7.3994 |
| 0.139435 | 0.066005 | 7.3994 |
| 0.348669 | −0.0327 | 7.3994 |
| 0.558886 | −0.12923 | 7.3994 |
| 0.769995 | −0.22379 | 7.3994 |
| 0.981857 | −0.31667 | 7.3994 |
| 1.194302 | −0.40827 | 7.3994 |
| 1.407087 | −0.49908 | 7.3994 |
| 1.612882 | −0.58663 | 7.3994 |
| 1.811533 | −0.67127 | 7.3994 |
| 2.002951 | −0.75321 | 7.3994 |
| 2.187083 | −0.83257 | 7.3994 |
| 2.36394 | −0.90932 | 7.3994 |
| 2.53355 | −0.98341 | 7.3994 |
| 2.695937 | −1.05476 | 7.3994 |
| 2.844074 | −1.1202 | 7.3994 |
| 2.978001 | −1.17964 | 7.3994 |
| 3.097745 | −1.23301 | 7.3994 |
| 3.203315 | −1.2803 | 7.3994 |
| 3.294732 | −1.32146 | 7.3994 |
| 3.372043 | −1.35637 | 7.3994 |
| 3.438122 | −1.38618 | 7.3994 |
| 3.493697 | −1.41114 | 7.3994 |
| 3.539455 | −1.43161 | 7.3994 |
| 3.576076 | −1.44795 | 7.3994 |
| 3.604254 | −1.4605 | 7.3994 |
| 3.62539 | −1.46991 | 7.3994 |
| 3.639921 | −1.48223 | 7.3994 |
| 3.644467 | −1.49697 | 7.3994 |
| 3.62295 | −1.61777 | 7.9494 |
| 3.616608 | −1.62755 | 7.9494 |
| 3.603069 | −1.63494 | 7.9494 |
| 3.583931 | −1.63258 | 7.9494 |
| 3.561655 | −1.62523 | 7.9494 |
| 3.531937 | −1.61549 | 7.9494 |
| 3.493275 | −1.60291 | 7.9494 |
| 3.444907 | −1.58732 | 7.9494 |
| 3.386072 | −1.56851 | 7.9494 |
| 3.316014 | −1.5463 | 7.9494 |
| 3.233998 | −1.52041 | 7.9494 |
| 3.137071 | −1.48981 | 7.9494 |
| 3.025271 | −1.45439 | 7.9494 |
| 2.898615 | −1.41408 | 7.9494 |
| 2.757115 | −1.36885 | 7.9494 |
| 2.600787 | −1.31867 | 7.9494 |
| 2.429681 | −1.2634 | 7.9494 |
| 2.251327 | −1.20518 | 7.9494 |
| 2.065799 | −1.14379 | 7.9494 |
| 1.87316 | −1.07906 | 7.9494 |
| 1.673508 | −1.01072 | 7.9494 |
| 1.467017 | −0.93825 | 7.9494 |
| 1.253902 | −0.86104 | 7.9494 |
| 1.034427 | −0.77835 | 7.9494 |
| 0.816163 | −0.6922 | 7.9494 |
| 0.599364 | −0.60208 | 7.9494 |
| 0.3844 | −0.50803 | 7.9494 |
| 0.171296 | −0.41012 | 7.9494 |
| −0.04 | −0.30846 | 7.9494 |
| −0.24977 | −0.20362 | 7.9494 |
| −0.45838 | −0.09635 | 7.9494 |
| −0.66616 | 0.012624 | 7.9494 |
| −0.8733 | 0.12287 | 7.9494 |

TABLE A-continued

| X | Y | Z |
|---|---|---|
| −1.07994 | 0.234054 | 7.9494 |
| −1.28623 | 0.345885 | 7.9494 |
| −1.4854 | 0.454438 | 7.9494 |
| −1.67753 | 0.55955 | 7.9494 |
| −1.86264 | 0.661209 | 7.9494 |
| −2.04061 | 0.759616 | 7.9494 |
| −2.21135 | 0.854948 | 7.9494 |
| −2.37474 | 0.947368 | 7.9494 |
| −2.53072 | 1.037004 | 7.9494 |
| −2.67917 | 1.124028 | 7.9494 |
| −2.81329 | 1.204549 | 7.9494 |
| −2.93309 | 1.27851 | 7.9494 |
| −3.0387 | 1.345672 | 7.9494 |
| −3.13693 | 1.409837 | 7.9494 |
| −3.22138 | 1.466473 | 7.9494 |
| −3.28595 | 1.510625 | 7.9494 |
| −3.33634 | 1.547711 | 7.9494 |
| −3.37096 | 1.579285 | 7.9494 |
| −3.39253 | 1.607009 | 7.9494 |
| −3.40078 | 1.624639 | 7.9494 |
| −3.40277 | 1.636986 | 7.9494 |
| −3.40182 | 1.643233 | 7.9494 |
| −3.40062 | 1.646138 | 7.9494 |
| −3.39989 | 1.64754 | 7.9494 |
| −3.39896 | 1.648824 | 7.9494 |
| −3.3968 | 1.651109 | 7.9494 |
| −3.39138 | 1.654301 | 7.9494 |
| −3.37903 | 1.656553 | 7.9494 |
| −3.35969 | 1.653799 | 7.9494 |
| −3.32736 | 1.640468 | 7.9494 |
| −3.28603 | 1.618822 | 7.9494 |
| −3.23073 | 1.590337 | 7.9494 |
| −3.16133 | 1.555267 | 7.9494 |
| −3.0707 | 1.510511 | 7.9494 |
| −2.96544 | 1.460326 | 7.9494 |
| −2.85244 | 1.408442 | 7.9494 |
| −2.72464 | 1.351656 | 7.9494 |
| −2.58196 | 1.290098 | 7.9494 |
| −2.42444 | 1.223717 | 7.9494 |
| −2.25941 | 1.155118 | 7.9494 |
| −2.08711 | 1.083781 | 7.9494 |
| −1.90771 | 1.009243 | 7.9494 |
| −1.72145 | 0.930988 | 7.9494 |
| −1.52854 | 0.848511 | 7.9494 |
| −1.32924 | 0.761261 | 7.9494 |
| −1.12369 | 0.668892 | 7.9494 |
| −0.91204 | 0.571206 | 7.9494 |
| −0.70138 | 0.471409 | 7.9494 |
| −0.49161 | 0.369722 | 7.9494 |
| −0.28267 | 0.266398 | 7.9494 |
| −0.07432 | 0.161871 | 7.9494 |
| 0.133887 | 0.057054 | 7.9494 |
| 0.342428 | −0.04708 | 7.9494 |
| 0.551647 | −0.14981 | 7.9494 |
| 0.76158 | −0.25105 | 7.9494 |
| 0.972222 | −0.35082 | 7.9494 |
| 1.183509 | −0.44925 | 7.9494 |
| 1.395223 | −0.54677 | 7.9494 |
| 1.600067 | −0.64063 | 7.9494 |
| 1.797864 | −0.73121 | 7.9494 |
| 1.988504 | −0.81877 | 7.9494 |
| 2.171912 | −0.90345 | 7.9494 |
| 2.348086 | −0.98527 | 7.9494 |
| 2.517053 | −1.06415 | 7.9494 |
| 2.678843 | −1.14004 | 7.9494 |
| 2.826461 | −1.20956 | 7.9494 |
| 2.959932 | −1.27263 | 7.9494 |
| 3.079265 | −1.32926 | 7.9494 |
| 3.184459 | −1.37943 | 7.9494 |
| 3.275535 | −1.42311 | 7.9494 |
| 3.352558 | −1.46016 | 7.9494 |
| 3.418403 | −1.49176 | 7.9494 |
| 3.473808 | −1.51818 | 7.9494 |
| 3.519449 | −1.5398 | 7.9494 |
| 3.555992 | −1.55703 | 7.9494 |
| 3.584116 | −1.57026 | 7.9494 |
| 3.605217 | −1.58016 | 7.9494 |
| 3.62018 | −1.59188 | 7.9494 |

TABLE A-continued

| X | Y | Z |
|---|---|---|
| 3.624807 | −1.60641 | 7.9494 |
| 3.588589 | −1.71262 | 8.4994 |
| 3.58186 | −1.72218 | 8.4994 |
| 3.567769 | −1.72856 | 8.4994 |
| 3.548781 | −1.72456 | 8.4994 |
| 3.52663 | −1.71664 | 8.4994 |
| 3.497073 | −1.70614 | 8.4994 |
| 3.458612 | −1.69259 | 8.4994 |
| 3.410485 | −1.6758 | 8.4994 |
| 3.351929 | −1.65557 | 8.4994 |
| 3.282191 | −1.63169 | 8.4994 |
| 3.200548 | −1.60385 | 8.4994 |
| 3.104072 | −1.57091 | 8.4994 |
| 2.99282 | −1.5327 | 8.4994 |
| 2.866823 | −1.48916 | 8.4994 |
| 2.726104 | −1.44021 | 8.4994 |
| 2.570677 | −1.38582 | 8.4994 |
| 2.400614 | −1.32582 | 8.4994 |
| 2.223419 | −1.26251 | 8.4994 |
| 2.039168 | −1.19569 | 8.4994 |
| 1.847926 | −1.12519 | 8.4994 |
| 1.649811 | −1.05069 | 8.4994 |
| 1.445024 | −0.97166 | 8.4994 |
| 1.233801 | −0.88747 | 8.4994 |
| 1.016399 | −0.79744 | 8.4994 |
| 0.800352 | −0.704 | 8.4994 |
| 0.58606 | −0.60695 | 8.4994 |
| 0.373478 | −0.50644 | 8.4994 |
| 0.162486 | −0.40272 | 8.4994 |
| −0.04706 | −0.29606 | 8.4994 |
| −0.25541 | −0.187 | 8.4994 |
| −0.46288 | −0.07614 | 8.4994 |
| −0.66971 | 0.035972 | 8.4994 |
| −0.87598 | 0.149114 | 8.4994 |
| −1.08174 | 0.263184 | 8.4994 |
| −1.28704 | 0.378066 | 8.4994 |
| −1.48516 | 0.489738 | 8.4994 |
| −1.67621 | 0.597988 | 8.4994 |
| −1.86021 | 0.702756 | 8.4994 |
| −2.03708 | 0.804196 | 8.4994 |
| −2.20675 | 0.902442 | 8.4994 |
| −2.36912 | 0.997616 | 8.4994 |
| −2.52415 | 1.089815 | 8.4994 |
| −2.6717 | 1.179226 | 8.4994 |
| −2.80498 | 1.261897 | 8.4994 |
| −2.92402 | 1.337776 | 8.4994 |
| −3.02891 | 1.406635 | 8.4994 |
| −3.12645 | 1.472403 | 8.4994 |
| −3.21032 | 1.530373 | 8.4994 |
| −3.27449 | 1.575463 | 8.4994 |
| −3.32499 | 1.61267 | 8.4994 |
| −3.36022 | 1.643763 | 8.4994 |
| −3.38244 | 1.671079 | 8.4994 |
| −3.3912 | 1.688593 | 8.4994 |
| −3.39354 | 1.70091 | 8.4994 |
| −3.39273 | 1.707131 | 8.4994 |
| −3.39152 | 1.710071 | 8.4994 |
| −3.39076 | 1.711471 | 8.4994 |
| −3.38981 | 1.712739 | 8.4994 |
| −3.38753 | 1.714931 | 8.4994 |
| −3.38189 | 1.717762 | 8.4994 |
| −3.36938 | 1.719094 | 8.4994 |
| −3.3502 | 1.715045 | 8.4994 |
| −3.31841 | 1.700276 | 8.4994 |
| −3.27731 | 1.677876 | 8.4994 |
| −3.22227 | 1.648448 | 8.4994 |
| −3.15318 | 1.612212 | 8.4994 |
| −3.06292 | 1.565953 | 8.4994 |
| −2.9581 | 1.514005 | 8.4994 |
| −2.84556 | 1.460186 | 8.4994 |
| −2.71823 | 1.401223 | 8.4994 |
| −2.57604 | 1.337267 | 8.4994 |
| −2.41903 | 1.268238 | 8.4994 |
| −2.25456 | 1.196776 | 8.4994 |
| −2.08287 | 1.122341 | 8.4994 |
| −1.90415 | 1.04453 | 8.4994 |
| −1.7186 | 0.962896 | 8.4994 |
| −1.52641 | 0.876989 | 8.4994 |

TABLE A-continued

| X | Y | Z |
|---|---|---|
| −1.32782 | 0.786311 | 8.4994 |
| −1.12299 | 0.690578 | 8.4994 |
| −0.91202 | 0.58964 | 8.4994 |
| −0.70197 | 0.486802 | 8.4994 |
| −0.49282 | 0.38211 | 8.4994 |
| −0.28456 | 0.275623 | 8.4994 |
| −0.07712 | 0.16756 | 8.4994 |
| 0.129881 | 0.05864 | 8.4994 |
| 0.336855 | −0.05034 | 8.4994 |
| 0.544149 | −0.15868 | 8.4994 |
| 0.751912 | −0.26611 | 8.4994 |
| 0.960244 | −0.37243 | 8.4994 |
| 1.1692 | −0.47753 | 8.4994 |
| 1.378639 | −0.58168 | 8.4994 |
| 1.581381 | −0.6818 | 8.4994 |
| 1.777246 | −0.77825 | 8.4994 |
| 1.966095 | −0.87129 | 8.4994 |
| 2.147824 | −0.96115 | 8.4994 |
| 2.322413 | −1.04785 | 8.4994 |
| 2.489888 | −1.13134 | 8.4994 |
| 2.650278 | −1.21157 | 8.4994 |
| 2.796654 | −1.28497 | 8.4994 |
| 2.929027 | −1.35149 | 8.4994 |
| 3.04738 | −1.41118 | 8.4994 |
| 3.151703 | −1.46406 | 8.4994 |
| 3.242012 | −1.5101 | 8.4994 |
| 3.318388 | −1.54912 | 8.4994 |
| 3.383692 | −1.5824 | 8.4994 |
| 3.438663 | −1.6102 | 8.4994 |
| 3.483967 | −1.63292 | 8.4994 |
| 3.520255 | −1.65101 | 8.4994 |
| 3.548194 | −1.66487 | 8.4994 |
| 3.569161 | −1.67524 | 8.4994 |
| 3.585129 | −1.68622 | 8.4994 |
| 3.59054 | −1.70093 | 8.4994 |
| 3.481767 | −1.89218 | 9.7394 |
| 3.474339 | −1.90116 | 9.7394 |
| 3.459494 | −1.90522 | 9.7394 |
| 3.441031 | −1.89882 | 9.7394 |
| 3.419219 | −1.89007 | 9.7394 |
| 3.390122 | −1.87843 | 9.7394 |
| 3.352275 | −1.86335 | 9.7394 |
| 3.304937 | −1.84458 | 9.7394 |
| 3.247369 | −1.82186 | 9.7394 |
| 3.17884 | −1.79489 | 9.7394 |
| 3.098642 | −1.76335 | 9.7394 |
| 3.003905 | −1.72596 | 9.7394 |
| 2.894682 | −1.6826 | 9.7394 |
| 2.771028 | −1.63314 | 9.7394 |
| 2.633003 | −1.57744 | 9.7394 |
| 2.480674 | −1.51537 | 9.7394 |
| 2.314146 | −1.44667 | 9.7394 |
| 2.140776 | −1.37406 | 9.7394 |
| 1.960674 | −1.29729 | 9.7394 |
| 1.773963 | −1.21607 | 9.7394 |
| 1.580816 | −1.13001 | 9.7394 |
| 1.381453 | −1.0386 | 9.7394 |
| 1.176117 | −0.94126 | 9.7394 |
| 0.965141 | −0.83753 | 9.7394 |
| 0.755933 | −0.73055 | 9.7394 |
| 0.54847 | −0.62038 | 9.7394 |
| 0.342452 | −0.50756 | 9.7394 |
| 0.137568 | −0.39266 | 9.7394 |
| −0.06645 | −0.27618 | 9.7394 |
| −0.26981 | −0.15848 | 9.7394 |
| −0.47269 | −0.03993 | 9.7394 |
| −0.67523 | 0.079211 | 9.7394 |
| −0.87736 | 0.199048 | 9.7394 |
| −1.07896 | 0.319756 | 9.7394 |
| −1.27998 | 0.441453 | 9.7394 |
| −1.47379 | 0.559937 | 9.7394 |
| −1.66051 | 0.674992 | 9.7394 |
| −1.84021 | 0.786509 | 9.7394 |
| −2.01286 | 0.894522 | 9.7394 |
| −2.17845 | 0.999059 | 9.7394 |
| −2.33694 | 1.100166 | 9.7394 |
| −2.48829 | 1.197889 | 9.7394 |
| −2.63239 | 1.292398 | 9.7394 |

TABLE A-continued

| X | Y | Z |
|---|---|---|
| −2.76255 | 1.379576 | 9.7394 |
| −2.87873 | 1.459455 | 9.7394 |
| −2.981 | 1.531904 | 9.7394 |
| −3.07599 | 1.601066 | 9.7394 |
| −3.15759 | 1.661979 | 9.7394 |
| −3.21991 | 1.709438 | 9.7394 |
| −3.26946 | 1.747808 | 9.7394 |
| −3.30527 | 1.778214 | 9.7394 |
| −3.32867 | 1.804454 | 9.7394 |
| −3.33846 | 1.82139 | 9.7394 |
| −3.34168 | 1.833471 | 9.7394 |
| −3.34125 | 1.839719 | 9.7394 |
| −3.34011 | 1.842646 | 9.7394 |
| −3.33931 | 1.844012 | 9.7394 |
| −3.33829 | 1.845234 | 9.7394 |
| −3.33574 | 1.847142 | 9.7394 |
| −3.32969 | 1.848994 | 9.7394 |
| −3.31711 | 1.848159 | 9.7394 |
| −3.29871 | 1.841363 | 9.7394 |
| −3.26816 | 1.824087 | 9.7394 |
| −3.22777 | 1.800396 | 9.7394 |
| −3.17372 | 1.769158 | 9.7394 |
| −3.10578 | 1.730768 | 9.7394 |
| −3.01688 | 1.681897 | 9.7394 |
| −2.91357 | 1.626933 | 9.7394 |
| −2.8026 | 1.569873 | 9.7394 |
| −2.67694 | 1.507348 | 9.7394 |
| −2.53656 | 1.43941 | 9.7394 |
| −2.38159 | 1.365822 | 9.7394 |
| −2.21935 | 1.289336 | 9.7394 |
| −2.0501 | 1.209432 | 9.7394 |
| −1.874 | 1.125768 | 9.7394 |
| −1.69123 | 1.037981 | 9.7394 |
| −1.50197 | 0.945715 | 9.7394 |
| −1.30641 | 0.848577 | 9.7394 |
| −1.1047 | 0.746321 | 9.7394 |
| −0.89695 | 0.638799 | 9.7394 |
| −0.69015 | 0.529482 | 9.7394 |
| −0.48439 | 0.418198 | 9.7394 |
| −0.27979 | 0.304739 | 9.7394 |
| −0.07645 | 0.189035 | 9.7394 |
| 0.125853 | 0.071515 | 9.7394 |
| 0.327429 | −0.04725 | 9.7394 |
| 0.528595 | −0.16672 | 9.7394 |
| 0.729666 | −0.28636 | 9.7394 |
| 0.930958 | −0.40561 | 9.7394 |
| 1.132768 | −0.52398 | 9.7394 |
| 1.335124 | −0.64141 | 9.7394 |
| 1.531151 | −0.75422 | 9.7394 |
| 1.720704 | −0.86265 | 9.7394 |
| 1.903645 | −0.96694 | 9.7394 |
| 2.079853 | −1.06729 | 9.7394 |
| 2.249266 | −1.16382 | 9.7394 |
| 2.411886 | −1.25651 | 9.7394 |
| 2.567714 | −1.34536 | 9.7394 |
| 2.709975 | −1.42652 | 9.7394 |
| 2.838667 | −1.49999 | 9.7394 |
| 2.953773 | −1.56579 | 9.7394 |
| 3.055282 | −1.62395 | 9.7394 |
| 3.143189 | −1.67447 | 9.7394 |
| 3.217547 | −1.71726 | 9.7394 |
| 3.281129 | −1.75376 | 9.7394 |
| 3.334643 | −1.78429 | 9.7394 |
| 3.378736 | −1.80931 | 9.7394 |
| 3.414044 | −1.82926 | 9.7394 |
| 3.441219 | −1.84459 | 9.7394 |
| 3.461606 | −1.85607 | 9.7394 |
| 3.477903 | −1.86659 | 9.7394 |
| 3.48388 | −1.88074 | 9.7394 |
| 3.387816 | −2.03592 | 10.8204 |
| 3.37983 | −2.04436 | 10.8204 |
| 3.364633 | −2.04625 | 10.8204 |
| 3.346641 | −2.03861 | 10.8204 |
| 3.325146 | −2.02923 | 10.8204 |
| 3.296504 | −2.01668 | 10.8204 |
| 3.259298 | −2.0003 | 10.8204 |
| 3.212831 | −1.97973 | 10.8204 |
| 3.156409 | −1.95461 | 10.8204 |

TABLE A-continued

| X | Y | Z |
|---|---|---|
| 3.089332 | −1.92459 | 10.8204 |
| 3.010884 | −1.88936 | 10.8204 |
| 2.918204 | −1.84766 | 10.8204 |
| 2.811314 | −1.79943 | 10.8204 |
| 2.690276 | −1.74454 | 10.8204 |
| 2.555198 | −1.68277 | 10.8204 |
| 2.406208 | −1.61384 | 10.8204 |
| 2.243428 | −1.53747 | 10.8204 |
| 2.074061 | −1.45674 | 10.8204 |
| 1.898269 | −1.37137 | 10.8204 |
| 1.716258 | −1.28107 | 10.8204 |
| 1.528207 | −1.1855 | 10.8204 |
| 1.334322 | −1.08428 | 10.8204 |
| 1.134832 | −0.97698 | 10.8204 |
| 0.929995 | −0.86313 | 10.8204 |
| 0.726838 | −0.74613 | 10.8204 |
| 0.52524 | −0.62623 | 10.8204 |
| 0.324889 | −0.5042 | 10.8204 |
| 0.125412 | −0.38076 | 10.8204 |
| −0.07349 | −0.25641 | 10.8204 |
| −0.27192 | −0.13131 | 10.8204 |
| −0.46998 | −0.00561 | 10.8204 |
| −0.66772 | 0.12059 | 10.8204 |
| −0.86509 | 0.247385 | 10.8204 |
| −1.062 | 0.37488 | 10.8204 |
| −1.25841 | 0.503141 | 10.8204 |
| −1.44785 | 0.627771 | 10.8204 |
| −1.63044 | 0.748601 | 10.8204 |
| −1.80622 | 0.865541 | 10.8204 |
| −1.97518 | 0.978618 | 10.8204 |
| −2.13729 | 1.087865 | 10.8204 |
| −2.29251 | 1.193349 | 10.8204 |
| −2.44077 | 1.295146 | 10.8204 |
| −2.58196 | 1.393428 | 10.8204 |
| −2.70951 | 1.483917 | 10.8204 |
| −2.82337 | 1.566665 | 10.8204 |
| −2.92356 | 1.641604 | 10.8204 |
| −3.01649 | 1.713161 | 10.8204 |
| −3.09619 | 1.776272 | 10.8204 |
| −3.15692 | 1.825533 | 10.8204 |
| −3.20527 | 1.865233 | 10.8204 |
| −3.2409 | 1.895747 | 10.8204 |
| −3.26512 | 1.921221 | 10.8204 |
| −3.27568 | 1.9376 | 10.8204 |
| −3.27967 | 1.949421 | 10.8204 |
| −3.27965 | 1.955667 | 10.8204 |
| −3.2786 | 1.95862 | 10.8204 |
| −3.27777 | 1.959957 | 10.8204 |
| −3.27669 | 1.96112 | 10.8204 |
| −3.27394 | 1.962711 | 10.8204 |
| −3.26769 | 1.963638 | 10.8204 |
| −3.25536 | 1.961057 | 10.8204 |
| −3.23793 | 1.952314 | 10.8204 |
| −3.20838 | 1.933396 | 10.8204 |
| −3.16889 | 1.908315 | 10.8204 |
| −3.11597 | 1.875306 | 10.8204 |
| −3.04937 | 1.834763 | 10.8204 |
| −2.96212 | 1.783222 | 10.8204 |
| −2.86061 | 1.725291 | 10.8204 |
| −2.75145 | 1.665145 | 10.8204 |
| −2.62772 | 1.599173 | 10.8204 |
| −2.48947 | 1.527297 | 10.8204 |
| −2.33687 | 1.449193 | 10.8204 |
| −2.17718 | 1.367838 | 10.8204 |
| −2.01065 | 1.282747 | 10.8204 |
| −1.83746 | 1.193562 | 10.8204 |
| −1.65781 | 1.099906 | 10.8204 |
| −1.4719 | 1.001416 | 10.8204 |
| −1.27997 | 0.897695 | 10.8204 |
| −1.08215 | 0.788477 | 10.8204 |
| −0.87857 | 0.67358 | 10.8204 |
| −0.67612 | 0.556743 | 10.8204 |
| −0.47486 | 0.437869 | 10.8204 |
| −0.27487 | 0.316832 | 10.8204 |
| −0.07623 | 0.193589 | 10.8204 |
| 0.12117 | 0.06841 | 10.8204 |
| 0.317577 | −0.05835 | 10.8204 |
| 0.513215 | −0.18631 | 10.8204 |

TABLE A-continued

| X | Y | Z |
|---|---|---|
| 0.708431 | −0.31492 | 10.8204 |
| 0.903659 | −0.44351 | 10.8204 |
| 1.09933 | −0.57142 | 10.8204 |
| 1.295584 | −0.69843 | 10.8204 |
| 1.485749 | −0.82052 | 10.8204 |
| 1.669688 | −0.93788 | 10.8204 |
| 1.84732 | −1.05064 | 10.8204 |
| 2.018599 | −1.15887 | 10.8204 |
| 2.183483 | −1.26263 | 10.8204 |
| 2.341903 | −1.36204 | 10.8204 |
| 2.493789 | −1.45719 | 10.8204 |
| 2.632514 | −1.544 | 10.8204 |
| 2.758077 | −1.62246 | 10.8204 |
| 2.870497 | −1.69254 | 10.8204 |
| 2.969783 | −1.75423 | 10.8204 |
| 3.05589 | −1.8076 | 10.8204 |
| 3.12878 | −1.85271 | 10.8204 |
| 3.191083 | −1.89123 | 10.8204 |
| 3.243453 | −1.92359 | 10.8204 |
| 3.286533 | −1.95023 | 10.8204 |
| 3.320969 | −1.97159 | 10.8204 |
| 3.34743 | −1.98807 | 10.8204 |
| 3.367253 | −2.00046 | 10.8204 |
| 3.383491 | −2.01111 | 10.8204 |
| 3.39 | −2.0247 | 10.8204 |
| 3.30385 | −2.17638 | 11.8994 |
| 3.295286 | −2.18424 | 11.8994 |
| 3.280051 | −2.1837 | 11.8994 |
| 3.262426 | −2.17522 | 11.8994 |
| 3.2413 | −2.16499 | 11.8994 |
| 3.213171 | −2.15128 | 11.8994 |
| 3.176665 | −2.13332 | 11.8994 |
| 3.131124 | −2.11069 | 11.8994 |
| 3.075894 | −2.08296 | 11.8994 |
| 3.010303 | −2.0497 | 11.8994 |
| 2.933638 | −2.01061 | 11.8994 |
| 2.843068 | −1.96434 | 11.8994 |
| 2.738624 | −1.91084 | 11.8994 |
| 2.620385 | −1.84996 | 11.8994 |
| 2.488484 | −1.78144 | 11.8994 |
| 2.343112 | −1.7049 | 11.8994 |
| 2.18453 | −1.61988 | 11.8994 |
| 2.019847 | −1.52978 | 11.8994 |
| 1.849138 | −1.43447 | 11.8994 |
| 1.672512 | −1.33378 | 11.8994 |
| 1.490147 | −1.22738 | 11.8994 |
| 1.302255 | −1.11493 | 11.8994 |
| 1.108979 | −0.99615 | 11.8994 |
| 0.910463 | −0.87096 | 11.8994 |
| 0.713432 | −0.74353 | 11.8994 |
| 0.51763 | −0.61425 | 11.8994 |
| 0.322665 | −0.48371 | 11.8994 |
| 0.128162 | −0.35247 | 11.8994 |
| −0.06607 | −0.22084 | 11.8994 |
| −0.26006 | −0.08883 | 11.8994 |
| −0.45382 | 0.043518 | 11.8994 |
| −0.64736 | 0.176198 | 11.8994 |
| −0.84063 | 0.309254 | 11.8994 |
| −1.03361 | 0.442739 | 11.8994 |
| −1.22628 | 0.576669 | 11.8994 |
| −1.41229 | 0.706482 | 11.8994 |
| −1.59172 | 0.832057 | 11.8994 |
| −1.76459 | 0.953348 | 11.8994 |
| −1.93088 | 1.070419 | 11.8994 |
| −2.09053 | 1.183332 | 11.8994 |
| −2.24345 | 1.292193 | 11.8994 |
| −2.38957 | 1.39713 | 11.8994 |
| −2.52871 | 1.498372 | 11.8994 |
| −2.65431 | 1.591622 | 11.8994 |
| −2.76632 | 1.676917 | 11.8994 |
| −2.86484 | 1.754081 | 11.8994 |
| −2.95622 | 1.827672 | 11.8994 |
| −3.03458 | 1.892482 | 11.8994 |
| −3.09425 | 1.943059 | 11.8994 |
| −3.14168 | 1.983869 | 11.8994 |
| −3.17698 | 2.014798 | 11.8994 |
| −3.20154 | 2.039952 | 11.8994 |
| −3.2125 | 2.056091 | 11.8994 |

TABLE A-continued

| X | Y | Z |
|---|---|---|
| −3.21688 | 2.067773 | 11.8994 |
| −3.21708 | 2.07402 | 11.8994 |
| −3.2161 | 2.076992 | 11.8994 |
| −3.21524 | 2.078318 | 11.8994 |
| −3.21409 | 2.079419 | 11.8994 |
| −3.2112 | 2.08072 | 11.8994 |
| −3.20487 | 2.080896 | 11.8994 |
| −3.19288 | 2.077045 | 11.8994 |
| −3.1762 | 2.066954 | 11.8994 |
| −3.14754 | 2.046627 | 11.8994 |
| −3.10909 | 2.019885 | 11.8994 |
| −3.05744 | 1.984782 | 11.8994 |
| −2.99239 | 1.941633 | 11.8994 |
| −2.90715 | 1.886619 | 11.8994 |
| −2.80798 | 1.824498 | 11.8994 |
| −2.70126 | 1.759798 | 11.8994 |
| −2.58015 | 1.688737 | 11.8994 |
| −2.44465 | 1.611317 | 11.8994 |
| −2.29498 | 1.527226 | 11.8994 |
| −2.13831 | 1.43964 | 11.8994 |
| −1.97494 | 1.348063 | 11.8994 |
| −1.80505 | 1.252143 | 11.8994 |
| −1.62887 | 1.151515 | 11.8994 |
| −1.44661 | 1.04581 | 11.8994 |
| −1.25852 | 0.934621 | 11.8994 |
| −1.06476 | 0.817701 | 11.8994 |
| −0.86547 | 0.694882 | 11.8994 |
| −0.66735 | 0.570159 | 11.8994 |
| −0.47045 | 0.443518 | 11.8994 |
| −0.27483 | 0.314937 | 11.8994 |
| −0.0805 | 0.184393 | 11.8994 |
| 0.112602 | 0.052047 | 11.8994 |
| 0.304583 | −0.08188 | 11.8994 |
| 0.495592 | −0.21719 | 11.8994 |
| 0.685898 | −0.35348 | 11.8994 |
| 0.8759 | −0.49021 | 11.8994 |
| 1.065998 | −0.6268 | 11.8994 |
| 1.256453 | −0.76289 | 11.8994 |
| 1.440971 | −0.89385 | 11.8994 |
| 1.619586 | −1.01964 | 11.8994 |
| 1.792318 | −1.14023 | 11.8994 |
| 1.959163 | −1.25562 | 11.8994 |
| 2.1201 | −1.36586 | 11.8994 |
| 2.274978 | −1.47113 | 11.8994 |
| 2.423617 | −1.57171 | 11.8994 |
| 2.5595 | −1.66328 | 11.8994 |
| 2.682661 | −1.74581 | 11.8994 |
| 2.793096 | −1.8193 | 11.8994 |
| 2.890756 | −1.88381 | 11.8994 |
| 2.975554 | −1.93949 | 11.8994 |
| 3.047389 | −1.98647 | 11.8994 |
| 3.108786 | −2.0266 | 11.8994 |
| 3.160355 | −2.06037 | 11.8994 |
| 3.202733 | −2.08824 | 11.8994 |
| 3.236572 | −2.11063 | 11.8994 |
| 3.262546 | −2.12793 | 11.8994 |
| 3.281989 | −2.14097 | 11.8994 |
| 3.298162 | −2.15188 | 11.8994 |
| 3.306008 | −2.16496 | 11.8994 |
| 3.2574 | −2.23949 | 12.4429 |
| 3.248535 | −2.24702 | 12.4429 |
| 3.233391 | −2.24529 | 12.4429 |
| 3.215947 | −2.23642 | 12.4429 |
| 3.195033 | −2.22573 | 12.4429 |
| 3.16718 | −2.21141 | 12.4429 |
| 3.131024 | −2.1927 | 12.4429 |
| 3.085907 | −2.16916 | 12.4429 |
| 3.031179 | −2.14035 | 12.4429 |
| 2.966181 | −2.10584 | 12.4429 |
| 2.890225 | −2.06526 | 12.4429 |
| 2.800551 | −2.01713 | 12.4429 |
| 2.697222 | −1.96133 | 12.4429 |
| 2.580333 | −1.89769 | 12.4429 |
| 2.450021 | −1.82597 | 12.4429 |
| 2.3065 | −1.74578 | 12.4429 |
| 2.150127 | −1.65664 | 12.4429 |
| 1.987922 | −1.56212 | 12.4429 |
| 1.819976 | −1.46207 | 12.4429 |

TABLE A-continued

| X | Y | Z |
|---|---|---|
| 1.646416 | −1.3563 | 12.4429 |
| 1.467426 | −1.24451 | 12.4429 |
| 1.28321 | −1.12638 | 12.4429 |
| 1.093815 | −1.00185 | 12.4429 |
| 0.899184 | −0.87101 | 12.4429 |
| 0.705684 | −0.73839 | 12.4429 |
| 0.51303 | −0.60446 | 12.4429 |
| 0.320887 | −0.46973 | 12.4429 |
| 0.128943 | −0.33469 | 12.4429 |
| −0.06292 | −0.19955 | 12.4429 |
| −0.25468 | −0.06425 | 12.4429 |
| −0.44632 | 0.071219 | 12.4429 |
| −0.6378 | 0.2069 | 12.4429 |
| −0.82911 | 0.342839 | 12.4429 |
| −1.02019 | 0.479084 | 12.4429 |
| −1.21105 | 0.615645 | 12.4429 |
| −1.39539 | 0.74788 | 12.4429 |
| −1.57328 | 0.875686 | 12.4429 |
| −1.74473 | 0.999038 | 12.4429 |
| −1.90968 | 1.118029 | 12.4429 |
| −2.06807 | 1.232751 | 12.4429 |
| −2.2198 | 1.343324 | 12.4429 |
| −2.36478 | 1.449883 | 12.4429 |
| −2.50282 | 1.552657 | 12.4429 |
| −2.62742 | 1.647282 | 12.4429 |
| −2.73851 | 1.733795 | 12.4429 |
| −2.83623 | 1.812017 | 12.4429 |
| −2.92683 | 1.886584 | 12.4429 |
| −3.00452 | 1.952216 | 12.4429 |
| −3.06367 | 2.003413 | 12.4429 |
| −3.11065 | 2.044765 | 12.4429 |
| −3.1457 | 2.075993 | 12.4429 |
| −3.17025 | 2.101169 | 12.4429 |
| −3.18125 | 2.117274 | 12.4429 |
| −3.18569 | 2.128934 | 12.4429 |
| −3.18594 | 2.135164 | 12.4429 |
| −3.18495 | 2.138157 | 12.4429 |
| −3.18408 | 2.139473 | 12.4429 |
| −3.1829 | 2.140544 | 12.4429 |
| −3.17996 | 2.141721 | 12.4429 |
| −3.17363 | 2.141607 | 12.4429 |
| −3.1618 | 2.137289 | 12.4429 |
| −3.14543 | 2.126686 | 12.4429 |
| −3.11723 | 2.105712 | 12.4429 |
| −3.07935 | 2.078139 | 12.4429 |
| −3.02841 | 2.041964 | 12.4429 |
| −2.96424 | 1.997473 | 12.4429 |
| −2.88013 | 1.940682 | 12.4429 |
| −2.78224 | 1.876465 | 12.4429 |
| −2.67686 | 1.809501 | 12.4429 |
| −2.55722 | 1.735862 | 12.4429 |
| −2.42331 | 1.655564 | 12.4429 |
| −2.27535 | 1.568328 | 12.4429 |
| −2.12045 | 1.477505 | 12.4429 |
| −1.95887 | 1.382622 | 12.4429 |
| −1.79083 | 1.283327 | 12.4429 |
| −1.61655 | 1.179254 | 12.4429 |
| −1.43626 | 1.070044 | 12.4429 |
| −1.2502 | 0.955307 | 12.4429 |
| −1.05853 | 0.834794 | 12.4429 |
| −0.86139 | 0.708348 | 12.4429 |
| −0.66541 | 0.580107 | 12.4429 |
| −0.47063 | 0.450047 | 12.4429 |
| −0.27709 | 0.318152 | 12.4429 |
| −0.08483 | 0.184401 | 12.4429 |
| 0.106192 | 0.048878 | 12.4429 |
| 0.296041 | −0.08825 | 12.4429 |
| 0.484803 | −0.22686 | 12.4429 |
| 0.672687 | −0.36665 | 12.4429 |
| 0.86004 | −0.50716 | 12.4429 |
| 1.04722 | −0.64791 | 12.4429 |
| 1.234537 | −0.78847 | 12.4429 |
| 1.415971 | −0.92385 | 12.4429 |
| 1.591725 | −1.05377 | 12.4429 |
| 1.761904 | −1.1781 | 12.4429 |
| 1.926472 | −1.29688 | 12.4429 |
| 2.085374 | −1.41018 | 12.4429 |
| 2.23845 | −1.51822 | 12.4429 |

TABLE A-continued

| X | Y | Z |
|---|---|---|
| 2.385501 | −1.62126 | 12.4429 |
| 2.520019 | −1.71497 | 12.4429 |
| 2.64197 | −1.7994 | 12.4429 |
| 2.751307 | −1.87463 | 12.4429 |
| 2.847968 | −1.94074 | 12.4429 |
| 2.931866 | −1.99785 | 12.4429 |
| 3.002912 | −2.04609 | 12.4429 |
| 3.063647 | −2.08728 | 12.4429 |
| 3.114695 | −2.12189 | 12.4429 |
| 3.156675 | −2.15039 | 12.4429 |
| 3.190215 | −2.17327 | 12.4429 |
| 3.215972 | −2.19092 | 12.4429 |
| 3.235257 | −2.20421 | 12.4429 |
| 3.251304 | −2.21532 | 12.4429 |
| 3.259573 | −2.22808 | 12.4429 |
| 3.213388 | −2.30044 | 12.9864 |
| 3.204242 | −2.30766 | 12.9864 |
| 3.18921 | −2.30489 | 12.9864 |
| 3.17194 | −2.29565 | 12.9864 |
| 3.151228 | −2.28455 | 12.9864 |
| 3.123631 | −2.2697 | 12.9864 |
| 3.087789 | −2.25034 | 12.9864 |
| 3.043039 | −2.22604 | 12.9864 |
| 2.98873 | −2.19636 | 12.9864 |
| 2.924217 | −2.16085 | 12.9864 |
| 2.848854 | −2.11907 | 12.9864 |
| 2.75996 | −2.06938 | 12.9864 |
| 2.657633 | −2.0116 | 12.9864 |
| 2.54201 | −1.94553 | 12.9864 |
| 2.413256 | −1.87089 | 12.9864 |
| 2.27159 | −1.78732 | 12.9864 |
| 2.117294 | −1.69434 | 12.9864 |
| 1.957291 | −1.59563 | 12.9864 |
| 1.791759 | −1.49098 | 12.9864 |
| 1.62094 | −1.3802 | 12.9864 |
| 1.445005 | −1.26307 | 12.9864 |
| 1.264125 | −1.13933 | 12.9864 |
| 1.07823 | −1.00909 | 12.9864 |
| 0.887118 | −0.87264 | 12.9864 |
| 0.696892 | −0.7349 | 12.9864 |
| 0.507227 | −0.59636 | 12.9864 |
| 0.317804 | −0.45747 | 12.9864 |
| 0.128324 | −0.31866 | 12.9864 |
| −0.06128 | −0.18002 | 12.9864 |
| −0.25094 | −0.04145 | 12.9864 |
| −0.44058 | 0.097154 | 12.9864 |
| −0.63014 | 0.235858 | 12.9864 |
| −0.81958 | 0.374727 | 12.9864 |
| −1.00885 | 0.51382 | 12.9864 |
| −1.19795 | 0.653155 | 12.9864 |
| −1.38063 | 0.788001 | 12.9864 |
| −1.55696 | 0.918258 | 12.9864 |
| −1.72695 | 1.043919 | 12.9864 |
| −1.89051 | 1.165117 | 12.9864 |
| −2.04754 | 1.281975 | 12.9864 |
| −2.19794 | 1.394621 | 12.9864 |
| −2.34162 | 1.503178 | 12.9864 |
| −2.47843 | 1.607837 | 12.9864 |
| −2.60196 | 1.70407 | 12.9864 |
| −2.71216 | 1.791919 | 12.9864 |
| −2.80909 | 1.87128 | 12.9864 |
| −2.89892 | 1.94693 | 12.9864 |
| −2.97589 | 2.013539 | 12.9864 |
| −3.03446 | 2.065494 | 12.9864 |
| −3.08094 | 2.107486 | 12.9864 |
| −3.11566 | 2.139141 | 12.9864 |
| −3.14012 | 2.164461 | 12.9864 |
| −3.15109 | 2.180601 | 12.9864 |
| −3.15553 | 2.192266 | 12.9864 |
| −3.15579 | 2.198503 | 12.9864 |
| −3.1548 | 2.2015 | 12.9864 |
| −3.15391 | 2.202806 | 12.9864 |
| −3.15271 | 2.20385 | 12.9864 |
| −3.14972 | 2.204919 | 12.9864 |
| −3.1434 | 2.204561 | 12.9864 |
| −3.13171 | 2.199845 | 12.9864 |
| −3.11563 | 2.188786 | 12.9864 |
| −3.08784 | 2.167192 | 12.9864 |

TABLE A-continued

| X | Y | Z |
|---|---|---|
| −3.05049 | 2.138813 | 12.9864 |
| −3.00025 | 2.101561 | 12.9864 |
| −2.9369 | 2.055736 | 12.9864 |
| −2.85382 | 1.997253 | 12.9864 |
| −2.75703 | 1.931163 | 12.9864 |
| −2.65276 | 1.862206 | 12.9864 |
| −2.53438 | 1.786232 | 12.9864 |
| −2.40193 | 1.703208 | 12.9864 |
| −2.25559 | 1.612895 | 12.9864 |
| −2.10233 | 1.518907 | 12.9864 |
| −1.94242 | 1.420821 | 12.9864 |
| −1.77608 | 1.318275 | 12.9864 |
| −1.60353 | 1.210896 | 12.9864 |
| −1.42501 | 1.098327 | 12.9864 |
| −1.24076 | 0.980188 | 12.9864 |
| −1.05096 | 0.856252 | 12.9864 |
| −0.85572 | 0.72636 | 12.9864 |
| −0.66162 | 0.594774 | 12.9864 |
| −0.46871 | 0.461463 | 12.9864 |
| −0.27702 | 0.326374 | 12.9864 |
| −0.08664 | 0.189475 | 12.9864 |
| 0.10246 | 0.050795 | 12.9864 |
| 0.290298 | −0.08958 | 12.9864 |
| 0.4769 | −0.23155 | 12.9864 |
| 0.662422 | −0.37493 | 12.9864 |
| 0.847171 | −0.51931 | 12.9864 |
| 1.031469 | −0.66427 | 12.9864 |
| 1.215665 | −0.80937 | 12.9864 |
| 1.394025 | −0.94923 | 12.9864 |
| 1.566935 | −1.08335 | 12.9864 |
| 1.73459 | −1.21148 | 12.9864 |
| 1.896894 | −1.33375 | 12.9864 |
| 2.053729 | −1.4503 | 12.9864 |
| 2.204937 | −1.56134 | 12.9864 |
| 2.350342 | −1.66707 | 12.9864 |
| 2.483469 | −1.76311 | 12.9864 |
| 2.604184 | −1.84962 | 12.9864 |
| 2.712378 | −1.92677 | 12.9864 |
| 2.807974 | −1.99466 | 12.9864 |
| 2.890897 | −2.0534 | 12.9864 |
| 2.961079 | −2.10308 | 12.9864 |
| 3.021083 | −2.14549 | 12.9864 |
| 3.071555 | −2.18107 | 12.9864 |
| 3.113105 | −2.21031 | 12.9864 |
| 3.146334 | −2.23372 | 12.9864 |
| 3.171874 | −2.25176 | 12.9864 |
| 3.191011 | −2.26531 | 12.9864 |
| 3.206944 | −2.27663 | 12.9864 |
| 3.215548 | −2.2891 | 12.9864 |
| 3.169062 | −2.39699 | 13.7994 |
| 3.159584 | −2.40386 | 13.7994 |
| 3.144654 | −2.39993 | 13.7994 |
| 3.127444 | −2.39031 | 13.7994 |
| 3.106804 | −2.37874 | 13.7994 |
| 3.079303 | −2.36328 | 13.7994 |
| 3.043585 | −2.34312 | 13.7994 |
| 2.998993 | −2.31783 | 13.7994 |
| 2.944881 | −2.28694 | 13.7994 |
| 2.880619 | −2.24997 | 13.7994 |
| 2.805592 | −2.20641 | 13.7994 |
| 2.717176 | −2.1545 | 13.7994 |
| 2.615536 | −2.09398 | 13.7994 |
| 2.500897 | −2.02449 | 13.7994 |
| 2.373534 | −1.9456 | 13.7994 |
| 2.233698 | −1.8569 | 13.7994 |
| 2.081667 | −1.75795 | 13.7994 |
| 1.924374 | −1.65278 | 13.7994 |
| 1.762025 | −1.54114 | 13.7994 |
| 1.594735 | −1.42286 | 13.7994 |
| 1.422563 | −1.29788 | 13.7994 |
| 1.245561 | −1.1661 | 13.7994 |
| 1.06354 | −1.02781 | 13.7994 |
| 0.876189 | −0.88344 | 13.7994 |
| 0.689404 | −0.73833 | 13.7994 |
| 0.502853 | −0.59292 | 13.7994 |
| 0.316239 | −0.44759 | 13.7994 |
| 0.129295 | −0.30269 | 13.7994 |
| −0.05799 | −0.15823 | 13.7994 |

TABLE A-continued

| X | Y | Z |
|---|---|---|
| −0.24548 | −0.01404 | 13.7994 |
| −0.43306 | 0.130054 | 13.7994 |
| −0.62062 | 0.274158 | 13.7994 |
| −0.80813 | 0.418329 | 13.7994 |
| −0.99555 | 0.562616 | 13.7994 |
| −1.18287 | 0.707041 | 13.7994 |
| −1.36388 | 0.846731 | 13.7994 |
| −1.53864 | 0.981613 | 13.7994 |
| −1.70714 | 1.111707 | 13.7994 |
| −1.86923 | 1.23719 | 13.7994 |
| −2.0248 | 1.358224 | 13.7994 |
| −2.17375 | 1.474931 | 13.7994 |
| −2.316 | 1.587397 | 13.7994 |
| −2.45144 | 1.695752 | 13.7994 |
| −2.57377 | 1.795247 | 13.7994 |
| −2.68293 | 1.885931 | 13.7994 |
| −2.77891 | 1.967794 | 13.7994 |
| −2.86776 | 2.045849 | 13.7994 |
| −2.94377 | 2.114619 | 13.7994 |
| −3.00156 | 2.16825 | 13.7994 |
| −3.04736 | 2.211621 | 13.7994 |
| −3.08155 | 2.244322 | 13.7994 |
| −3.10574 | 2.270241 | 13.7994 |
| −3.11658 | 2.286632 | 13.7994 |
| −3.12094 | 2.29845 | 13.7994 |
| −3.12115 | 2.30473 | 13.7994 |
| −3.12013 | 2.307714 | 13.7994 |
| −3.11921 | 2.309012 | 13.7994 |
| −3.11797 | 2.310019 | 13.7994 |
| −3.1149 | 2.310921 | 13.7994 |
| −3.10857 | 2.310192 | 13.7994 |
| −3.09705 | 2.304902 | 13.7994 |
| −3.08125 | 2.293217 | 13.7994 |
| −3.05389 | 2.270694 | 13.7994 |
| −3.01715 | 2.240996 | 13.7994 |
| −2.96772 | 2.201934 | 13.7994 |
| −2.90535 | 2.153891 | 13.7994 |
| −2.82338 | 2.092656 | 13.7994 |
| −2.72771 | 2.023539 | 13.7994 |
| −2.62453 | 1.951404 | 13.7994 |
| −2.50735 | 1.871795 | 13.7994 |
| −2.37624 | 1.784634 | 13.7994 |
| −2.2314 | 1.689712 | 13.7994 |
| −2.07967 | 1.590937 | 13.7994 |
| −1.92129 | 1.487947 | 13.7994 |
| −1.75649 | 1.380407 | 13.7994 |
| −1.58548 | 1.267964 | 13.7994 |
| −1.40853 | 1.150242 | 13.7994 |
| −1.22592 | 1.026845 | 13.7994 |
| −1.03781 | 0.897528 | 13.7994 |
| −0.84433 | 0.762134 | 13.7994 |
| −0.65203 | 0.625084 | 13.7994 |
| −0.46095 | 0.486336 | 13.7994 |
| −0.27117 | 0.345861 | 13.7994 |
| −0.08274 | 0.203609 | 13.7994 |
| 0.104311 | 0.059558 | 13.7994 |
| 0.289991 | −0.0863 | 13.7994 |
| 0.474276 | −0.23396 | 13.7994 |
| 0.657218 | −0.38325 | 13.7994 |
| 0.839112 | −0.53381 | 13.7994 |
| 1.020289 | −0.68524 | 13.7994 |
| 1.20114 | −0.83707 | 13.7994 |
| 1.376168 | −0.98358 | 13.7994 |
| 1.545865 | −1.12417 | 13.7994 |
| 1.710494 | −1.25851 | 13.7994 |
| 1.869918 | −1.38677 | 13.7994 |
| 2.023975 | −1.50915 | 13.7994 |
| 2.172555 | −1.62579 | 13.7994 |
| 2.315595 | −1.73676 | 13.7994 |
| 2.446752 | −1.83735 | 13.7994 |
| 2.565837 | −1.92781 | 13.7994 |
| 2.672682 | −2.00837 | 13.7994 |
| 2.767129 | −2.07922 | 13.7994 |
| 2.849068 | −2.14051 | 13.7994 |
| 2.918438 | −2.19232 | 13.7994 |
| 2.977742 | −2.23656 | 13.7994 |
| 3.027604 | −2.27371 | 13.7994 |
| 3.068641 | −2.30427 | 13.7994 |

TABLE A-continued

| X | Y | Z |
|---|---|---|
| 3.101475 | −2.3287 | 13.7994 |
| 3.126732 | −2.3475 | 13.7994 |
| 3.145675 | −2.3616 | 13.7994 |
| 3.161459 | −2.37335 | 13.7994 |
| 3.170989 | −2.38546 | 13.7994 |
| 3.146482 | −2.54578 | 14.7554 |
| 3.136448 | −2.55209 | 14.7554 |
| 3.121607 | −2.54663 | 14.7554 |
| 3.104448 | −2.53615 | 14.7554 |
| 3.083876 | −2.52354 | 14.7554 |
| 3.056477 | −2.50668 | 14.7554 |
| 3.020914 | −2.48468 | 14.7554 |
| 2.976546 | −2.45704 | 14.7554 |
| 2.922752 | −2.42324 | 14.7554 |
| 2.858928 | −2.38273 | 14.7554 |
| 2.784493 | −2.33493 | 14.7554 |
| 2.696889 | −2.2779 | 14.7554 |
| 2.596299 | −2.21139 | 14.7554 |
| 2.482909 | −2.13512 | 14.7554 |
| 2.356902 | −2.04883 | 14.7554 |
| 2.218459 | −1.95225 | 14.7554 |
| 2.067821 | −1.84505 | 14.7554 |
| 1.911869 | −1.73139 | 14.7554 |
| 1.751004 | −1.61085 | 14.7554 |
| 1.585448 | −1.48329 | 14.7554 |
| 1.415195 | −1.3487 | 14.7554 |
| 1.240188 | −1.20717 | 14.7554 |
| 1.060015 | −1.0592 | 14.7554 |
| 0.874119 | −0.90553 | 14.7554 |
| 0.688182 | −0.7519 | 14.7554 |
| 0.502081 | −0.59847 | 14.7554 |
| 0.315774 | −0.44529 | 14.7554 |
| 0.129193 | −0.29245 | 14.7554 |
| −0.05764 | −0.13991 | 14.7554 |
| −0.24461 | 0.012458 | 14.7554 |
| −0.43163 | 0.164771 | 14.7554 |
| −0.61862 | 0.317113 | 14.7554 |
| −0.80558 | 0.469486 | 14.7554 |
| −0.99253 | 0.621885 | 14.7554 |
| −1.17946 | 0.774301 | 14.7554 |
| −1.36017 | 0.921621 | 14.7554 |
| −1.53469 | 1.063818 | 14.7554 |
| −1.70297 | 1.200943 | 14.7554 |
| −1.86484 | 1.333208 | 14.7554 |
| −2.02013 | 1.460808 | 14.7554 |
| −2.16876 | 1.583858 | 14.7554 |
| −2.31069 | 1.702399 | 14.7554 |
| −2.44581 | 1.816564 | 14.7554 |
| −2.56769 | 1.921464 | 14.7554 |
| −2.67622 | 2.017219 | 14.7554 |
| −2.77142 | 2.103738 | 14.7554 |
| −2.85939 | 2.186258 | 14.7554 |
| −2.93454 | 2.258914 | 14.7554 |
| −2.99166 | 2.315517 | 14.7554 |
| −3.03682 | 2.361322 | 14.7554 |
| −3.07042 | 2.395943 | 14.7554 |
| −3.09414 | 2.423241 | 14.7554 |
| −3.10465 | 2.440316 | 14.7554 |
| −3.10871 | 2.452485 | 14.7554 |
| −3.10876 | 2.458905 | 14.7554 |
| −3.10764 | 2.461921 | 14.7554 |
| −3.10666 | 2.463216 | 14.7554 |
| −3.10535 | 2.464183 | 14.7554 |
| −3.10216 | 2.464877 | 14.7554 |
| −3.09578 | 2.463696 | 14.7554 |
| −3.08431 | 2.45773 | 14.7554 |
| −3.06861 | 2.44528 | 14.7554 |
| −3.04145 | 2.421421 | 14.7554 |
| −3.00512 | 2.389742 | 14.7554 |
| −2.95629 | 2.347958 | 14.7554 |
| −2.89456 | 2.296565 | 14.7554 |
| −2.81328 | 2.231112 | 14.7554 |
| −2.71823 | 2.15722 | 14.7554 |
| −2.61552 | 2.080149 | 14.7554 |
| −2.49861 | 1.995205 | 14.7554 |
| −2.36755 | 1.902381 | 14.7554 |
| −2.2226 | 1.801395 | 14.7554 |
| −2.07075 | 1.696272 | 14.7554 |

TABLE A-continued

| X | Y | Z |
|---|---|---|
| −1.91222 | 1.586683 | 14.7554 |
| −1.7472 | 1.472377 | 14.7554 |
| −1.57591 | 1.353011 | 14.7554 |
| −1.39867 | 1.228143 | 14.7554 |
| −1.21583 | 1.097303 | 14.7554 |
| −1.02759 | 0.960229 | 14.7554 |
| −0.83409 | 0.81675 | 14.7554 |
| −0.64188 | 0.671559 | 14.7554 |
| −0.45097 | 0.524648 | 14.7554 |
| −0.26142 | 0.376034 | 14.7554 |
| −0.07326 | 0.225698 | 14.7554 |
| 0.113499 | 0.073626 | 14.7554 |
| 0.298856 | −0.08019 | 14.7554 |
| 0.482795 | −0.23573 | 14.7554 |
| 0.665343 | −0.39288 | 14.7554 |
| 0.846695 | −0.55139 | 14.7554 |
| 1.027043 | −0.71105 | 14.7554 |
| 1.206651 | −0.87156 | 14.7554 |
| 1.38012 | −1.02688 | 14.7554 |
| 1.548063 | −1.17633 | 14.7554 |
| 1.710876 | −1.31945 | 14.7554 |
| 1.868498 | −1.4563 | 14.7554 |
| 2.020816 | −1.58702 | 14.7554 |
| 2.167654 | −1.7118 | 14.7554 |
| 2.308769 | −1.83093 | 14.7554 |
| 2.437833 | −1.93944 | 14.7554 |
| 2.554765 | −2.03743 | 14.7554 |
| 2.659524 | −2.12494 | 14.7554 |
| 2.752079 | −2.20201 | 14.7554 |
| 2.832389 | −2.26869 | 14.7554 |
| 2.9004 | −2.32504 | 14.7554 |
| 2.958555 | −2.37315 | 14.7554 |
| 3.007453 | −2.41356 | 14.7554 |
| 3.047702 | −2.44678 | 14.7554 |
| 3.079912 | −2.47335 | 14.7554 |
| 3.104694 | −2.49378 | 14.7554 |
| 3.123284 | −2.5091 | 14.7554 |
| 3.138778 | −2.52186 | 14.7554 |
| 3.148457 | −2.5342 | 14.7554 |
| 3.106634 | −2.63686 | 15.1994 |
| 3.09641 | −2.64305 | 15.1994 |
| 3.081594 | −2.637 | 15.1994 |
| 3.064408 | −2.62617 | 15.1994 |
| 3.04381 | −2.61314 | 15.1994 |
| 3.016391 | −2.59569 | 15.1994 |
| 2.980823 | −2.57289 | 15.1994 |
| 2.936485 | −2.54419 | 15.1994 |
| 2.882778 | −2.50905 | 15.1994 |
| 2.819127 | −2.46684 | 15.1994 |
| 2.744991 | −2.41694 | 15.1994 |
| 2.657877 | −2.35727 | 15.1994 |
| 2.558038 | −2.2875 | 15.1994 |
| 2.445766 | −2.20723 | 15.1994 |
| 2.321371 | −2.11602 | 15.1994 |
| 2.185087 | −2.01357 | 15.1994 |
| 2.037143 | −1.89956 | 15.1994 |
| 1.884217 | −1.77865 | 15.1994 |
| 1.72659 | −1.65067 | 15.1994 |
| 1.564215 | −1.51571 | 15.1994 |
| 1.396906 | −1.37399 | 15.1994 |
| 1.224457 | −1.22576 | 15.1994 |
| 1.046391 | −1.07158 | 15.1994 |
| 0.862097 | −0.91219 | 15.1994 |
| 0.677205 | −0.75351 | 15.1994 |
| 0.491756 | −0.59549 | 15.1994 |
| 0.305883 | −0.43797 | 15.1994 |
| 0.119683 | −0.28084 | 15.1994 |
| −0.06676 | −0.12399 | 15.1994 |
| −0.25335 | 0.032678 | 15.1994 |
| −0.44001 | 0.189266 | 15.1994 |
| −0.62668 | 0.345841 | 15.1994 |
| −0.81336 | 0.502408 | 15.1994 |
| −1.00004 | 0.658973 | 15.1994 |
| −1.18672 | 0.815536 | 15.1994 |
| −1.36719 | 0.966862 | 15.1994 |
| −1.54148 | 1.112933 | 15.1994 |
| −1.70952 | 1.253802 | 15.1994 |
| −1.87116 | 1.389673 | 15.1994 |

TABLE A-continued

| X | Y | Z |
|---|---|---|
| −2.02621 | 1.520744 | 15.1994 |
| −2.17458 | 1.647144 | 15.1994 |
| −2.3162 | 1.768943 | 15.1994 |
| −2.45093 | 1.886288 | 15.1994 |
| −2.57238 | 1.994137 | 15.1994 |
| −2.68043 | 2.092598 | 15.1994 |
| −2.77513 | 2.181573 | 15.1994 |
| −2.86252 | 2.266445 | 15.1994 |
| −2.93711 | 2.341167 | 15.1994 |
| −2.99374 | 2.399393 | 15.1994 |
| −3.03845 | 2.446533 | 15.1994 |
| −3.07168 | 2.482176 | 15.1994 |
| −3.09504 | 2.51025 | 15.1994 |
| −3.10527 | 2.52773 | 15.1994 |
| −3.10909 | 2.540111 | 15.1994 |
| −3.10899 | 2.546598 | 15.1994 |
| −3.1078 | 2.549621 | 15.1994 |
| −3.10679 | 2.550912 | 15.1994 |
| −3.10545 | 2.551872 | 15.1994 |
| −3.10223 | 2.55254 | 15.1994 |
| −3.0958 | 2.551261 | 15.1994 |
| −3.08431 | 2.545046 | 15.1994 |
| −3.06868 | 2.532167 | 15.1994 |
| −3.04174 | 2.507502 | 15.1994 |
| −3.00566 | 2.47477 | 15.1994 |
| −2.9572 | 2.43153 | 15.1994 |
| −2.89591 | 2.378334 | 15.1994 |
| −2.81506 | 2.310634 | 15.1994 |
| −2.72035 | 2.234301 | 15.1994 |
| −2.61784 | 2.154732 | 15.1994 |
| −2.50107 | 2.067037 | 15.1994 |
| −2.37009 | 1.971219 | 15.1994 |
| −2.22516 | 1.867024 | 15.1994 |
| −2.07322 | 1.758668 | 15.1994 |
| −1.91453 | 1.645801 | 15.1994 |
| −1.74931 | 1.52812 | 15.1994 |
| −1.57782 | 1.405247 | 15.1994 |
| −1.40042 | 1.276723 | 15.1994 |
| −1.21745 | 1.142062 | 15.1994 |
| −1.02911 | 1.001013 | 15.1994 |
| −0.83555 | 0.853439 | 15.1994 |
| −0.64327 | 0.704181 | 15.1994 |
| −0.45234 | 0.553224 | 15.1994 |
| −0.26283 | 0.400536 | 15.1994 |
| −0.07479 | 0.246053 | 15.1994 |
| 0.11175 | 0.089749 | 15.1994 |
| 0.2968 | −0.06837 | 15.1994 |
| 0.480309 | −0.22826 | 15.1994 |
| 0.66228 | −0.38986 | 15.1994 |
| 0.84281 | −0.55306 | 15.1994 |
| 1.02199 | −0.71777 | 15.1994 |
| 1.199988 | −0.88379 | 15.1994 |
| 1.3714 | −1.04498 | 15.1994 |
| 1.536817 | −1.2007 | 15.1994 |
| 1.69665 | −1.35051 | 15.1994 |
| 1.850961 | −1.49435 | 15.1994 |
| 1.99979 | −1.63218 | 15.1994 |
| 2.143162 | −1.76395 | 15.1994 |
| 2.281038 | −1.88971 | 15.1994 |
| 2.407375 | −2.00404 | 15.1994 |
| 2.522099 | −2.10702 | 15.1994 |
| 2.625126 | −2.19873 | 15.1994 |
| 2.716316 | −2.27933 | 15.1994 |
| 2.795535 | −2.34898 | 15.1994 |
| 2.862696 | −2.40776 | 15.1994 |
| 2.92018 | −2.45789 | 15.1994 |
| 2.968556 | −2.49994 | 15.1994 |
| 3.008403 | −2.53449 | 15.1994 |
| 3.040309 | −2.5621 | 15.1994 |
| 3.064869 | −2.58331 | 15.1994 |
| 3.0833 | −2.59921 | 15.1994 |
| 3.098666 | −2.61245 | 15.1994 |
| 3.108595 | −2.62495 | 15.1994 |
| 3.065305 | −2.70257 | 15.5994 |
| 3.054903 | −2.7087 | 15.5994 |
| 3.039971 | −2.70253 | 15.5994 |
| 3.022626 | −2.69163 | 15.5994 |
| 3.001843 | −2.67849 | 15.5994 |

TABLE A-continued

| X | Y | Z |
|---|---|---|
| 2.974187 | −2.66089 | 15.5994 |
| 2.938329 | −2.63787 | 15.5994 |
| 2.89366 | −2.60885 | 15.5994 |
| 2.839598 | −2.57324 | 15.5994 |
| 2.775598 | −2.53038 | 15.5994 |
| 2.701154 | −2.47954 | 15.5994 |
| 2.613832 | −2.41855 | 15.5994 |
| 2.513966 | −2.34695 | 15.5994 |
| 2.401889 | −2.26431 | 15.5994 |
| 2.277957 | −2.17011 | 15.5994 |
| 2.142591 | −2.06391 | 15.5994 |
| 1.996288 | −1.94529 | 15.5994 |
| 1.845664 | −1.81913 | 15.5994 |
| 1.690828 | −1.68529 | 15.5994 |
| 1.531539 | −1.54406 | 15.5994 |
| 1.367399 | −1.39591 | 15.5994 |
| 1.197984 | −1.24134 | 15.5994 |
| 1.022724 | −1.08101 | 15.5994 |
| 0.840936 | −0.9157 | 15.5994 |
| 0.658176 | −0.75149 | 15.5994 |
| 0.47455 | −0.58825 | 15.5994 |
| 0.290258 | −0.42575 | 15.5994 |
| 0.105479 | −0.26381 | 15.5994 |
| −0.07966 | −0.10227 | 15.5994 |
| −0.26506 | 0.058986 | 15.5994 |
| −0.4506 | 0.220067 | 15.5994 |
| −0.63624 | 0.381044 | 15.5994 |
| −0.82196 | 0.541928 | 15.5994 |
| −1.00775 | 0.702727 | 15.5994 |
| −1.19361 | 0.863455 | 15.5994 |
| −1.37329 | 1.018794 | 15.5994 |
| −1.54678 | 1.168783 | 15.5994 |
| −1.714 | 1.313486 | 15.5994 |
| −1.87485 | 1.45304 | 15.5994 |
| −2.02922 | 1.587574 | 15.5994 |
| −2.17696 | 1.717233 | 15.5994 |
| −2.31794 | 1.842172 | 15.5994 |
| −2.45198 | 1.9626 | 15.5994 |
| −2.57266 | 2.073354 | 15.5994 |
| −2.6799 | 2.174528 | 15.5994 |
| −2.77376 | 2.265978 | 15.5994 |
| −2.86027 | 2.353216 | 15.5994 |
| −2.934 | 2.430036 | 15.5994 |
| −2.98989 | 2.48992 | 15.5994 |
| −3.03397 | 2.538405 | 15.5994 |
| −3.06673 | 2.575044 | 15.5994 |
| −3.08965 | 2.603878 | 15.5994 |
| −3.09953 | 2.621747 | 15.5994 |
| −3.10307 | 2.63434 | 15.5994 |
| −3.10278 | 2.640861 | 15.5994 |
| −3.10151 | 2.643879 | 15.5994 |
| −3.10047 | 2.645149 | 15.5994 |
| −3.0991 | 2.646096 | 15.5994 |
| −3.09584 | 2.646725 | 15.5994 |
| −3.08937 | 2.645341 | 15.5994 |
| −3.07788 | 2.638884 | 15.5994 |
| −3.06237 | 2.625593 | 15.5994 |
| −3.03574 | 2.600117 | 15.5994 |
| −3.00004 | 2.566341 | 15.5994 |
| −2.95207 | 2.521698 | 15.5994 |
| −2.89134 | 2.466784 | 15.5994 |
| −2.81109 | 2.396944 | 15.5994 |
| −2.71692 | 2.318269 | 15.5994 |
| −2.61486 | 2.236303 | 15.5994 |
| −2.49844 | 2.146008 | 15.5994 |
| −2.36772 | 2.047433 | 15.5994 |
| −2.22295 | 1.940338 | 15.5994 |
| −2.07109 | 1.829051 | 15.5994 |
| −1.91247 | 1.713157 | 15.5994 |
| −1.74735 | 1.59227 | 15.5994 |
| −1.57606 | 1.465965 | 15.5994 |
| −1.39894 | 1.333787 | 15.5994 |
| −1.21636 | 1.195261 | 15.5994 |
| −1.02851 | 1.050142 | 15.5994 |
| −0.83555 | 0.898312 | 15.5994 |
| −0.64398 | 0.744754 | 15.5994 |
| −0.45386 | 0.589411 | 15.5994 |
| −0.26525 | 0.4322 | 15.5994 |

TABLE A-continued

| X | Y | Z |
|---|---|---|
| −0.07825 | 0.273045 | 15.5994 |
| 0.107077 | 0.111944 | 15.5994 |
| 0.290697 | −0.0511 | 15.5994 |
| 0.472525 | −0.21605 | 15.5994 |
| 0.652551 | −0.38287 | 15.5994 |
| 0.830865 | −0.55146 | 15.5994 |
| 1.007586 | −0.72172 | 15.5994 |
| 1.182901 | −0.89343 | 15.5994 |
| 1.351448 | −1.06038 | 15.5994 |
| 1.513763 | −1.222 | 15.5994 |
| 1.670281 | −1.37786 | 15.5994 |
| 1.821313 | −1.52762 | 15.5994 |
| 1.967172 | −1.67096 | 15.5994 |
| 2.108062 | −1.80766 | 15.5994 |
| 2.243925 | −1.93778 | 15.5994 |
| 2.36872 | −2.05581 | 15.5994 |
| 2.48231 | −2.16189 | 15.5994 |
| 2.584552 | −2.25615 | 15.5994 |
| 2.675245 | −2.33879 | 15.5994 |
| 2.754197 | −2.41003 | 15.5994 |
| 2.821251 | −2.47003 | 15.5994 |
| 2.878723 | −2.52112 | 15.5994 |
| 2.927137 | −2.56392 | 15.5994 |
| 2.967048 | −2.59906 | 15.5994 |
| 2.999025 | −2.62711 | 15.5994 |
| 3.023653 | −2.64865 | 15.5994 |
| 3.04214 | −2.66479 | 15.5994 |
| 3.057557 | −2.67823 | 15.5994 |
| 3.067423 | −2.69083 | 15.5994 |
| 3.044732 | −2.74588 | 15.9164 |
| 3.034206 | −2.75197 | 15.9164 |
| 3.019184 | −2.74573 | 15.9164 |
| 3.001723 | −2.73477 | 15.9164 |
| 2.980803 | −2.72157 | 15.9164 |
| 2.952969 | −2.70387 | 15.9164 |
| 2.916887 | −2.68071 | 15.9164 |
| 2.87195 | −2.6515 | 15.9164 |
| 2.817584 | −2.61563 | 15.9164 |
| 2.753257 | −2.57241 | 15.9164 |
| 2.678495 | −2.52106 | 15.9164 |
| 2.590865 | −2.45935 | 15.9164 |
| 2.490737 | −2.38683 | 15.9164 |
| 2.378495 | −2.303 | 15.9164 |
| 2.254548 | −2.20731 | 15.9164 |
| 2.119324 | −2.0992 | 15.9164 |
| 1.973416 | −1.97824 | 15.9164 |
| 1.823502 | −1.84939 | 15.9164 |
| 1.669692 | −1.71255 | 15.9164 |
| 1.511708 | −1.56801 | 15.9164 |
| 1.349079 | −1.41631 | 15.9164 |
| 1.181303 | −1.25801 | 15.9164 |
| 1.007809 | −1.09375 | 15.9164 |
| 0.827923 | −0.92427 | 15.9164 |
| 0.647122 | −0.7558 | 15.9164 |
| 0.465467 | −0.58825 | 15.9164 |
| 0.283121 | −0.42146 | 15.9164 |
| 0.100244 | −0.25525 | 15.9164 |
| −0.08306 | −0.08951 | 15.9164 |
| −0.26671 | 0.075865 | 15.9164 |
| −0.4506 | 0.240965 | 15.9164 |
| −0.63467 | 0.405872 | 15.9164 |
| −0.81888 | 0.570632 | 15.9164 |
| −1.00318 | 0.735281 | 15.9164 |
| −1.18756 | 0.899849 | 15.9164 |
| −1.36584 | 1.058877 | 15.9164 |
| −1.53798 | 1.212402 | 15.9164 |
| −1.70395 | 1.360484 | 15.9164 |
| −1.86363 | 1.503232 | 15.9164 |
| −2.01695 | 1.640745 | 15.9164 |
| −2.16374 | 1.773188 | 15.9164 |
| −2.30381 | 1.90078 | 15.9164 |
| −2.43691 | 2.023782 | 15.9164 |
| −2.55668 | 2.136916 | 15.9164 |
| −2.663 | 2.240273 | 15.9164 |
| −2.75598 | 2.33369 | 15.9164 |
| −2.84159 | 2.422802 | 15.9164 |
| −2.91447 | 2.501282 | 15.9164 |
| −2.96963 | 2.562477 | 15.9164 |

TABLE A-continued

| X | Y | Z |
|---|---|---|
| −3.01311 | 2.612007 | 15.9164 |
| −3.04546 | 2.649385 | 15.9164 |
| −3.06799 | 2.678786 | 15.9164 |
| −3.07755 | 2.696955 | 15.9164 |
| −3.0808 | 2.709679 | 15.9164 |
| −3.08034 | 2.716232 | 15.9164 |
| −3.07897 | 2.719256 | 15.9164 |
| −3.07788 | 2.720517 | 15.9164 |
| −3.07649 | 2.721438 | 15.9164 |
| −3.0732 | 2.722002 | 15.9164 |
| −3.06671 | 2.720495 | 15.9164 |
| −3.05525 | 2.713842 | 15.9164 |
| −3.03983 | 2.700284 | 15.9164 |
| −3.01351 | 2.674209 | 15.9164 |
| −2.97824 | 2.639611 | 15.9164 |
| −2.93074 | 2.593966 | 15.9164 |
| −2.87052 | 2.537841 | 15.9164 |
| −2.79092 | 2.466423 | 15.9164 |
| −2.69742 | 2.385954 | 15.9164 |
| −2.59602 | 2.302099 | 15.9164 |
| −2.48028 | 2.209714 | 15.9164 |
| −2.35021 | 2.108861 | 15.9164 |
| −2.20607 | 1.999326 | 15.9164 |
| −2.05482 | 1.885544 | 15.9164 |
| −1.89684 | 1.767013 | 15.9164 |
| −1.73253 | 1.643221 | 15.9164 |
| −1.56222 | 1.513715 | 15.9164 |
| −1.38621 | 1.378111 | 15.9164 |
| −1.20484 | 1.236025 | 15.9164 |
| −1.01828 | 1.087216 | 15.9164 |
| −0.82671 | 0.931513 | 15.9164 |
| −0.63663 | 0.773997 | 15.9164 |
| −0.4481 | 0.614622 | 15.9164 |
| −0.26123 | 0.453371 | 15.9164 |
| −0.07608 | 0.290188 | 15.9164 |
| 0.107326 | 0.125039 | 15.9164 |
| 0.288972 | −0.04209 | 15.9164 |
| 0.468827 | −0.21119 | 15.9164 |
| 0.646853 | −0.38216 | 15.9164 |
| 0.823195 | −0.55485 | 15.9164 |
| 0.998033 | −0.72906 | 15.9164 |
| 1.171584 | −0.90459 | 15.9164 |
| 1.33849 | −1.07513 | 15.9164 |
| 1.499221 | −1.24021 | 15.9164 |
| 1.654202 | −1.3994 | 15.9164 |
| 1.803853 | −1.5523 | 15.9164 |
| 1.948577 | −1.69849 | 15.9164 |
| 2.088594 | −1.83778 | 15.9164 |
| 2.223784 | −1.97025 | 15.9164 |
| 2.348073 | −2.09031 | 15.9164 |
| 2.461317 | −2.19811 | 15.9164 |
| 2.563381 | −2.29379 | 15.9164 |
| 2.654039 | −2.37758 | 15.9164 |
| 2.733046 | −2.44972 | 15.9164 |
| 2.800167 | −2.51046 | 15.9164 |
| 2.857687 | −2.56219 | 15.9164 |
| 2.906152 | −2.60553 | 15.9164 |
| 2.946114 | −2.64109 | 15.9164 |
| 2.978139 | −2.66948 | 15.9164 |
| 3.002808 | −2.69128 | 15.9164 |
| 3.021328 | −2.70761 | 15.9164 |
| 3.036775 | −2.7212 | 15.9164 |
| 3.046878 | −2.73384 | 15.9164 |
| 3.027968 | −2.78671 | 16.2334 |
| 3.017332 | −2.79274 | 16.2334 |
| 3.00226 | −2.78639 | 16.2334 |
| 2.984733 | −2.77533 | 16.2334 |
| 2.963738 | −2.762 | 16.2334 |
| 2.935807 | −2.74414 | 16.2334 |
| 2.899605 | −2.72074 | 16.2334 |
| 2.85453 | −2.69124 | 16.2334 |
| 2.800014 | −2.65498 | 16.2334 |
| 2.735539 | −2.61126 | 16.2334 |
| 2.660666 | −2.55925 | 16.2334 |
| 2.572957 | −2.49667 | 16.2334 |
| 2.472786 | −2.42312 | 16.2334 |
| 2.360601 | −2.33802 | 16.2334 |
| 2.23688 | −2.24075 | 16.2334 |

TABLE A-continued

| X | Y | Z |
|---|---|---|
| 2.102046 | −2.13075 | 16.2334 |
| 1.956662 | −2.00757 | 16.2334 |
| 1.807424 | −1.87635 | 16.2334 |
| 1.65442 | −1.737 | 16.2334 |
| 1.497338 | −1.58986 | 16.2334 |
| 1.335659 | −1.43549 | 16.2334 |
| 1.16885 | −1.27447 | 16.2334 |
| 0.996393 | −1.10736 | 16.2334 |
| 0.817691 | −0.93481 | 16.2334 |
| 0.638228 | −0.76307 | 16.2334 |
| 0.45806 | −0.59207 | 16.2334 |
| 0.277331 | −0.42167 | 16.2334 |
| 0.096176 | −0.25173 | 16.2334 |
| −0.08532 | −0.08215 | 16.2334 |
| −0.26711 | 0.087123 | 16.2334 |
| −0.44911 | 0.256165 | 16.2334 |
| −0.63128 | 0.425034 | 16.2334 |
| −0.81355 | 0.593785 | 16.2334 |
| −0.99589 | 0.762471 | 16.2334 |
| −1.17826 | 0.931124 | 16.2334 |
| −1.3546 | 1.094106 | 16.2334 |
| −1.52491 | 1.251404 | 16.2334 |
| −1.68917 | 1.403052 | 16.2334 |
| −1.84728 | 1.54916 | 16.2334 |
| −1.99913 | 1.689834 | 16.2334 |
| −2.14456 | 1.825255 | 16.2334 |
| −2.28332 | 1.955685 | 16.2334 |
| −2.41514 | 2.081402 | 16.2334 |
| −2.53371 | 2.197007 | 16.2334 |
| −2.63892 | 2.302565 | 16.2334 |
| −2.73088 | 2.397932 | 16.2334 |
| −2.81549 | 2.488854 | 16.2334 |
| −2.88746 | 2.568899 | 16.2334 |
| −2.9419 | 2.631292 | 16.2334 |
| −2.98483 | 2.681749 | 16.2334 |
| −3.0168 | 2.719774 | 16.2334 |
| −3.03897 | 2.749688 | 16.2334 |
| −3.04824 | 2.768119 | 16.2334 |
| −3.05125 | 2.781002 | 16.2334 |
| −3.05065 | 2.78758 | 16.2334 |
| −3.04922 | 2.790571 | 16.2334 |
| −3.04811 | 2.791824 | 16.2334 |
| −3.0467 | 2.792724 | 16.2334 |
| −3.04339 | 2.793222 | 16.2334 |
| −3.03692 | 2.791592 | 16.2334 |
| −3.02552 | 2.784774 | 16.2334 |
| −3.01016 | 2.770982 | 16.2334 |
| −2.98412 | 2.744362 | 16.2334 |
| −2.94927 | 2.709 | 16.2334 |
| −2.90221 | 2.662423 | 16.2334 |
| −2.84252 | 2.605139 | 16.2334 |
| −2.76363 | 2.532124 | 16.2334 |
| −2.67095 | 2.449751 | 16.2334 |
| −2.57038 | 2.363831 | 16.2334 |
| −2.45553 | 2.26911 | 16.2334 |
| −2.32641 | 2.165694 | 16.2334 |
| −2.18324 | 2.053378 | 16.2334 |
| −2.03296 | 1.936727 | 16.2334 |
| −1.87603 | 1.815167 | 16.2334 |
| −1.7129 | 1.688096 | 16.2334 |
| −1.54394 | 1.55506 | 16.2334 |
| −1.36939 | 1.415759 | 16.2334 |
| −1.18953 | 1.269876 | 16.2334 |
| −1.00456 | 1.117179 | 16.2334 |
| −0.81468 | 0.957489 | 16.2334 |
| −0.62636 | 0.796 | 16.2334 |
| −0.43963 | 0.632677 | 16.2334 |
| −0.2545 | 0.467486 | 16.2334 |
| −0.07104 | 0.30041 | 16.2334 |
| 0.110689 | 0.131473 | 16.2334 |
| 0.290693 | −0.03931 | 16.2334 |
| 0.468911 | −0.21186 | 16.2334 |
| 0.645389 | −0.38612 | 16.2334 |
| 0.820283 | −0.56194 | 16.2334 |
| 0.993761 | −0.73915 | 16.2334 |
| 1.166015 | −0.91756 | 16.2334 |
| 1.331695 | −1.09084 | 16.2334 |
| 1.491246 | −1.25855 | 16.2334 |

TABLE A-continued

| X | Y | Z |
|---|---|---|
| 1.645079 | −1.42029 | 16.2334 |
| 1.793627 | −1.57564 | 16.2334 |
| 1.937295 | −1.72419 | 16.2334 |
| 2.076299 | −1.86572 | 16.2334 |
| 2.210545 | −2.00032 | 16.2334 |
| 2.334045 | −2.1223 | 16.2334 |
| 2.446672 | −2.23177 | 16.2334 |
| 2.548283 | −2.32884 | 16.2334 |
| 2.63863 | −2.41377 | 16.2334 |
| 2.717436 | −2.48683 | 16.2334 |
| 2.784378 | −2.54838 | 16.2334 |
| 2.84171 | −2.60083 | 16.2334 |
| 2.890018 | −2.64478 | 16.2334 |
| 2.929858 | −2.68084 | 16.2334 |
| 2.961791 | −2.70962 | 16.2334 |
| 2.986392 | −2.73171 | 16.2334 |
| 3.004865 | −2.74826 | 16.2334 |
| 3.020272 | −2.76204 | 16.2334 |
| 3.03024 | −2.77482 | 16.2334 |
| 3.007762 | −2.83628 | 16.6194 |
| 2.99698 | −2.84225 | 16.6194 |
| 2.981842 | −2.83572 | 16.6194 |
| 2.964229 | −2.82452 | 16.6194 |
| 2.943134 | −2.81101 | 16.6194 |
| 2.915074 | −2.7929 | 16.6194 |
| 2.878715 | −2.76918 | 16.6194 |
| 2.83346 | −2.73924 | 16.6194 |
| 2.77875 | −2.70242 | 16.6194 |
| 2.71409 | −2.65798 | 16.6194 |
| 2.639083 | −2.60501 | 16.6194 |
| 2.551288 | −2.54121 | 16.6194 |
| 2.451084 | −2.46619 | 16.6194 |
| 2.339009 | −2.3793 | 16.6194 |
| 2.215625 | −2.27981 | 16.6194 |
| 2.081357 | −2.1672 | 16.6194 |
| 1.93669 | −2.04102 | 16.6194 |
| 1.788302 | −1.90665 | 16.6194 |
| 1.63623 | −1.76405 | 16.6194 |
| 1.480095 | −1.61362 | 16.6194 |
| 1.319303 | −1.456 | 16.6194 |
| 1.153279 | −1.29177 | 16.6194 |
| 0.981569 | −1.12143 | 16.6194 |
| 0.803672 | −0.94548 | 16.6194 |
| 0.625124 | −0.7702 | 16.6194 |
| 0.445989 | −0.59553 | 16.6194 |
| 0.266404 | −0.42132 | 16.6194 |
| 0.086495 | −0.24744 | 16.6194 |
| −0.09366 | −0.07381 | 16.6194 |
| −0.27401 | 0.099615 | 16.6194 |
| −0.45448 | 0.27291 | 16.6194 |
| −0.63504 | 0.446116 | 16.6194 |
| −0.81565 | 0.61927 | 16.6194 |
| −0.99628 | 0.792412 | 16.6194 |
| −1.17689 | 0.965559 | 16.6194 |
| −1.35153 | 1.132894 | 16.6194 |
| −1.52023 | 1.294371 | 16.6194 |
| −1.68297 | 1.450012 | 16.6194 |
| −1.83961 | 1.599962 | 16.6194 |
| −1.99002 | 1.74436 | 16.6194 |
| −2.134 | 1.883408 | 16.6194 |
| −2.27128 | 2.017384 | 16.6194 |
| −2.40158 | 2.146569 | 16.6194 |
| −2.51864 | 2.265386 | 16.6194 |
| −2.6224 | 2.373882 | 16.6194 |
| −2.713 | 2.471853 | 16.6194 |
| −2.79631 | 2.565188 | 16.6194 |
| −2.86716 | 2.647267 | 16.6194 |
| −2.9208 | 2.711139 | 16.6194 |
| −2.96313 | 2.762719 | 16.6194 |
| −2.99466 | 2.801583 | 16.6194 |
| −3.01634 | 2.832177 | 16.6194 |
| −3.0253 | 2.850952 | 16.6194 |
| −3.02809 | 2.863962 | 16.6194 |
| −3.02738 | 2.870594 | 16.6194 |
| −3.02589 | 2.873583 | 16.6194 |
| −3.02476 | 2.87483 | 16.6194 |
| −3.02333 | 2.875719 | 16.6194 |
| −3.01999 | 2.876184 | 16.6194 |

TABLE A-continued

| X | Y | Z |
|---|---|---|
| −3.0135 | 2.874463 | 16.6194 |
| −3.00211 | 2.867455 | 16.6194 |
| −2.98685 | 2.853358 | 16.6194 |
| −2.96113 | 2.826075 | 16.6194 |
| −2.92665 | 2.789862 | 16.6194 |
| −2.88017 | 2.742072 | 16.6194 |
| −2.82125 | 2.683175 | 16.6194 |
| −2.74341 | 2.607952 | 16.6194 |
| −2.65192 | 2.522969 | 16.6194 |
| −2.55253 | 2.434282 | 16.6194 |
| −2.43885 | 2.336527 | 16.6194 |
| −2.31086 | 2.229884 | 16.6194 |
| −2.16879 | 2.11415 | 16.6194 |
| −2.01957 | 1.994019 | 16.6194 |
| −1.86366 | 1.868907 | 16.6194 |
| −1.70156 | 1.738211 | 16.6194 |
| −1.53363 | 1.601475 | 16.6194 |
| −1.36016 | 1.458369 | 16.6194 |
| −1.18146 | 1.308528 | 16.6194 |
| −0.99775 | 1.151721 | 16.6194 |
| −0.80923 | 0.987784 | 16.6194 |
| −0.62229 | 0.822067 | 16.6194 |
| −0.43695 | 0.654549 | 16.6194 |
| −0.25323 | 0.485212 | 16.6194 |
| −0.07118 | 0.314063 | 16.6194 |
| 0.10917 | 0.14113 | 16.6194 |
| 0.287835 | −0.03352 | 16.6194 |
| 0.464801 | −0.2098 | 16.6194 |
| 0.640131 | −0.38766 | 16.6194 |
| 0.813947 | −0.56696 | 16.6194 |
| 0.986368 | −0.74761 | 16.6194 |
| 1.157537 | −0.92945 | 16.6194 |
| 1.322118 | −1.10608 | 16.6194 |
| 1.480551 | −1.27708 | 16.6194 |
| 1.633242 | −1.44204 | 16.6194 |
| 1.780625 | −1.60057 | 16.6194 |
| 1.923106 | −1.75226 | 16.6194 |
| 2.060932 | −1.89688 | 16.6194 |
| 2.194069 | −2.03447 | 16.6194 |
| 2.316631 | −2.15913 | 16.6194 |
| 2.42852 | −2.27095 | 16.6194 |
| 2.529601 | −2.37 | 16.6194 |
| 2.619609 | −2.45656 | 16.6194 |
| 2.698213 | −2.53096 | 16.6194 |
| 2.764978 | −2.59365 | 16.6194 |
| 2.822117 | −2.64713 | 16.6194 |
| 2.870265 | −2.69194 | 16.6194 |
| 2.909986 | −2.72869 | 16.6194 |
| 2.941831 | −2.75802 | 16.6194 |
| 2.966371 | −2.78053 | 16.6194 |
| 2.984801 | −2.79739 | 16.6194 |
| 3.000174 | −2.81143 | 16.6194 |
| 3.010133 | −2.82434 | 16.6194 |
| 2.985462 | −2.891 | 17.0454 |
| 2.974517 | −2.89689 | 17.0454 |
| 2.959299 | −2.89017 | 17.0454 |
| 2.941579 | −2.8788 | 17.0454 |
| 2.920358 | −2.86508 | 17.0454 |
| 2.892138 | −2.84668 | 17.0454 |
| 2.855579 | −2.82257 | 17.0454 |
| 2.810094 | −2.79211 | 17.0454 |
| 2.755134 | −2.75465 | 17.0454 |
| 2.690228 | −2.70936 | 17.0454 |
| 2.61503 | −2.6553 | 17.0454 |
| 2.527087 | −2.59009 | 17.0454 |
| 2.426784 | −2.51339 | 17.0454 |
| 2.314771 | −2.42444 | 17.0454 |
| 2.191711 | −2.32244 | 17.0454 |
| 2.058024 | −2.20689 | 17.0454 |
| 1.914111 | −2.07733 | 17.0454 |
| 1.766594 | −1.93937 | 17.0454 |
| 1.615485 | −1.79307 | 17.0454 |
| 1.460321 | −1.63891 | 17.0454 |
| 1.300421 | −1.47757 | 17.0454 |
| 1.135156 | −1.3097 | 17.0454 |
| 0.964139 | −1.13567 | 17.0454 |
| 0.786969 | −0.95591 | 17.0454 |
| 0.609247 | −0.77669 | 17.0454 |

TABLE A-continued

| X | Y | Z |
|---|---|---|
| 0.43104 | −0.59796 | 17.0454 |
| 0.252473 | −0.41959 | 17.0454 |
| 0.073661 | −0.24147 | 17.0454 |
| −0.10533 | −0.06352 | 17.0454 |
| −0.28443 | 0.114312 | 17.0454 |
| −0.46358 | 0.292089 | 17.0454 |
| −0.64276 | 0.469846 | 17.0454 |
| −0.82195 | 0.647596 | 17.0454 |
| −1.00113 | 0.825353 | 17.0454 |
| −1.1803 | 1.003111 | 17.0454 |
| −1.35357 | 1.174882 | 17.0454 |
| −1.52099 | 1.340602 | 17.0454 |
| −1.68252 | 1.500301 | 17.0454 |
| −1.83798 | 1.654185 | 17.0454 |
| −1.98716 | 1.802451 | 17.0454 |
| −2.12982 | 1.945335 | 17.0454 |
| −2.26568 | 2.083125 | 17.0454 |
| −2.39441 | 2.216106 | 17.0454 |
| −2.50986 | 2.338503 | 17.0454 |
| −2.61198 | 2.450327 | 17.0454 |
| −2.70101 | 2.55129 | 17.0454 |
| −2.78279 | 2.647412 | 17.0454 |
| −2.85233 | 2.731836 | 17.0454 |
| −2.90507 | 2.797398 | 17.0454 |
| −2.94674 | 2.850258 | 17.0454 |
| −2.97773 | 2.890107 | 17.0454 |
| −2.99881 | 2.921514 | 17.0454 |
| −3.00737 | 2.940675 | 17.0454 |
| −3.00988 | 2.953862 | 17.0454 |
| −3.00902 | 2.960533 | 17.0454 |
| −3.00748 | 2.96352 | 17.0454 |
| −3.00632 | 2.964761 | 17.0454 |
| −3.00486 | 2.965645 | 17.0454 |
| −3.00149 | 2.966108 | 17.0454 |
| −2.99496 | 2.964345 | 17.0454 |
| −2.98355 | 2.957164 | 17.0454 |
| −2.96839 | 2.942717 | 17.0454 |
| −2.94302 | 2.91469 | 17.0454 |
| −2.90892 | 2.877556 | 17.0454 |
| −2.86311 | 2.828367 | 17.0454 |
| −2.80513 | 2.767573 | 17.0454 |
| −2.72854 | 2.689789 | 17.0454 |
| −2.63846 | 2.601829 | 17.0454 |
| −2.5404 | 2.510049 | 17.0454 |
| −2.42798 | 2.408974 | 17.0454 |
| −2.30112 | 2.298862 | 17.0454 |
| −2.16006 | 2.179509 | 17.0454 |
| −2.01174 | 2.055729 | 17.0454 |
| −1.85665 | 1.926951 | 17.0454 |
| −1.69527 | 1.792603 | 17.0454 |
| −1.528 | 1.652195 | 17.0454 |
| −1.35523 | 1.505299 | 17.0454 |
| −1.17735 | 1.351454 | 17.0454 |
| −0.99461 | 1.190427 | 17.0454 |
| −0.80717 | 1.022082 | 17.0454 |
| −0.62137 | 0.851943 | 17.0454 |
| −0.43721 | 0.680005 | 17.0454 |
| −0.25471 | 0.506262 | 17.0454 |
| −0.07393 | 0.330741 | 17.0454 |
| 0.105166 | 0.153487 | 17.0454 |
| 0.282593 | −0.02538 | 17.0454 |
| 0.4584 | −0.20576 | 17.0454 |
| 0.632663 | −0.38759 | 17.0454 |
| 0.805461 | −0.5708 | 17.0454 |
| 0.976861 | −0.75531 | 17.0454 |
| 1.146957 | −0.94105 | 17.0454 |
| 1.31043 | −1.12148 | 17.0454 |
| 1.467721 | −1.29621 | 17.0454 |
| 1.619234 | −1.46485 | 17.0454 |
| 1.765406 | −1.62699 | 17.0454 |
| 1.906653 | −1.78225 | 17.0454 |
| 2.04325 | −1.93038 | 17.0454 |
| 2.175233 | −2.07134 | 17.0454 |
| 2.296823 | −2.19905 | 17.0454 |
| 2.407945 | −2.31352 | 17.0454 |
| 2.508491 | −2.41483 | 17.0454 |
| 2.598172 | −2.50326 | 17.0454 |
| 2.676598 | −2.5792 | 17.0454 |

TABLE A-continued

| X | Y | Z |
|---|---|---|
| 2.743208 | −2.6432 | 17.0454 |
| 2.800169 | −2.69785 | 17.0454 |
| 2.848168 | −2.74364 | 17.0454 |
| 2.887778 | −2.7812 | 17.0454 |
| 2.919544 | −2.81116 | 17.0454 |
| 2.944029 | −2.83416 | 17.0454 |
| 2.96242 | −2.85138 | 17.0454 |
| 2.977763 | −2.86571 | 17.0454 |
| 2.987898 | −2.87879 | 17.0454 |
| 2.954053 | −2.96808 | 17.6454 |
| 2.942913 | −2.97388 | 17.6454 |
| 2.927579 | −2.96692 | 17.6454 |
| 2.909698 | −2.95528 | 17.6454 |
| 2.888287 | −2.94125 | 17.6454 |
| 2.859822 | −2.92242 | 17.6454 |
| 2.822961 | −2.89772 | 17.6454 |
| 2.777122 | −2.86651 | 17.6454 |
| 2.721762 | −2.82807 | 17.6454 |
| 2.65644 | −2.78154 | 17.6454 |
| 2.580936 | −2.72587 | 17.6454 |
| 2.492858 | −2.65871 | 17.6454 |
| 2.392528 | −2.5797 | 17.6454 |
| 2.280715 | −2.48791 | 17.6454 |
| 2.158201 | −2.38242 | 17.6454 |
| 2.025394 | −2.26275 | 17.6454 |
| 1.882628 | −2.12851 | 17.6454 |
| 1.736334 | −1.9855 | 17.6454 |
| 1.586563 | −1.83401 | 17.6454 |
| 1.432737 | −1.67458 | 17.6454 |
| 1.274053 | −1.50801 | 17.6454 |
| 1.109811 | −1.33496 | 17.6454 |
| 0.939724 | −1.15571 | 17.6454 |
| 0.763532 | −0.97051 | 17.6454 |
| 0.586925 | −0.78571 | 17.6454 |
| 0.409976 | −0.60124 | 17.6454 |
| 0.232795 | −0.41699 | 17.6454 |
| 0.055479 | −0.23288 | 17.6454 |
| −0.12191 | −0.04883 | 17.6454 |
| −0.2993 | 0.135216 | 17.6454 |
| −0.47665 | 0.319305 | 17.6454 |
| −0.65392 | 0.503464 | 17.6454 |
| −0.83114 | 0.687674 | 17.6454 |
| −1.00832 | 0.871919 | 17.6454 |
| −1.18551 | 1.056159 | 17.6454 |
| −1.35689 | 1.234168 | 17.6454 |
| −1.52254 | 1.405861 | 17.6454 |
| −1.68242 | 1.571276 | 17.6454 |
| −1.83625 | 1.730698 | 17.6454 |
| −1.98372 | 1.884407 | 17.6454 |
| −2.12455 | 2.032683 | 17.6454 |
| −2.25839 | 2.175821 | 17.6454 |
| −2.38493 | 2.31412 | 17.6454 |
| −2.49809 | 2.441527 | 17.6454 |
| −2.59787 | 2.557998 | 17.6454 |
| −2.68465 | 2.663144 | 17.6454 |
| −2.76423 | 2.763168 | 17.6454 |
| −2.83187 | 2.850891 | 17.6454 |
| −2.88329 | 2.918844 | 17.6454 |
| −2.924 | 2.973525 | 17.6454 |
| −2.95421 | 3.01477 | 17.6454 |
| −2.97442 | 3.047317 | 17.6454 |
| −2.98237 | 3.067019 | 17.6454 |
| −2.98447 | 3.080436 | 17.6454 |
| −2.98341 | 3.087147 | 17.6454 |
| −2.98175 | 3.090156 | 17.6454 |
| −2.98054 | 3.091387 | 17.6454 |
| −2.97907 | 3.09226 | 17.6454 |
| −2.97567 | 3.092728 | 17.6454 |
| −2.96909 | 3.090919 | 17.6454 |
| −2.95768 | 3.083527 | 17.6454 |
| −2.94267 | 3.068572 | 17.6454 |
| −2.91779 | 3.039472 | 17.6454 |
| −2.88424 | 3.001001 | 17.6454 |
| −2.8394 | 2.949805 | 17.6454 |
| −2.78279 | 2.886338 | 17.6454 |
| −2.708 | 2.804942 | 17.6454 |
| −2.61985 | 2.712747 | 17.6454 |
| −2.52358 | 2.616531 | 17.6454 |

TABLE A-continued

| X | Y | Z |
|---|---|---|
| −2.41293 | 2.510792 | 17.6454 |
| −2.28767 | 2.395861 | 17.6454 |
| −2.14805 | 2.271468 | 17.6454 |
| −2.00102 | 2.142596 | 17.6454 |
| −1.84707 | 2.008697 | 17.6454 |
| −1.68669 | 1.869238 | 17.6454 |
| −1.52035 | 1.723681 | 17.6454 |
| −1.34856 | 1.571471 | 17.6454 |
| −1.17185 | 1.412026 | 17.6454 |
| −0.99047 | 1.245092 | 17.6454 |
| −0.80452 | 1.070544 | 17.6454 |
| −0.6203 | 0.894193 | 17.6454 |
| −0.43782 | 0.716068 | 17.6454 |
| −0.25706 | 0.536172 | 17.6454 |
| −0.07803 | 0.35453 | 17.6454 |
| 0.099281 | 0.171246 | 17.6454 |
| 0.275008 | −0.01356 | 17.6454 |
| 0.449264 | −0.19978 | 17.6454 |
| 0.622107 | −0.38729 | 17.6454 |
| 0.793547 | −0.57606 | 17.6454 |
| 0.963579 | −0.7661 | 17.6454 |
| 1.132226 | −0.95738 | 17.6454 |
| 1.294195 | −1.14323 | 17.6454 |
| 1.44992 | −1.32326 | 17.6454 |
| 1.599812 | −1.49709 | 17.6454 |
| 1.744316 | −1.66434 | 17.6454 |
| 1.88386 | −1.82464 | 17.6454 |
| 2.018763 | −1.97771 | 17.6454 |
| 2.149148 | −2.12343 | 17.6454 |
| 2.269365 | −2.2554 | 17.6454 |
| 2.37941 | −2.37362 | 17.6454 |
| 2.479218 | −2.47814 | 17.6454 |
| 2.568456 | −2.56927 | 17.6454 |
| 2.646632 | −2.64741 | 17.6454 |
| 2.713032 | −2.71329 | 17.6454 |
| 2.769745 | −2.76961 | 17.6454 |
| 2.817535 | −2.81681 | 17.6454 |
| 2.856989 | −2.85552 | 17.6454 |
| 2.888643 | −2.88639 | 17.6454 |
| 2.913048 | −2.91008 | 17.6454 |
| 2.931384 | −2.92781 | 17.6454 |
| 2.946682 | −2.94257 | 17.6454 |
| 2.956698 | −2.95594 | 17.6454 |

Figure 5:
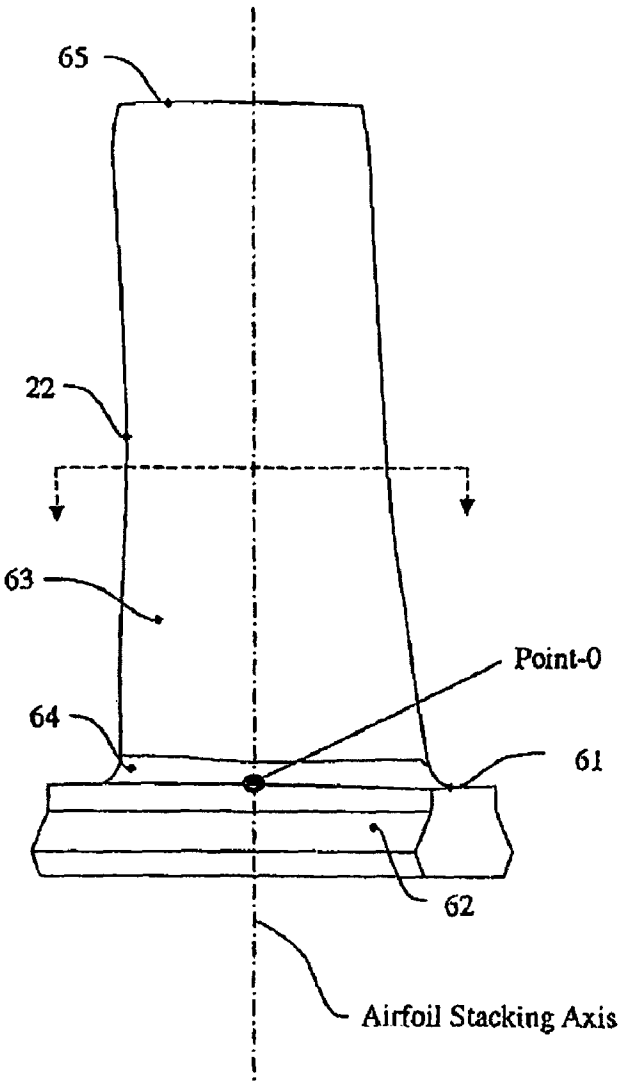
Figure 8:
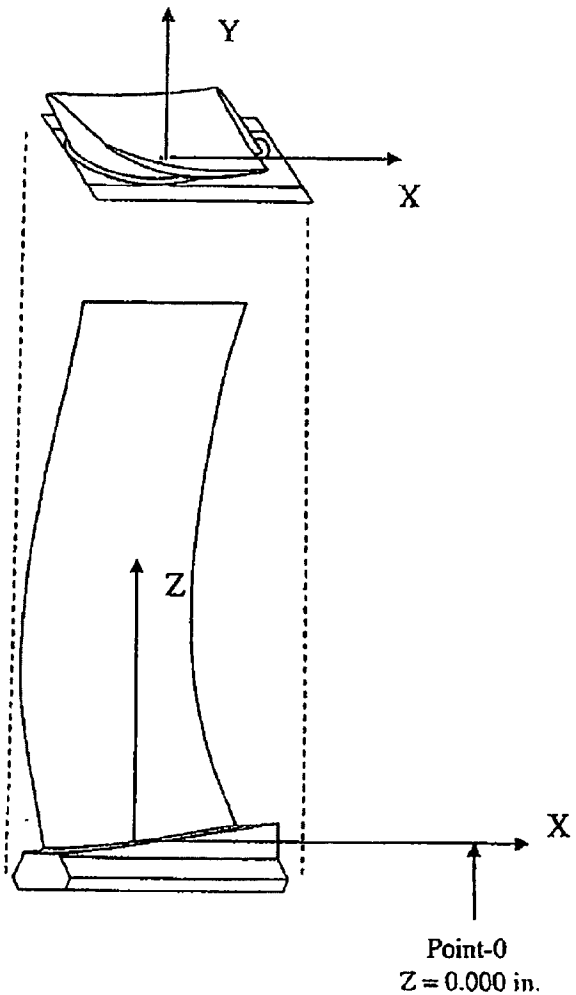
FIGS. 7 and 8 are side views of the vane of FIG. 2 and associated platform and dovetail connection as embodied by the invention.
Figure 7:
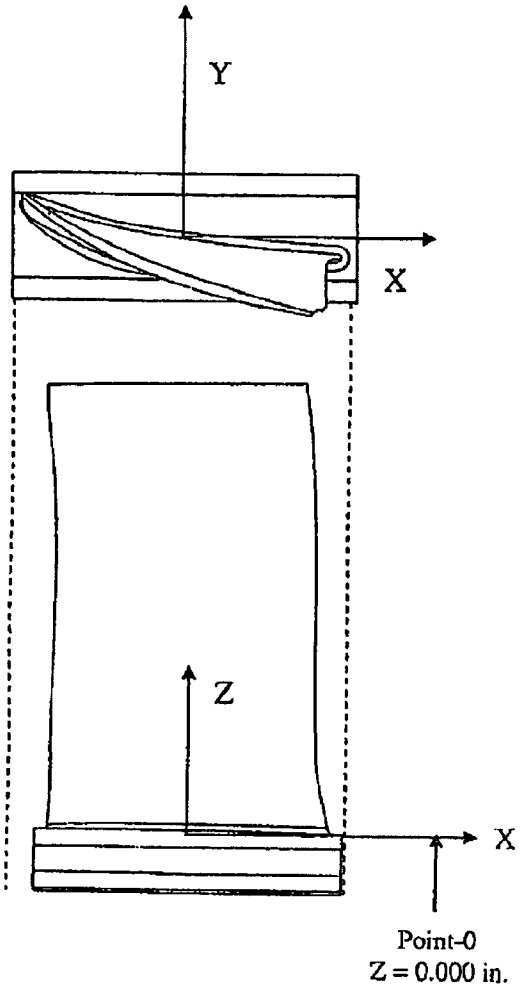

In the exemplary embodiments, as embodied by the invention, for example the stage compressor blade, there are many airfoils, which are un-cooled. For reference purposes only, there is established point-0 passing through the intersection of the airfoil and the platform along the stacking axis, as illustrated in FIG. 5.

It will also be appreciated that the exemplary airfoil(s) disclosed in the above TABLE A may be scaled up or down geometrically for use in other similar compressor designs. Consequently, the coordinate values set forth in TABLE A may be scaled upwardly or downwardly such TABLE A the airfoil profile shape remains unchanged. A scaled version of the coordinates in the TABLE A would be represented by X, Y and Z coordinate values of the TABLE A multiplied or divided by a constant.

In particular, as embodied by the invention, the airfoil as defined by TABLE A, can be applied in a compressor of a turbine, for example, but not limited to, as General Electric "7FA+e" compressor. Moreover, the blade airfoil profile, as embodied by the invention, can comprise a first rotating stage "R0"of a compressor. This compressor is merely illustrative of the intended applications for the airfoil, as embodied by the invention. Moreover, it is envisioned that the airfoil of TABLE A, as embodied by the invention, can also be used in GE Frame F-class turbines, as well as GE's Frame 6 and 9 turbines, given the scaling of the airfoil, as embodied by the invention.

The airfoils impart kinetic energy to the airflow and therefore bring about a desired flow across the compressor. The airfoils turn the fluid flow, slow the fluid flow velocity (in the respective airfoil frame of reference), and yield a rise in the static pressure of the fluid flow. The configuration of the airfoil (along with its interaction with surrounding airfoils), as embodied by the invention, including its peripheral surface provides for stage airflow efficiency, enhanced aeromechanics, smooth flow from stage to stage, reduced thermal stresses, enhanced interrelation of the stages to effectively pass the airflow from stage to stage, and reduced mechanical stresses, among other desirable aspects of the invention. Typically, multiple rows of airfoil stages, such as, but not limited to, rotor/stator airfoils, are stacked to achieve a desired discharge to inlet pressure ratio. Airfoils can be secured to wheels or a case by an appropriate attachment configuration, often known as a "root", "base" or "dovetail".

The configuration of the airfoil and any interaction with surrounding airfoils, as embodied by the invention, that provide the desirable aspects fluid flow dynamics and flow of the invention can be determined by various means. Fluid flow from a preceding/upstream airfoil intersects with the airfoil, as embodied by the invention, and via the configuration of the instant airfoil, flow over and around the airfoil, as embodied by the invention, is enhanced. In particular, the fluid dynamics and flow from the airfoil, as embodied by the invention, is enhanced. There is a smooth transition fluid flow from any preceding/upstream airfoil(s) and a smooth transition fluid flow to the adjacent/downstream airfoil(s). Moreover, the flow from the airfoil, as embodied by the invention, proceeds to the adjacent/downstream airfoil(s) is enhanced due to the enhanced fluid flow off of the airfoil, as embodied by the invention. Therefore, the configuration of the airfoil, as embodied by the invention, assists in the prevention of turbulent fluid flow in the unit comprising the airfoil, as embodied by the invention.

For example, but in no way limiting of the invention, the airfoil configuration (with or without fluid flow interaction) can be determined by computational modeling, Fluid Dynamics (CFD); traditional fluid dynamics analysis; Euler and Navier-Stokes equations; for transfer functions, algorithms, manufacturing: manual positioning, flow testing (for example in wind tunnels), and modification of the airfoil; in-situ testing; modeling: application of scientific principles to design or develop the airfoils, machines, apparatus, or manufacturing processes; airfoil flow testing and modification; combinations thereof, and other design processes and practices. These methods of determination are merely exemplary, and are not intended to limit the invention in any manner.

As noted above, the airfoil configuration (along with its interaction with surrounding airfoils), as embodied by the invention, including its peripheral surface provides for stage airflow efficiency, enhanced aeromechanics, smooth laminar flow from stage to stage, reduced thermal stresses, enhanced interrelation of the stages to effectively pass the airflow from stage to stage, and reduced mechanical stresses, among other desirable aspects of the invention, compared to other similar airfoils, which have like applications. Of course, other such advantages are within the scope of the invention.

While various embodiments are described herein, it will be appreciated from the specification that various combinations of elements, variations or improvements therein may be made by those skilled in the art, and are within the scope of the invention.

What is claimed is:

1. An article of manufacture, the article having a nominal profile substantially in accordance with Cartesian coordinate values of X, Y and Z set forth in TABLE A, and wherein X and Y are distances in inches which, when connected by smooth continuing arcs, define airfoil profile sections at each distance Z in inches, the profile sections at the Z distances being joined smoothly with one another to form a complete airfoil shape.

2. An article of manufacture according to claim 1, wherein the airfoil shape comprises an airfoil.

3. An article of manufacture according to claim 2, wherein said airfoil shape lies in an envelope within ±0.160 inches in a direction normal to any article surface location.

4. An article of manufacture according to claim 1, wherein the airfoil shape comprises a blade.

5. A compressor comprising a compressor casing having a plurality of blades, each of said blades including an airfoil having an airfoil shape, said airfoil having a nominal profile substantially in accordance with Cartesian coordinate values of X, Y and Z set forth in TABLE A, wherein X and Y are distances in inches which, when connected by smooth continuing arcs, define the airfoil profile sections at each distance Z in inches, the profile sections at the Z distances being joined smoothly with one another to form a complete airfoil shape.

6. A compressor comprising a compressor casing having a plurality of blades, each of said blades including an airfoil having an uncoated nominal airfoil profile substantially in accordance with Cartesian coordinate values of X, Y and Z set forth in TABLE A, wherein X and Y are distances in inches which, when connected by smooth continuing arcs, define airfoil profile sections at each distance Z in inches, the profile sections at the Z distances being joined smoothly with one another to form a complete airfoil shape, the X and Y distances being scalable as a function of the same constant or number to provide at least one of a scaled up blade airfoil and scaled down blade airfoil.

7. A compressor according to claim 6 wherein the compressor casing comprises a R0 stage of the compressor.

8. A compressor according to claim 6 wherein said airfoil shape lies in an envelope within ±0.160 inches in a direction normal to any airfoil surface location.

* * * * *